US006017674A

United States Patent [19]

Ezoe et al.

[11] Patent Number: 6,017,674

[45] **Date of Patent: *Jan. 25, 2000**

[54] SILVER HALIDE PHOTOGRAPHIC MATERIAL AND PROCESSING PROCESS THEREOF

[75] Inventors: Toshihide Ezoe; Kohzaburoh Yamada, both of Kanagawa, Japan

[73] Assignee: Fuji Photo Film Co., Ltd., Kanagawa, Japan

[ * ] Notice: This patent is subject to a terminal disclaimer.

[21] Appl. No.: 08/786,640

[22] Filed: Jan. 21, 1997

[30] Foreign Application Priority Data

| | | | |
|---|---|---|---|
| Jan. 19, 1996 | [JP] | Japan | 8-024881 |
| Feb. 1, 1996 | [JP] | Japan | 8-037053 |
| Feb. 1, 1996 | [JP] | Japan | 8-037060 |

[51] Int. Cl.[7] ..... G03C 1/08

[52] U.S. Cl. ..... 430/264; 430/265; 430/440; 430/446

[58] Field of Search ..... 430/264, 566

[56] References Cited

U.S. PATENT DOCUMENTS

| | | | |
|---|---|---|---|
| 4,996,141 | 2/1991 | Ficken et al. | 430/583 |
| 5,378,578 | 1/1995 | Hoshimiya et al. | 430/264 |
| 5,382,496 | 1/1995 | Sakai et al. | 430/264 |
| 5,478,696 | 12/1995 | Arai | 430/264 |
| 5,578,414 | 11/1996 | Yamamoto et al. | 430/264 |

FOREIGN PATENT DOCUMENTS

| | | |
|---|---|---|
| 4102848 | 4/1992 | Japan . |
| WO 9532453 | 11/1995 | WIPO . |

*Primary Examiner*—Hoa Van Le

*Attorney, Agent, or Firm*—Sughrue, Mion, Zinn, Macpeak & Seas, PLLC

[57] ABSTRACT

A silver halide photographic material comprising a support having thereon at least one photosensitive silver halide emulsion layer, wherein at least one of the silver halide emulsion layer and other hydrophilic colloid layers comprises at least one hydrazine compound represented by the following general formula (II) in the form of fine solid dispersion:

$$A—(B)_m \qquad (II)$$

wherein A represents a connecting group; B represents a group represented by the following general formula (III); and m represents an integer of from 2 to 6:

$$—(L_2—Ar_2)_n—L_1—Ar_1—NHNH—G_1—R_1 \qquad (III)$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an $—SO_2—$ group, an —SO— group, a group, a —CO—CO— group, a thiocarbonyl group or an iminomethylene group; $R_2$ represents a group selected from those defined above as $R_1$, and may be different from $R_1$.

6 Claims, No Drawings

SILVER HALIDE PHOTOGRAPHIC MATERIAL AND PROCESSING PROCESS THEREOF

FIELD OF THE INVENTION

The present invention relates to a silver halide photographic material. More particularly, the present invention relates to an ultrahigh contrast silver halide photographic material for use in photomechanical process.

BACKGROUND OF THE INVENTION

In recent years, in the art of photomechanical process, it has been desired to use a photographic light-sensitive material excellent in original reproducibility and a processing system which can operate with reduced amount of waste liquid to be disposed so as to cope with diversification and complexity of printed matters and the rise in environmental awareness.

In order to obtain good reproduction of a halftone image in continuous gradation or of a line work, an image formation system exhibiting an ultrahigh contrast (particularly having a $\gamma$ value of 10 or more) photographic property is required.

For forming a high contrast image, a lithographic development system employing a so-called "infectious development effect" has been commonly used. However, this lithographic development system is disadvantageous in that the developer is too unstable to be used. An image forming system has been desired in which the photographic light-sensitive material is developed with a processing solution having a good storage stability to obtain an ultrahigh contrast. Examples of such an image forming system are disclosed in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836 and 5,650,746. In this image forming system, a surface latent image type silver halide photographic material comprising a hydrazine derivative incorporated therein is developed with a stable MQ or PQ developer having a pH value of from 11.0 to 12.3 to obtain an ultrahigh negative image having $\gamma$ of more than 10. In accordance with this process, an ultrahigh contrast and a high photographic sensitivity can be obtained. Further, a sulfite can be added to the developer in a high concentration. Accordingly, the developer thus obtained exhibits a remarkably improved stability against air oxidation as compared with the conventional lith developers.

The above described methods make it possible to use a high concentration sulfite preservative to enhance the stability of the developer. However, in order to obtain an ultrahigh contrast photographic image, it is necessary that a developer having a relatively high pH value be used. Such a developer having a relatively high pH value is liable to air oxidation. Thus, it is necessary that the developer be replenished at a high rate. Therefore, some means have been elaborated in an attempt to realize an ultrahigh contrast photographic image forming system comprising the nucleation development with a hydrazine compound by using a developer having a lower pH value.

U.S. Pat. Nos. 4,269,929 (corresponding to JP-A-61-267759 (The term "JP-A" as used herein means an "unexamined published Japanese patent application")), 4,737,452 (corresponding to JP-A-60-179734), 5,104,769, 4,798,780, 4,998,604 and 4,994,365, JP-A-1-179939 and JP-A-1-179940 disclose a process which comprises the use of a hydrazine nucleating agent having high activity and a nucleation accelerator in order to obtain an ultrahigh image with a stable developer having a pH value of less than 11.0. These publications also disclose that a chemically-sensitized silver halide emulsion having a high silver chloride content also has a high nucleation activity. However, this process is disadvantageous in that the developer needs to be replenished at a rate of from 320 to 450 ml per $m^2$ of silver halide photographic material to be processed. Further enhancement of the processing stability of the system has been desired.

The use of such a highly active hydrazine nucleating agent is disadvantageous in that a sand-like fog called black pepper tends to occur in the unexposed areas or that the photographic light-sensitive material is sensitized more than desired when aged under natural conditions.

Further, the use of the above described highly active hydrazine nucleating agent is disadvantageous in that when the emulsion layer coating solution containing such a hydrazine nucleating agent is aged in the form of solution, sensitization is effected vigorously, raising some problems in productivity.

The incorporation of a hydrazine compound in the coating solution in the form of solid dispersion is disclosed in JP-A-2-3033, JP-A-7-175159 and JP-A-4-102848. However, the techniques disclosed therein cannot solve the above described problems.

Further, the use of such a highly active nucleating agent is disadvantageous in that the nucleating agent in the photographic light-sensitive material is decomposed more rapidly than desired with the lapse of time during natural aging, giving a great adverse effect on photographic properties. JP-A-7-175159 discloses that a hydrazine compound is incorporated in a coating solution in the form of solid dispersion and an amino compound is incorporated in the photographic light-sensitive material as a nucleation accelerator. However, such an amino compound accelerates the decomposition of the nucleating agent, and thus the above described problems are worsened.

SUMMARY OF THE INVENTION

It is therefore an object of the present invention to provide a silver halide photographic material which exhibits an ultrahigh contrast, an excellent processing stability and an excellent productivity and a process for the processing thereof.

Another object of the present invention is to provide a silver halide photographic material which exhibits an ultrahigh contrast, an excellent original reproducibility, a high processing stability and an excellent aging stability.

A further object of the present invention is to provide a photographic light-sensitive material which exhibits an ultrahigh contrast and an excellent aging stability and is insusceptible to the generation of black pepper.

These and other objects of the present invention will become more apparent from the following description.

The above described objects of the present invention has been achieved by providing:

a silver halide photographic material comprising a support having thereon at least one photosensitive silver halide emulsion layer, wherein at least one of the silver halide emulsion layer and other hydrophilic colloid layers comprises at least one hydrazine compound represented by the following general formula (II) in the form of fine solid dispersion:

$$A—(B)_m \quad (II)$$

wherein A represents a connecting group; B represents a group represented by the following general formula (III); and m represents an integer of from 2 to 6:

$$—(L_2—Ar_2)_n—L_1—Ar_1—NHNH—G_1—R_1 \quad (III)$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

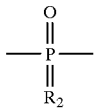

group, a —CO—CO— group, a thiocarbonyl group or an iminomethylene group; $R_2$ represents a group selected from those defined above as $R_1$, and may be different from $R_1$; and providing a processing process thereof which comprises the steps of:

imagewise exposing a silver halide photographic material; and developing the exposed silver halide photographic material while replenishing a developer, wherein the developer is substantially free of dihydroxybenzene developing agents and contains a developing agent represented by the following general formula (1):

(1)

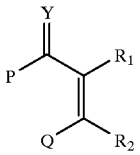

wherein $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group, or P and Q represent atomic groups which are connected to each other to form a 5- to 7-membered ring with the two vinyl carbon atoms on which $R_1$ and $R_2$ substitute and the carbon atom on which Y substitutes; and Y represents =O or =N—$R_3$ wherein $R_3$ represents a hydrogen atom, a hydroxyl group, an alkyl group, an acyl group, a hydroxyalkyl group, a sulfoalkyl group or a carboxyalkyl group.

The present invention also relates a silver halide photographic material comprising a support having thereon at least one photosensitive silver halide emulsion layer, wherein at least one of the silver halide emulsion layer and other hydrophilic colloid layers comprises:

(i) at least one hydrazine compound represented by the following general formula (N) in the form of fine solid dispersion:

(N)

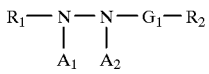

wherein $R_1$ represents an aliphatic group, an aromatic group or a heterocyclic group; $R_2$ represents a hydrogen atom, an alkyl group, an aryl group, a heterocyclic group, an alkoxy group, an aryloxy group, an amino group or a hydrazino group; $G_1$ represents a —CO— group, an —$SO_2$— group, an —SO— group, a

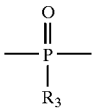

group, a —CO—CO— group, a thiocarbonyl group or an iminomethylene group; $A_1$ and $A_2$ both represent a hydrogen atom at the same time, or one of $A_1$ and $A_2$ represents a hydrogen atom and the other represents a substituted or unsubstituted, alkylsulfonyl, arylsulfonyl or acyl group; and $R_3$ represents a group selected from those defined above as $R_2$, and may be different from $R_2$; and (ii) at least one nucleation accelerator represented by the following general formula (2), (3), (4) or (5):

(2)

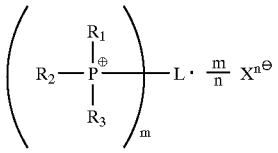

wherein $R_1$, $R_2$ and $R_3$ each represents an alkyl group, a cycloalkyl group, an aralkyl group, an aryl group, an alkenyl group, a cycloalkenyl group, an alkynyl group or a heterocyclic residue; m represents an integer; L represents an organic group having a valence of n, and is connected to the P atom with its carbon atom; and n represents an integer of from 1 to 3;

(3)

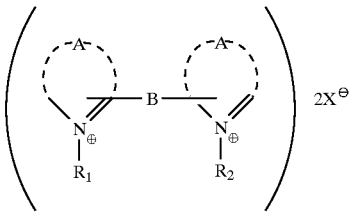

-continued (4)

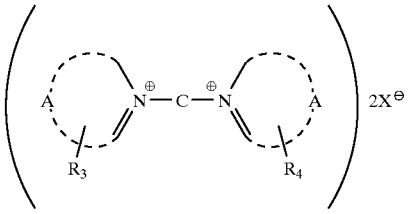

wherein A represents an organic group for completing a heterocyclic group; B and C each represents a connecting group comprising one or more of an alkylene, arylene, alkenylene, alkynylene, —$SO_2$—, —SO—, —O—, —S—, —N($R_N$)— (wherein $R_N$ represents an alkyl group, an aryl group, an aralkyl group or a hydrogen atom), —C═O— and —P═O— group; $R_1$ and $R_2$ each represents an alkyl group or an aralkyl group; $R_3$ and $R_4$ each represents a hydrogen atom or a substituent; and X represents an anion group, provided that X is omitted when the nucleation accelerator represented by general formula (3) or (4) is an intramolecular salt;

(5)

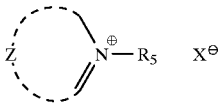

wherein Z represents an organic group for completing a heterocyclic group; $R_5$ represents an alkyl group or an aralkyl group; X represents an anion group, provided that X is omitted when the nucleation accelerator represented by general formula (5) is an intramolecular salt, and that no amino groups are contained in the molecule.

The present invention further relates a silver halide photographic material comprising a support having thereon at least one photosensitive silver halide emulsion layer:

wherein the silver halide emulsion is a selenium or tellurium sensitized emulsion; and wherein at least one of the silver halide emulsion layer and other hydrophilic colloid layers comprises at least one hydrazine compound represented by the following general formula (N) in the form of fine solid dispersion:

(N)

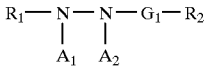

wherein $R_1$ represents an aliphatic group, an aromatic group or a heterocyclic group; $R_2$ represents a hydrogen atom, an alkyl group, an aryl group, a heterocyclic group, an alkoxy group, an aryloxy group, an amino group or a hydrazino group; $G_1$ represents a —CO— group, an —$SO_2$— group, an —SO— group, a

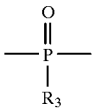

group, a —CO—CO— group, a thiocarbonyl group or an iminomethylene group; $A_1$ and $A_2$ both represent a hydrogen atom at the same time, or one of $A_1$ and $A_2$ represents a hydrogen atom and the other represents a substituted or unsubstituted, alkylsulfonyl, arylsulfonyl or acyl group; and $R_3$ represents a group selected from those defined above as $R_2$, and may be different from $R_2$.

DETAILED DESCRIPTION OF THE INVENTION

The constitution of the present invention is described in detail below.

The hydrazine compound represented by general formula (II) for use in the present invention as a nucleating agent is described in more detail below.

In partial structure B (general formula (III)) in general formula (II), the aromatic group represented by $Ar_1$ or $Ar_2$ includes monocyclic and bicyclic aryl groups such as benzene ring and naphthalene ring. The aromatic heterocyclic group represented by $Ar_1$ or $Ar_2$ includes monocyclic and bicyclic, aromatic heterocyclic groups which may be condensed with an aryl group. Examples thereof include a pyridine ring, a pyrimidine ring, an imidazole ring, a pyrazole ring, a quinoline ring, an isoquinoline ring, a benzimidazole ring, a thiazole ring and a benzothiazole ring.

$Ar_1$ and $Ar_2$ each are preferably the aromatic group, particularly preferably a phenylene group.

$Ar_1$ and $Ar_2$ each may be substituted, and examples of the substituent include an alkyl group (including active methine groups), an alkenyl group, an alkynyl group, an aryl group, a group containing a heterocycle, a group containing a heterocycle containing a quaternarized nitrogen atom (e.g., pyridinio group), a hydroxyl group, an alkoxy group (including a group containing an ethyleneoxy group or a propyleneoxy group as a repeating unit), an aryloxy group, an acyloxy group, an acyl group, an alkoxycarbonyl group, an aryloxycarbonyl group, a carbamoyl group, a urethane group, a carboxyl group (including salts thereof), an imide group, an amino group, a carbonamido group, a sulfonamido group, a ureide group, a thioureide group, a sulfamoylamino group, a semicarbazide group, a thiosemicarbazide group, a hydrazino group, a quaternary ammonio group, a mercapto group, an (alkyl, aryl or heterocyclic)thio group, an (alkyl or aryl)sulfonyl group, an (alkyl or aryl)sulfinyl group, a sulfo group (including salts thereof), a sulfamoyl group, an acylsulfamoyl group, an (alkyl or aryl)sylfonylureide group, an (alkyl or aryl)sulfonylcarbamoyl group, a halogen atom, a cyano group, a nitro group, an amide phosphate group, a group containing a phosphoric acid ester structure, a group having a acylurea structure, a group containing a selenium atom or a tellurium atom, a group having a tertiary sulfonium structure or a quaternary sulfonium structure, and a group containing a quaternarized phosphorus atom. These substituents may be further substituted by one or more of these substituents.

Of these examples, preferred substituents include an alkyl group having from 1 to 20 carbon atoms, an aralkyl group, a heterocyclic group, a substituted amino group, an acylamino group, a sulfonamido group, a ureide group, a sulfamoylamino group, an imide group, a thioureide group, an amide phosphate group, a hydroxyl group, an alkoxy group, an aryloxy group, an acyloxy group, an acyl group, an alkoxycarbonyl group, an aryloxycarbonyl group, a carbamoyl group, a carboxyl group (including salts thereof), an (alkyl, aryl or heterocyclic)thio group, a sulfo group (including salts thereof), a sulfamoyl group, a halogen atom, a cyano group, a nitro group.

The group represented by $Ar_1$ is particularly preferably an unsubstituted phenylene group.

In general formula (III), the alkyl group represented by $R_1$ is preferably an alkyl group having from 1 to 10 carbon atoms, and the aryl group represented by $R_1$ is preferably a monocyclic or bicyclic aryl group, e.g., an aryl group containing a benzene ring.

The heterocyclic group represented by $R_1$ is preferably a 5- or 6-membered compound containing at least one nitrogen, oxygen and sulfur atom. Examples thereof include an imidazolyl group, a pyrazolyl group, a triazolyl group, a tetrazolyl group, a pyridyl group, a pyridinio group, a quinolinio group and a quinolinyl group. Particularly preferred among these compounds are a pyridyl group and a pyridinio group.

The alkoxy group represented by $R_1$ preferably has from 1 to 8 carbon atoms. The aryloxy group represented by $R_1$ is preferably a monocyclic aryloxy group. The amino group represented by $R_1$ is preferably an unsubstituted amino group, a $C_{1-10}$ alkylamino group, an arylamino group or a saturated or unsaturated heterocyclic amino group.

$R_1$ may be substituted, and examples of the substituent include those listed above as a substituent on $Ar_1$ and $Ar_2$.

If $G_1$ is a —CO— group, preferred examples of the group represented by $R_1$ include a hydrogen atom, an alkyl group (e.g., methyl, trifluoromethyl, difluoromethyl, 2-carboxytetrafluoroethyl, pyridiniomethyl, 3-hydroxypropyl, 3-methanesulfonamidopropyl, phenylsulfonylmethyl), an aralkyl group (e.g., o-hydroxybenzyl) and an aryl group (e.g., phenyl, 3,5-dichlorophenyl, o-methanesulfonamidophenyl, o-carbamoylphenyl, 4-cyanophenyl, 2-hydroxymethylphenyl). Particularly preferred among these groups are a hydrogen atom and an alkyl group.

If $G_1$ is an —$SO_2$— group, preferred examples of the group represented by $R_1$ include an alkyl group (e.g., methyl), an aralkyl group (e.g., o-hyroxybenzyl), an aryl group (e.g., phenyl) or a substituted amino group (e.g., dimethylamino).

If $G_1$ is a —COCO— group, preferred examples of the group represented by $R_1$ include an alkoxy group, an aryloxy group or an amino group. Particularly, an alkylamino group, an arylamino group, a heterocyclic amino group (including a heterocyclic group containing a quaternarized nitrogen atom) are preferred. Examples thereof include 2,2,6,6-tetramethylpipieridine-4-ylamino, propylamino, anilino, o-hydroxyanilino, 5-benzotriazolylamino, N-benzyl-3-pyridinioamino.

Alternatively, $R_1$ may be a group which allows the $G_1$—$R_1$ moiety to be separated from the rest of the molecule to cause cyclization reaction that produces a cyclic structure containing atoms constituting —$G_1$—$R_1$ moiety. Examples of such a group include those described in JP-A-63-29751.

The compound represented by general formula (II) may comprise an adsorptive group incorporated therein which is adsorbed by silver halide. Examples of such an adsorptive group include groups described in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as an alkylthio group, an arylthio group, a thiourea group, a thioamido group, a mercaptoheterocyclic group and a triazole group. These adsorptive groups for silver halide may be in the form of precursor. Examples of the precursor include those described in JP-A-2-285344.

The connecting groups represented by $L_1$ and $L_2$ in general formula (III) comprises —O—, —S—, —N($R_N$)— (wherein $R_N$ represents a hydrogen atom, an alkyl group or an aryl group), —CO—, —C(=S)—, —$SO_2$—, —SO—, —P=O— and an alkylene group, singly or in combination of two or more thereof. Specific examples of the group comprising the combination of the above described groups include —CON($R_N$)—, $SO_2$N($R_N$)—, —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S-(alkylene group)—CONH—, —O-(alkylene group)—CONH— and —O-(alkylene group)—NHCO—. These connecting groups may be connected to the rest of the molecule (III) either on the left or right side thereof.

In general formula (III), if the connecting group represented by $L_1$ or $L_2$ contains a group having a valence of 3 or more, $L_1$ may be connected to two or more groups represented by —$Ar_1$—NHNH—$G_1$—$R_1$ in general formula (III), and $L_2$ may be connected to two or more groups represented by —$Ar_2$—$L_1$—$Ar_1$—NHNH—$G_1$—$R_1$ in general formula (III).

In this case, the connecting group having a valence of 3 or more contained in $L_1$ and $L_2$ is an amino group or alkylene group.

In general formula (III), $L_1$ is preferably —$SO_2$NH—, —NHCONH—, —NHC(=S)NH—, —OH, —S—, —N($R_N$)— or an active methine group, particularly preferably a —$SO_2$NH— group. $L_2$ is preferably a —CON($R_N$)—, —$SO_2$N($R_N$)—, —COO—, —N($R_N$)CON($R_N$)— or —N($R_N$)CSN($R_N$)— group.

In general formula (II), the connecting group represented by A is a divalent to hexavalent connecting group capable of connecting with 2 to 6 groups represented by B. The connecting group A is a single bond or comprises —O—, —S—, —N($R_N$)— (wherein $R_N$ represents a hydrogen atom, an alkyl group or an aryl group), —$N^+(R_N)_2$— (wherein two $R_N$ groups may be the same or different and may be connected to each other to form a ring), —CO—, —C(=S)—, —$SO_2$—, —SO—, —P(=O)—, an alkylene group, an cycloalkylene group, an alkenylene group, an alkynylene group, an arylene group and a heterocyclic group, singly or in combination or two or more thereof. The heterocyclic group may be one containing a quaternarized nitrogen atom such as a pyridinio group.

The connecting group represented by A in general formula (II) may be substituted, and examples the substituent include those listed above as a substituent on $Ar_1$ and $Ar_2$ in formula (III).

When n is 0, the connecting group represented by A preferably contains at least one of a benzene ring, a naphthalene ring, a saturated or unsaturated heterocyclic group, a heterocyclic group containing a quaternarized nitrogen atom (e.g., pyridinio group), a quaternarized nitrogen atom such as an ammonio group, and a cycloalkylene group.

When n is 1, the connecting group represented by A preferably contains at least one of a single bond, a benzene ring, a naphthalene ring, a saturated or unsaturated heterocyclic group, a heterocyclic group containing a quaternarized nitrogen atom (e.g., pyridinio group), a quaternarized nitrogen atom such as an ammonio group, and a cycloalkylene group.

Symbol m in general formula (II) represents an integer of from 2 to 6, more preferably from 2 to 4, particularly preferably 2 or 3.

Specific examples of the compound represented by general formula (II) are shown below. However, the present invention is not limited to these compounds.

| | | R = | | | |
|---|---|---|---|---|---|
| | | —H | —$CF_2H$ | 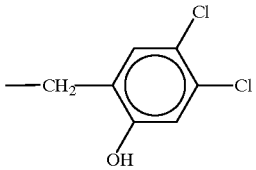 | —$CONHC_3H_7$ |
| 1 | 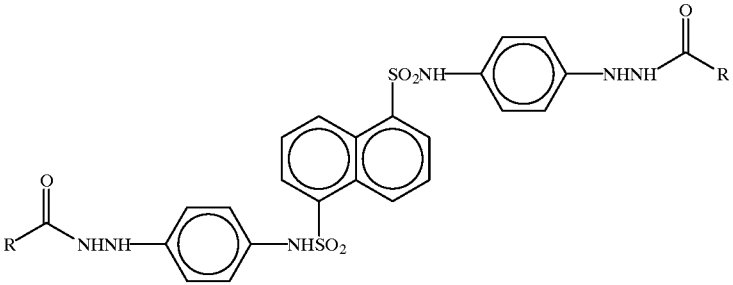 | 1a | 1e | 1k | 1l |
| 2 | 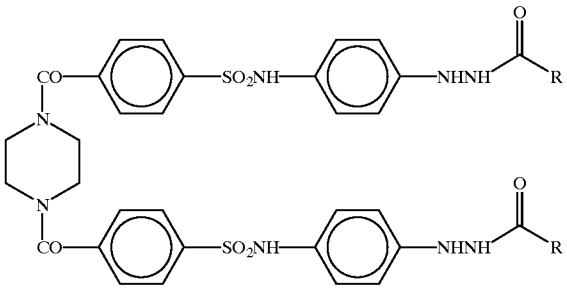 | 2a | 2e | 2k | 2l |

-continued
| | | | | | |
|---|---|---|---|---|---|
| 3 | 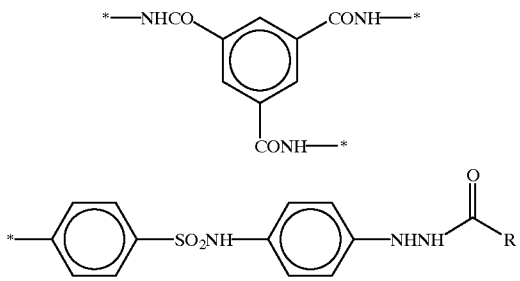 | 3a | 3e | 3k | 3l |
| | | B = | | | |
| | | —H | —$CF_2H$ | —$CONHCF_3$ | —$CF_2SCH_3$ |
| 4 | 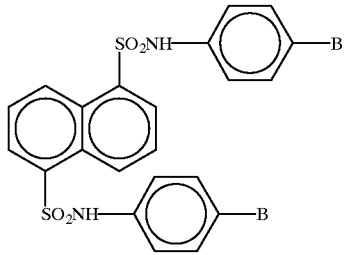 | 4a | 4e | 4p | 4r |
| 5 | 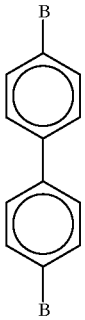 | 5a | 5e | 5p | 5r |

-continued
| | | | | | |
|---|---|---|---|---|---|
| 6 | 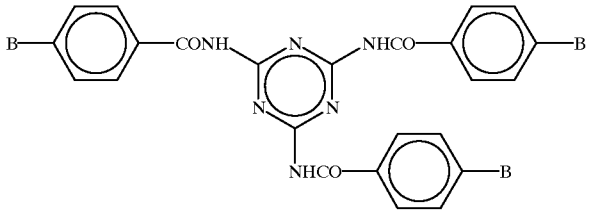 | 6a | 6e | 6p | 6r |
| 7 | 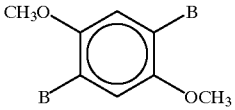 | 7a | 7e | 7p | 7r |
| 8 | 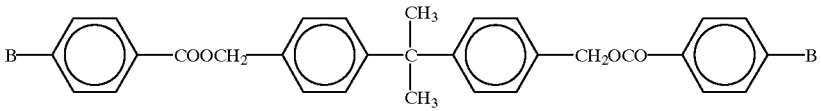 | 8a | 8e | 8p | 8r |
| 9 | 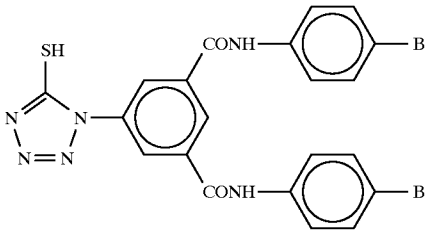 | 9a | 9e | 9p | 9r |
| 10 | 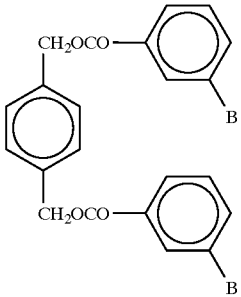 | 10a | 10e | 10p | 10r |
B' =

-continued
| | | —H | —$CF_2H$ | 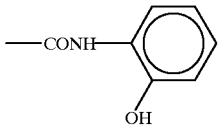 | 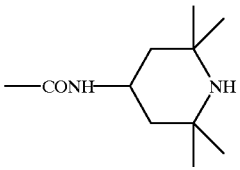 |
|---|---|---|---|---|---|
| 11 | 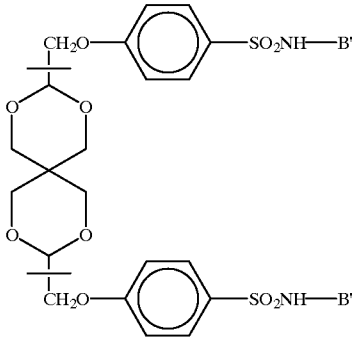 | 11a | 11e | 11s | 11g |
| 12 | 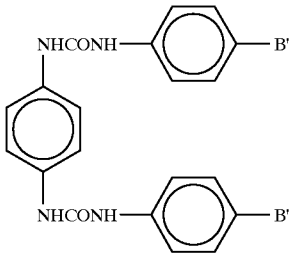 | 12a | 12e | 12s | 12g |
| 13 | 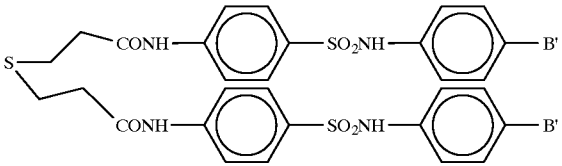 | 13a | 13e | 13s | 13g |

-continued
| | | | | | |
|---|---|---|---|---|---|
| 14 | 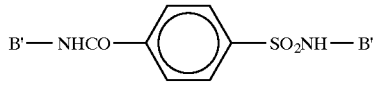 | 14a | 14e | 14s | 14g |
| 15 | 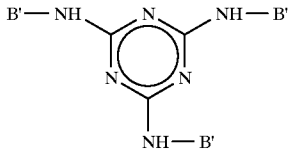 | 15a | 15e | 15s | 15g |
| 16 | 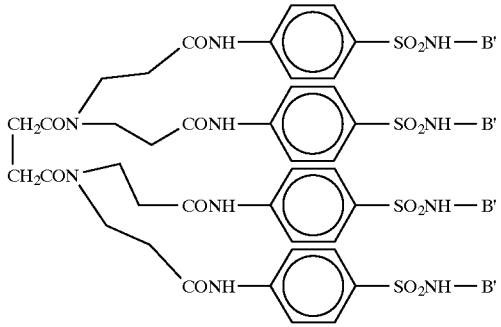 | 16a | 16e | 16s | 16g |
| 17 | 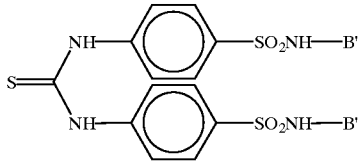 | 17a | 17e | 17s | 17g |
| 18 | 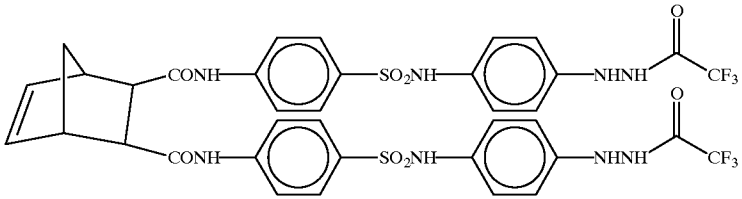 | | | | |

-continued
19
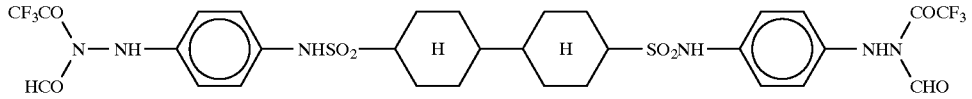
20
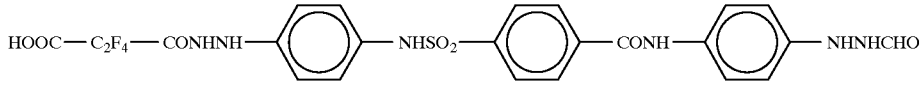
21
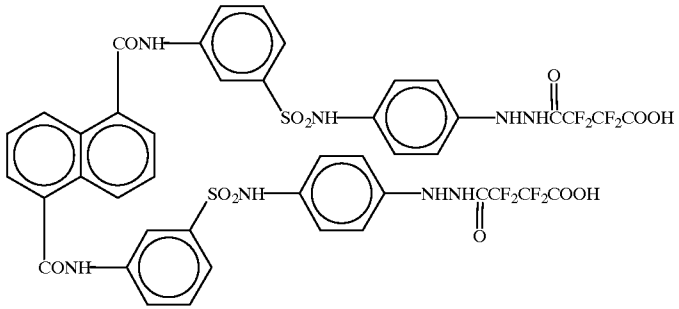
22
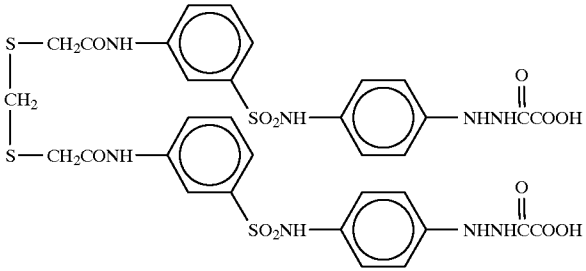
B' = 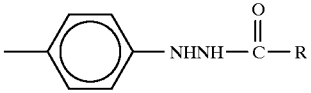
R =

-continued
| | | | | | |
|---|---|---|---|---|---|
| | | —H | —$CF_3$ | —$CF_2H$ | 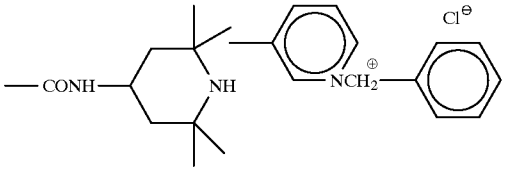 |
| 23 | 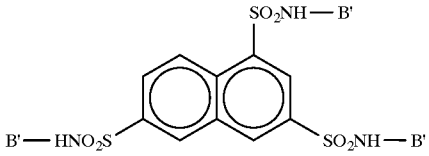 | 23a | 23c | 23e | 23g | 23d |
| 24 | 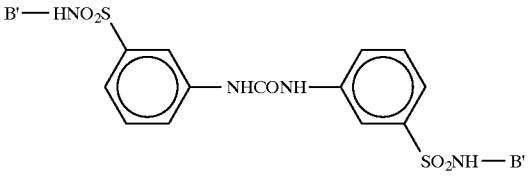 | 24a | 24c | 24e | 24g | 24d |
| 25 | 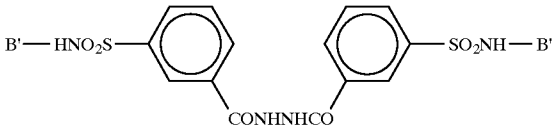 | 25a | 25c | 25e | 25g | 25d |
| 26 | 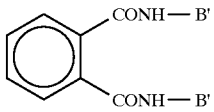 | 26a | 26c | 26e | 26g | 26d |
| | R = | | | | |
|---|---|---|---|---|---|
| | —H | —$CF_3$ | —$CF_2H$ | —$CONHCH_3$ | 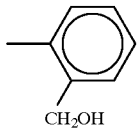 | —$C_2F_4COOH$ |

-continued
| | | | | | | |
|---|---|---|---|---|---|---|
| 27 | 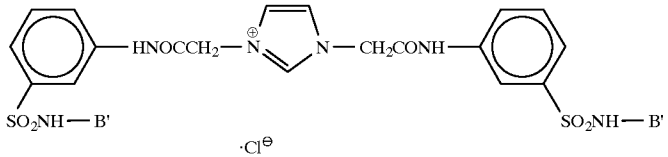 | 27a | 27c | 27e | 27p | 27f | 27t |
| 28 | 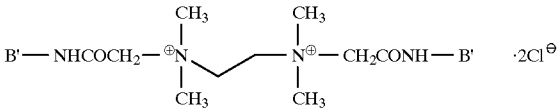 | 28a | 28c | 28e | 28p | 28f | 28t |
| 29 | 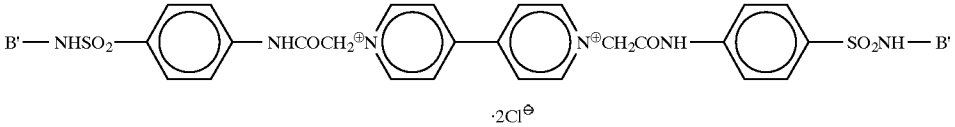 | 29a | 29c | 29e | 29p | 29f | 29t |
| 30 | 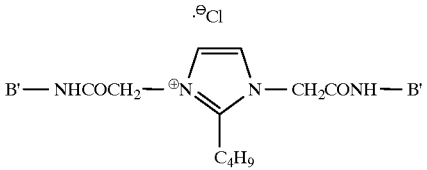 | 30a | 30c | 30e | 30p | 30f | 30t |

The hydrazine nucleating agent of the present invention is incorporated in the photographic light-sensitive material in the form of solid dispersion of finely divided powder (microcrystalline particle). The solid dispersion of microcrystalline particles of hydrazine nucleating agent may be mechanically prepared by means of a known atomizing apparatus (e.g., ball mill, oscillating ball mill, planetary ball mill, sand mill, colloid mill, jet mill, roller mill) in the presence of a dispersant, optionally, using an appropriate solvent (e.g., water, alcohol). The microcrystalline particles of the hydrazine nucleating agent may be prepared by a process which comprises dissolving the hydrazine nucleating agent in an appropriate solvent with a dispersing surface active agent, and then adding the solution to a poor solvent for hydrazine nucleating agent to thereby cause precipitation of microcrystalline particles, or a process which comprises controlling the pH value of the system to make a solution of hydrazine nucleating agent which is then changed in its pH value to undergo microcrystallization. The layer containing a particulate hydrazine nucleating agent may be prepared by a process which comprises dispersing the thus obtained microcrystalline particles of hydrazine nucleating agent in an appropriate binder to prepare an almost uniform solid dispersion, and then applying the dispersion to a desired support. Alternatively, a process may be used which comprises applying a dissociated hydrazine nucleating agent in the form of salt, and then applying an acidic gelatin to the coating so that dispersion is fixed upon coating.

As the binder, there may be used the above described polymer having an active methylene group, or hydrophilic colloid or synthetic polymer which can be incorporated in photosensitive emulsion layer or light-insensitive layer. The hydrophilic colloid for use herein is not specifically limited, but normally is preferably gelatin.

As the dispersing surface active agent, there may be used a known surface active agent. Preferred examples of such a dispersing surface active agent include anionic, nonionic and amphoteric surface active agents. In particular, anionic and/or nonionic surface active agents are preferred.

The particulate hydrazine nucleating agent in the solid dispersion has an average particle diameter of from 0.005 to 10 $\mu$m, preferably from 0.01 to 1 $\mu$m, more preferably from 0.01 to 0.5 $\mu$m.

The hydrazine nucleating agent of the present invention may be incorporated in any of the silver halide emulsion layer or other hydrophilic colloid layers on the silver halide emulsion layer side of the support, but is preferably incorporated in the silver halide emulsion layer or the hydrophilic colloid layer adjacent thereto.

The addition amount of the nucleating agent is preferably from $1\times10^{-6}$ to $1\times10^{-2}$ mol, more preferably from $1\times10^{-5}$ to $1\times10^{-3}$ mol, most preferably from $5\times10^{-5}$ to $1\times10^{-3}$ mol per mol of silver halide.

Examples of a nucleation accelerator for use in the present invention include amine derivatives, onium salts, disulfide derivatives, hydroxymethyl derivatives or the like. Examples of these nucleation accelerators include compounds described in JP-A-7-77783, lines 2 to 37 on page 48 (specifically, Compounds A-1 to A-73 on pp. 49 to 58), compounds represented by Chemical Formula 21, 22 and 23 described in JP-A-7-84331 (specifically, compounds described on pp. 6 to 8), and compounds represented by general formula (Na) and (Nb) described in JP-A-7-104426 (specifically, Compounds Na-1 to Na-22 and Nb-1 to Nb-12 described on pp. 16 to 20).

The nucleation accelerator which is preferably used in the present invention is an onium salt compound represented by general formula (2), (3), (4) or (5). These onium salt compounds is described in more detail below.

(2)

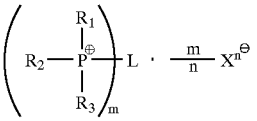

In the above general formula (2), $R_1$, $R_2$ and $R_3$ each represents an alkyl group, a cycloalkyl group, an aralkyl group, an aryl group, an alkenyl group, a cycloalkenyl group, an alkynyl group or a heterocyclic residue. These groups may further contain a substituent.

Symbol m represents an integer. L represents an organic group having a valence of n which is connected to the P atom in general formula (2) with its carbon atom. Symbol n represents an integer of from 1 to 3. X represents an anion having a valence of n. X may be connected to L.

Examples of the group represented by $R_1$, $R_2$ or $R_3$ include straight-chain or branched alkyl groups such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; aralkyl groups such as a substituted or unsubstituted benzyl group; cycloalkyl groups such as a cyclopropyl group, a cyclopentyl group and a cyclohexyl group; aryl groups such as a phenyl group, a naphthyl group and a phenanthryl group; alkenyl groups such as an allyl group, a vinyl group and a 5-hexenyl group; cycloalkenyl groups such as a cyclopentenyl group and a cyclohexenyl group; alkynyl groups such as a phenylethynyl group; and heterocyclic residue such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group and a pyrrolidyl group. Examples of substituents on these groups include the groups represented by $R_1$, $R_2$ and $R_3$, a halogen atom such as a fluorine atom, a chlorine atom, a bromine atom and an iodine atom, a nitro group, a primary amino group, a secondary amino group, a tertiary amino group, an alkylether group, an arylether group, an alkylthioether group, an arylthioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group, an oxycarbonyl group and an acyl group. Examples of the group represented by L include those exemplified as $R_1$, $R_2$ and $R_3$ if m and n each represent 1. If m and n each represent an integer other than 1, examples of the group represented by L include polymethylene groups such as a trimethylene group, a tetramethylene group, a hexamethylene group, a pentamethylene group, an octamethylene group and a dodecamethylene group; divalent aromatic groups such as a phenylene group, a biphenylene group and a naphthylene group; polyvalent aliphatic groups such as a trimethylenemethyl group and a tetramethylenemethyl group; and polyvalent aromatic groups such as a phenylene-1,3,5-toluyl group and a phenylene-1,2,4,5-tetrayl group.

Examples of the anion represented by X include halogen ions such as a chlorine ion, a bromine ion and an iodine ion, carboxylate ions such as an acetate ion, an oxalate ion, a fumarate ion and a benzoate ion, sulfonate ions such as a p-toluene sulfonate, a methane sulfonate, a butane sulfonate and a benzene sulfonate, a sulfuric acid ion, a perchloric acid ion, a carbonic acid ion and a nitric acid ion.

In general formula (2), $R_1$, $R_2$ and $R_3$ each are preferably a group having 20 or less carbon atoms, particularly preferably an aryl group having 15 or less carbon atoms. Symbol m is preferably 1 or 2. When m is 1, L is preferably a group having 20 or less carbon atoms, particularly preferably an alkyl, aralkyl or aryl group having 15 or less carbon atoms. When m is 2, the divalent organic group represented by L is preferably an alkylene group, an arylene group or a divalent group formed by combining these groups, further a divalent group formed by combining these groups with a —CO— group, an —O— group, an —$NR_4$— group (wherein $R_4$ is a hydrogen atom or has the same meaning as $R_1$, $R_2$ and $R_3$, with the proviso that if there are a plurality of $R_4$ groups in the molecule, the plural groups may be the same or different and may be connected to each other), an —S— group, an —SO— group and an —$SO_2$— group. When m is 2, a particularly preferred example of the group represented by L is a divalent group having 20 or less carbon atoms which is connected to the P atom with its carbon atom. When m represents an integer of not less than 2, there are a plurality of $R_1$, $R_2$ and $R_3$ in the molecule. The plurality of $R_1$, $R_2$ and $R_3$ groups may be the same or different.

Symbols n and m each are preferably 1 or 2. X may be connected to $R_1$, $R_2$, $R_3$ or L to form an intramolecular salt.

Most of compounds represented by general formula (2) of the present invention are known and commercially available as reagents. Examples of general synthesis of these compounds include a process which comprises the reaction of a phosphinic acid with an alkylating agent such as halogenated alkyl and sulfonic acid ester, and a process which comprises exchanging paired anion in phosphonium salts by an ordinary method.

Specific examples of the compound represented by general formula (2) is shown below. However, the present invention is not limited to these compounds.

A-1

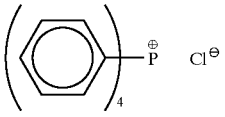

A-2

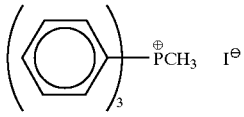

A-3

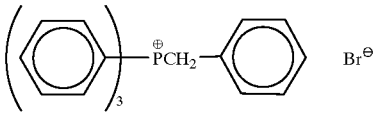

A-4

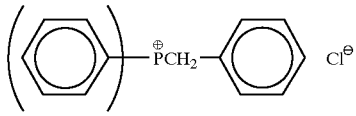

A-5

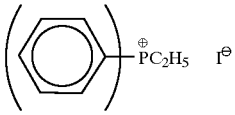

A-6

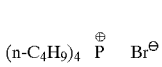

A-7

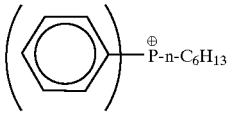

A-8

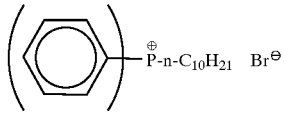

A-9

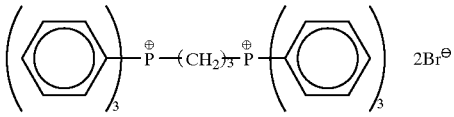

A-10

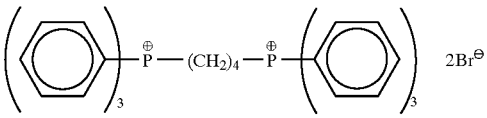

A-11

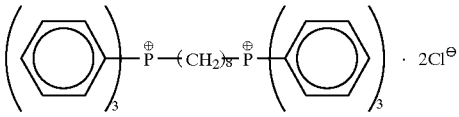

A-12

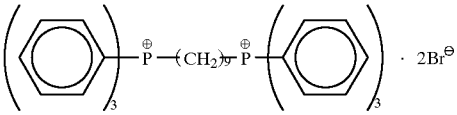

-continued
A-13
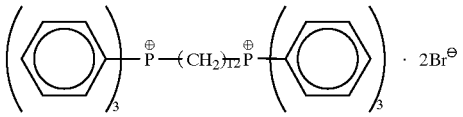
A-14
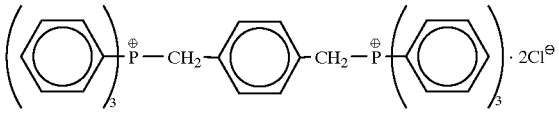
A-15
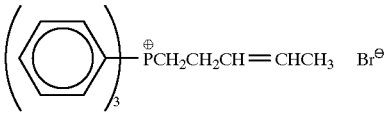
A-16
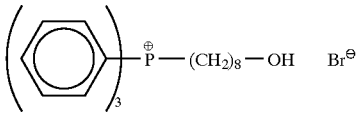
A-17
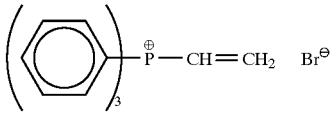
A-18
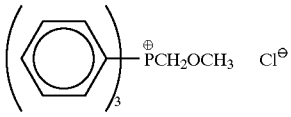
A-19
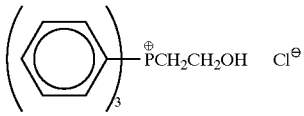
A-20
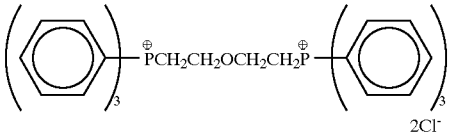
A-21
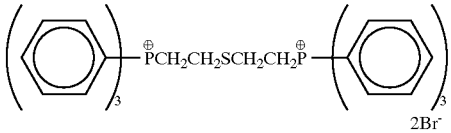
A-22
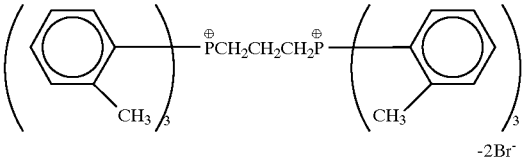
A-23
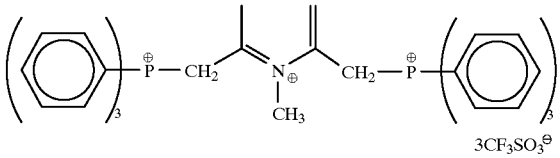
A-24
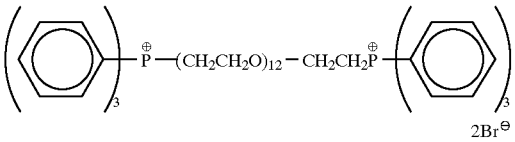
A-25
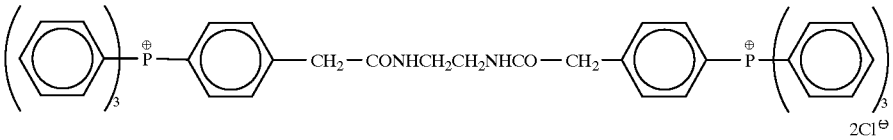
-continued
(4)
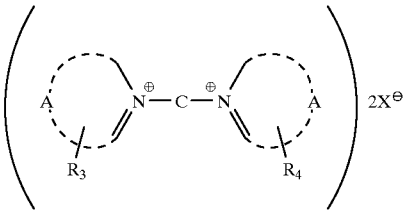
General formulae (3) and (4) are described in more detail below.
(3)
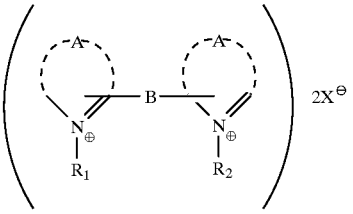
In general formulae (3) and (4), A represents an organic group (including those having a substituent) for completing a heterocyclic group and may contain a carbon, hydrogen, oxygen, nitrogen and sulfur atom. Further, a benzene ring may be condensed to the organic group. Preferred example of the organic group include a 5- or 6-membered nitrogen-containing heterocyclic group. A further preferred example of the organic group is a pyridine ring.

The divalent groups represented by B and C preferably comprises alkylene, arylene, alkenylene, —$SO_2$—, —SO—, —O—, —S—, —N($R_N$)— (wherein $R_N$ represents an alkyl group, an aralkyl group, an aryl group or a hydrogen atom), —C═O— or —P═O—, singly or in combination of two or more thereof. Particularly preferred examples of the divalent groups represented by B and C include alkylene, arylene, —O— or —S—, singly or in combination of two or more thereof.

$R_1$ and $R_2$ may be the same or different and each are preferably a $C_{1-20}$ alkyl group. The alkyl group may be substituted by a substituent. Examples of the substituent include a halogen atom (e.g., chlorine atom, bromine atom), a substituted or unsubstituted alkyl group (e.g., methyl, hydroxyethyl), a substituted or unsubstituted aryl group (e.g., phenyl, tollyl, p-chlorophenyl), a substituted or unsubstituted acyl group (e.g., benzoyl, p-bromobenzoyl, acetyl), an alkyloxycarbonyl group, an aryloxycarbonyl group, a sulfo group, a carboxyl group, a hydroxyl group, an alkoxy group (e.g., methoxy, ethoxy), an aryloxy group, an amido group, a sulfamoyl group, a carbamoyl group, a ureide group, an unsubstituted or alkyl-substituted amino group, a cyano group, a nitro group, an alkylthio group and an arylthio group. Particularly preferred examples of the alkyl group represented by $R_1$ or $R_2$ include a $C_{1-10}$ alkyl group. Preferred among the above described substituents are a carbamoyl group, an oxycarbonyl group, an acyl group, an aryl group, a sulfo group, a carboxyl group and a hydroxyl group.

$R_3$ and $R_4$ each represent a hydrogen atom or a substituent. There may be a plurality of $R_3$ groups and a plurality of $R_4$ groups. The plurality of $R_3$ and $R_4$ groups may be the same or different. Examples of the substituent represented by $R_3$ or $R_4$ include those listed above as the substituent on the alkyl group represented by $R_1$ or $R_2$. Preferred examples of the group represented by $R_3$ or $R_4$ include a $C_{0-10}$ aryl-substituted alkyl group or a substituted or unsubstituted aryl group.

If the heterocyclic group containing A in general formula (3) has a substituent, examples of the substituent include those listed above as the substituent represented by $R_3$ or $R_4$.

X represents an anion group. In the case of intramolecular salt, X is not necessary. Examples of X include a chlorine ion, a bromine ion, an iodine ion, a nitric acid ion, a sulfuric acid ion, a p-toluenesulfonic acid ion and an oxalate ion.

The synthesis of the compound for use in the present invention can be easily accomplished by well-known methods. For the details of these methods, reference can be made to Quart. Rev., 16, 163 (1962).

Specific examples of the compounds represented by general formulae (3) and (4) will be given below, but the present invention is not limited thereto.

B-1

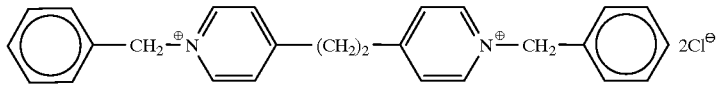

B-2

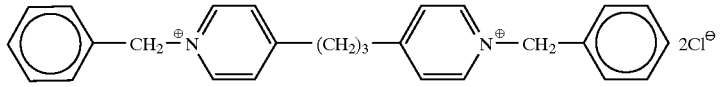

B-3

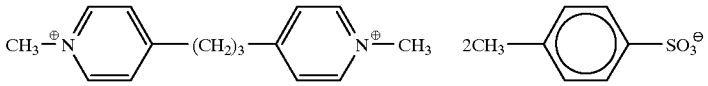

B-4

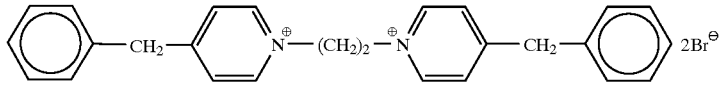

B-5

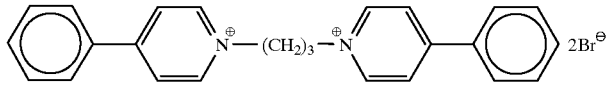

B-6

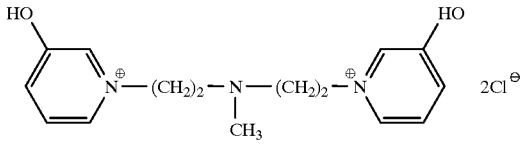

-continued

B-7

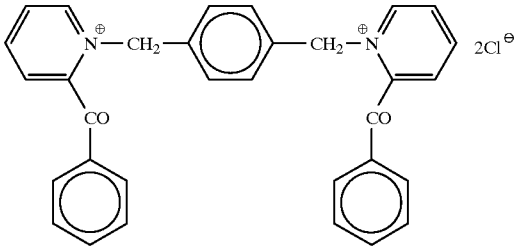

B-8

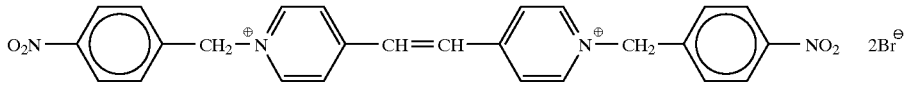

B-9

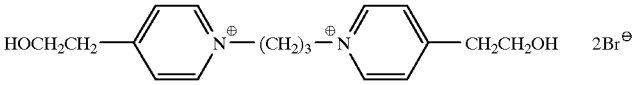

B-10

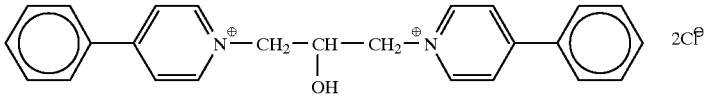

B-11

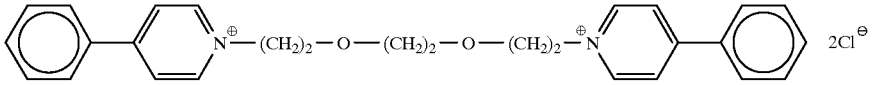

B-12

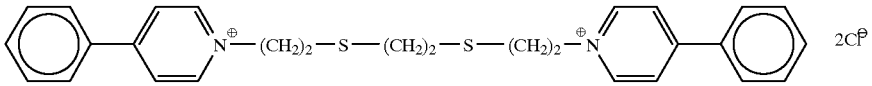

B-13

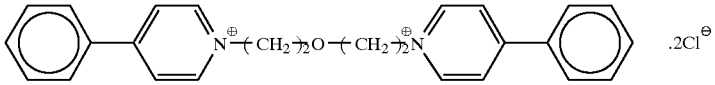

B-14

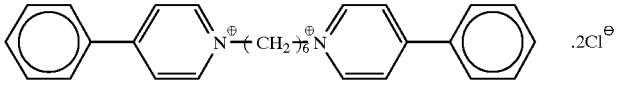

B-15

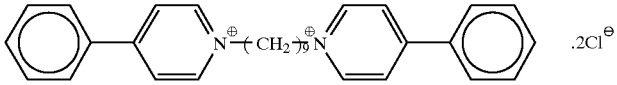

General formula (5) is described in more detail below.

(5)

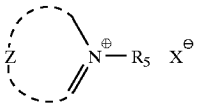

The nitrogen-containing heterocyclic group containing Z may contain a carbon atom, a hydrogen atom, an oxygen atom and a sulfur atom besides a nitrogen atom. A benzene ring may be condensed to the heterocyclic group. Further, the heterocyclic group may have a substituent. The heterocycle thus formed is preferably a 5- or 6-membered aromatic heterocycle, more preferably a pyridine ring, a quinoline ring or an isoquinoline ring.

$R_5$ is preferably a $C_{1-20}$ substituted or unsubstituted alkyl or aralkyl group. $R_5$ may be a straight-chain, branched or cyclic alkyl group. More preferably, $R_5$ is a $C_{1-12}$ alkyl group. Most preferably, $R_5$ is a $C_{1-8}$ alkyl group.

$X^-$ represents an anion group. In the case of intramolecular salt, $X^-$ is not necessary. Examples of $X^-$ include a chlorine ion, a bromine ion, an iodine ion, a nitric acid ion, a sulfuric acid ion, a p-toluenesulfonic acid ion and an oxalate ion.

The groups represented by Z and $R_5$ may be substituted by a substituent. Examples of the substituent include a halogen atom (e.g., chlorine atom, bromine atom), a substituted or unsubstituted aryl group (e.g., phenyl, tollyl, p-chlorophenyl), a substituted or unsubstituted acyl group (e.g., benzoyl, p-bromobenzoyl, acetyl), a sulfo group, a carboxyl group, a hydroxyl group, an alkoxy group (e.g., methoxy, ethoxy), an aryloxy group, an oxycarbonyl group, a an amido group, a sulfamoyl group, a carbamoyl group, a sulfonamido group, a ureide group, an unsubstituted or alkyl-substituted amino group, a cyano group, a nitro group, an alkylthio group and an arylthio group. Particularly preferred examples of the substituent include an oxycarbonyl group, a carbamoyl group, an acyl group, an aryl group, a sulfo group, a carboxyl group and a hydroxyl group.

Preferred examples of the substituent on nitrogen-containing heterocyclic group containing Z further include a substituted or unsubstituted alkyl group (e.g., methyl, hydroxyethyl) and a substituted or unsubstituted aralkyl group (e.g., benzyl, p-methoxyphenethyl).

The synthesis of the compound for use in the present invention can be easily accomplished by well-known methods. For the details of these methods, reference can be made to Quart. Rev., 16, 163 (1962).

Specific examples of the compound represented by general formula (5) are shown below, but the present invention is not limited thereto.

C-1

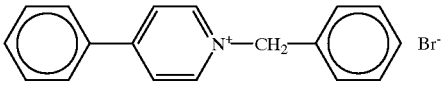

C-2

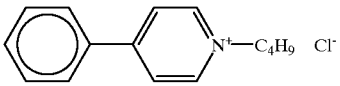

C-3

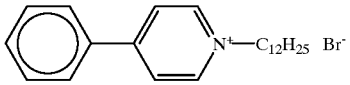

C-4

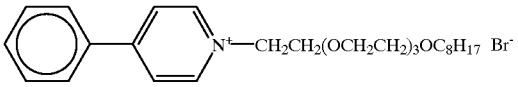

C-5

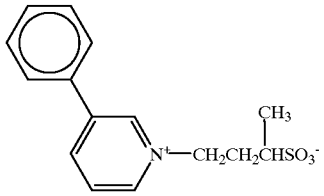

C-6

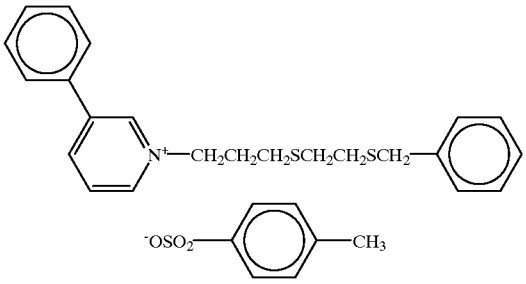

C-7

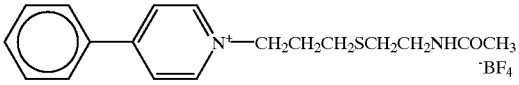

-continued

C-8

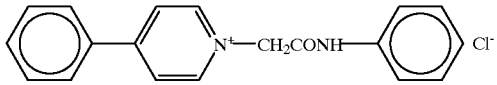

C-9

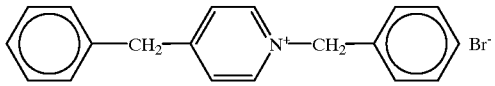

C-10

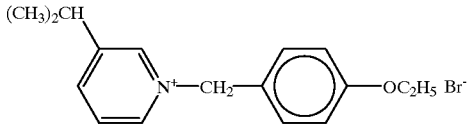

C-11

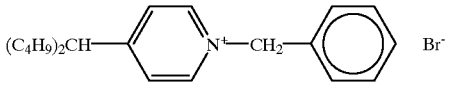

C-12

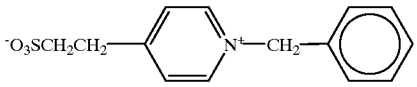

C-13

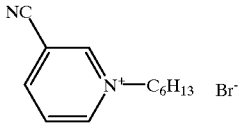

C-14

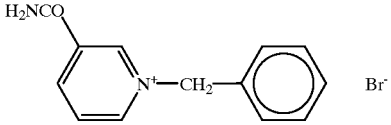

As the nucleation accelerator, there may preferably be also used an amino compound. In particular, the following compounds are preferably used.

Compounds represented by Chemical Formulae 21, 22 and 23 described in JP-A-7-84331 (specifically, compounds described on pp. 6 to 8). Compounds represented by general formula (Na) described in JP-A-7-104426 (specifically, Compounds Na-1 to Na-22 on pp. 16 to 20).

The nucleation accelerator for use in the present invention may be dissolved in an appropriate water-miscible organic solvent such as alcohols (e.g., methanol, ethanol, propanol, fluorinated alcohol), ketones (e.g., acetone, methyl ethyl ketone), dimethylformamide, dimethylsulfoxide and methyl cellosolve, prior to use.

Alternatively, the nucleation accelerator may be used in the form of an emulsion dispersion product obtained by dissolving the compound according to a well known emulsion dispersion method using an oil such as dibutyl phthalate, tricresyl phosphate, glyceryl triacetate or diethylphthalate, or an auxiliary solvent such as ethyl acetate or cyclohexanone, and mechanically forming it into an emulsion dispersion product. Further, powder of the nucleation accelerator may be dispersed in water according to a method known as a solid dispersion method by means of a ball mill, a colloid mill or ultrasonic waves and then used.

The nucleation accelerator for use in the present invention may be added to any of silver halide emulsion layers and other hydrophilic colloid layers on the silver halide emulsion layer side of the support, however, it is preferably added to the silver halide emulsion layer or a hydrophilic colloid layer adjacent thereto.

The nucleation accelerator of the present invention is preferably added in an amount of from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide.

The halogen composition of the silver halide emulsion for use in the present invention is not particularly limited, however, in view of achieving the objects of the present invention more effectively, silver chloride, silver chlorobromide or silver chloroiodobromide having a silver chloride content of 50 mol % or more is preferred. The silver iodide content is preferably less than 5 mol %, more preferably less than 2 mol %.

In the present invention, a light-sensitive material suitable for high illuminance exposure such as scanner exposure or a light-sensitive material for photographing line original contains a rhodium compound so as to achieve high contrast and low fog.

The rhodium compound for use in the present invention may be a water-soluble rhodium compound. Examples thereof include rhodium(III) halogenide compounds and rhodium complex salts having a halogen, an amine or an oxalate as a ligand, such as hexachlororhodium(III) complex salt, hexabromorhodium(III) complex salt, hexaminerhodium(III) complex salt and trisalaterhodium(III) complex salt. The rhodium compound is dissolved in water or an appropriate solvent prior to use and a method commonly used for stabilizing the rhodium compound solution, namely, a method of adding an aqueous solution of hydrogen halogenide (e.g., hydrochloric acid, bromic acid, hydrofluoric acid) or an alkali halide (e.g., KCl, NaCl, KBr, NaBr), may be used. In place of using a water-soluble rhodium, separate silver halide grains which are previously doped with rhodium may be added and dissolved at the time of preparation of silver halide.

The addition amount of the rhodium compound is from $1\times10^{-8}$ to $5\times10^{-6}$ mol, preferably from $5\times10^{-8}$ to $1\times10^{-6}$ mol, per mol of silver of the silver halide emulsion.

The rhodium compound may be added during production of silver halide emulsion grains or at any appropriate stage before coating of the emulsion, however, it is preferably added at the time of formation of the emulsion to incorporate it into a silver halide grain.

The photographic emulsion for use in the present invention can be prepared using a method described in P. Glafkides, *Chimie et Physique Photographique*, Paul Montel (1967); G. F. Duffin, *Photographic Emulsion Chemistry*, The Focal Press (1966); and V. L. Zelikman et al, *Making and Coating Photographic Emulsion*, The Focal Press (1964).

A soluble silver salt may be reacted with a soluble halogen salt by any of a single jet method, a double jet method and a combination thereof.

A method of forming grains in the presence of excessive silver ions (so-called reverse mixing process) may also be used. As one of the double jet method, a method of maintaining the pAg constant in the liquid phase where silver halide is produced, namely, a so-called controlled double jet method may be used. Further, it is preferred to form grains using a so-called silver halide solvent such as ammonia, thioether or tetra-substituted thiourea, more preferably using a tetra-substituted thiourea compound, and this is described in JP-A-53-82408 and JP-A-55-77737. Preferred examples of the thiourea compound include tetramethyl thiourea and 1,3-dimethyl-2-imidazolidinethione.

According to the controlled double jet method or the method of forming grains using a silver halide solvent, a silver halide emulsion comprising regular crystal form grains and having a narrow grain size distribution can be easily prepared, and these methods are a useful means for preparing the silver halide emulsion for use in the present invention.

In order to achieve a uniform grain size, it is preferred to rapidly grow grains within the range of not exceeding the critical saturation degree, using a method of changing the addition rate of silver nitrate or alkali halide according to the grain growth rate as described in British Patent 1,535,016, JP-B-48-36890 and JP-B-52-16364, or a method of changing the concentration of the aqueous solution as described in British Patent 4,242,445 and JP-A-55-158124.

The emulsion of the present invention is preferably a monodisperse emulsion having a coefficient of variation of 20% or less, more preferably 15% or less.

The grains in the monodisperse silver halide emulsion have an average grain size of 0.5 $\mu$m or less, more preferably from 0.1 to 0.4 $\mu$m.

The silver halide emulsion of the present invention is preferably subjected to a chemical sensitization. The chemical sensitization may be performed using a known method such as a sulfur sensitization, a selenium sensitization, a tellurium sensitization or a noble metal sensitization, and these sensitization methods may be used individually or in combination. When these sensitization methods are used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The addition amount of the sulfur sensitizer varies depending upon various conditions such as the pH and the temperature at the time of chemical ripening and the size of silver halide grains, however, it is usually from $10^{-7}$ to $10^{-2}$ mol, preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855, and among these, particularly preferred are the compounds represented by formulae (VIII) and (IX) of JP-A-4-324855.

The tellurium sensitizer for use in the present invention is a compound which generates silver telluride presumed to be a sensitization nuleus, on the surface or in the inside of a silver halide grain. The generating rate of silver telluride in a silver halide emulsion can be examined according to a method described in JP-A-5-313284.

Specific examples of the tellurium sensitizer include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai (compiler), T*he Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The use amount of the selenium sensitizer or the tellurium sensitizer for use in the present invention varies depending upon silver halide grains used or chemical ripening conditions, however, it is usually approximately from $10^{-8}$ to $10^{-2}$ mol, preferably approximately from $10^{-7}$ to $10^{-3}$ mol, per mol of silver halide. The conditions for chemical sensitization in the present invention are not particularly limited, however, the pH is generally from 5 to 8, the pAg is generally from 6 to 11, preferably from 7 to 10, and the temperature is from 40 to 95° C., preferably from 45 to 85° C.

Examples of the noble metal sensitizer for use in the present invention include gold, platinum, palladium and iridium, and gold sensitization is particularly preferred. Specific examples of the gold sensitizer for use in the present invention include chloroauric acid, potassium chlorate, potassium aurithiocyanate and gold sulfide, and the gold sensitizer is used in an amount of approximately from $10^{-7}$ to $10^{-2}$ mol per mol of silver halide.

In the silver halide emulsion for use in the present invention, a cadmium salt, a sulfite, a lead salt or a thallium salt may be present together during formation or physical ripening of silver halide grains.

In the present invention, reduction sensitization may be used. Examples of the reduction sensitizer which can be used include stannous salt, amines, formamidinesulfinic acid and silane compounds.

To the silver halide emulsion of the present invention, a thiosulfonic acid compound may be added according to the method described in European Unexamined Patent Publication EP-A-293917.

In the light-sensitive material for use in the present invention, one kind of silver halide emulsion may be used or two or more kinds of silver halide emulsions (for example, those having different average grain sizes, different halogen compositions, different crystal habits, or different chemical sensitization conditions) may be used in combination.

In the present invention, the silver halide emulsion particularly suitable as a light-sensitive material for dot-to-dot work comprises silver halide having a silver chloride content of 90 mol % or more, preferably 95 mol % or more, more specifically, silver chlorobromide or silver chloroiodobromide containing from 0 to 10 mol % of silver bromide. If the proportion of silver bromide or silver iodide increases, the safelight safety in a bright room may be worsened or the y value is disadvantageously lowered.

The silver halide emulsion for use in the dot-to-dot work light-sensitive material of the present invention preferably contains a transition metal complex, and examples of the transition metal include Rh, Ru, Re, Os, Ir and Cr.

Examples of the ligand include a nitrosyl bridging ligand, a thionitrosyl bridging ligand, a halogen ligand (e.g., fluorine, chlorine, bromine, iodine), a cyanide ligand, a cyanate ligand, a thiocyanate ligand, a selenocyanate ligand, a tellurocyanate ligand, an acid ligand and an aquo ligand. When an aquo ligand is present, it preferably occupies one or more of the ligands.

More specifically, the rhodium atom may be incorporated by forming it into a metal salt in any form, such as a single salt or a complex salt, and adding the salt at the time of preparation of grains.

Examples of the rhodium salt include rhodium monochloride, rhodium dichloride, rhodium trichloride and ammonium hexachlororhodate, and preferred are a halogen complex compound of water-soluble trivalent rhodium, such as hexachlororhodium(III) acid and a salt thereof (e.g., ammonium salt, sodium salt, potassium salt).

The addition amount of the water-soluble rhodate is from $1.0\times10^{-6}$ to $1.0\times10^{-3}$, preferably from $1.0\times10^{-5}$ to $1.0\times10^{-3}$, more preferably from $5.0\times10^{-5}$ to $5.0\times10^{-4}$ mol, per mol of silver halide.

The following transition metal complexes are also preferred.

1. $[Ru(NO)Cl_5]^{-2}$
2. $[Ru(NO)_2Cl_4]^{-1}$
3. $[Ru(NO)(H_2O)Cl_4]^{-1}$
4. $[Rh(NO)Cl_5]^{-2}$
5. $[Re(NO)CN_5]^{-2}$
6. $[Re(NO)ClCN_4]^{-2}$
7. $[Rh(NO)_2Cl_4]^{-1}$
8. $[Rh(NO)(H_2O)Cl_4]^{-1}$
9. $[Ru(NO)CN_5]^{2}$
10. $[Ru(NO)Br_5]^{-2}$
11. $[RU(NS)Cl_5]^{-2}$
12. $[Os(NO)Cl_5]^{-2}$
13. $[Cr(NO)Cl_5]^{-3}$
14. $[Re(NO)Cl_5]^{-1}$
15. $[Os(NS)Cl_4(TeCN)]^{-2}$
16. $[Ru(NS)I_5]^{-2}$
17. $[Re(NS)Cl_4(SeCN)]^{-2}$
18. $[Os(NS)Cl(SCN)_4]^{-2}$
19. $[Ir(NO)Cl_5]^{-2}$

The spectral sensitizing dye for use in the present invention is not particularly limited.

The addition amount of the sensitizing dye for use in the present invention varies depending upon the shape or size of silver halide grains, however, it is usually from $4\times10^{-6}$ to $8\times10^{-3}$ mol per mol of silver halide. For example, when the silver halide grain size is from 0.2 to 1.3 $\mu$m, the addition amount is preferably from $2\times10^{-7}$ to $3.5\times10^{-6}$ mol, more preferably from $6.5\times10^{-7}$ to $2.0\times10^{-6}$ mol, per 1 $m^2$ of the surface area of silver halide grains.

The light-sensitive silver halide emulsion for use in the present invention may be spectrally sensitized to blue light, green light, red light or infrared light, each having a relatively long wavelength, by a sensitizing dye. Examples of the sensitizing dye which can be used include a cyanine dye, a merocyanine dye, a complex cyanine dye, a complex merocyanine dye, a holopolar cyanine dye, a styryl dye, a hemicyanine dye, an oxonol dye and a hemioxonol dye.

Useful sensitizing dyes for use in the present invention are described, for example, in *Research Disclosure*, Item 17643, IV-A, page 23 (December, 1978), ibid., Item 18431X, page 437 (August, 1979), and publications cited therein. In particular, sensitizing dyes having spectral sensitivity suitable for spectral characteristics of various scanner light sources can be advantageously selected to use.

For example, A) for an argon laser light source, simple merocyanines described in JP-A-60-162247, JP-A-2-48653, U.S. Pat. No. 2,161,331, West German Patent 936,071 and JP-A-5-11389, B) for a helium-neon laser light source, trinuclear cyanine dyes described in JP-A-50-62425, JP-A-54-18726 and JP-A-59-102229, C) for an LED light source and a red semiconductor laser, thiacarbocyanines described in JP-B-48-42172, JP-B-51-9609, JP-B-55-39818, JP-A-62-284343 and JP-A-2-105135, and D) for an infrared semiconductor laser light source, tricarbocyanines described in JP-A-59-191032 and JP-A-60-80841, and dicarbocyanines containing a 4-quinoline nucleus described in JP-A-59-192242 and JP-A-3-67242, formulae (IIIa) and (IIIb), may be advantageously selected to use.

These sensitizing dyes may be used individually or in combination, and the combination of sensitizing dyes is often used for the purpose of supersensitization. In combination with the sensitizing dye, a dye which itself has no spectral sensitization effect or a material which absorbs substantially no visible light, but exhibits supersensitization may be incorporated into the emulsion.

Useful sensitizing dyes, combinations of dyes which exhibit supersensitization, and materials which show supersensitization are described in *Research Disclosure*, Vol. 176, 17643, page 23, Item IV-J (December, 1978).

For the argon laser source, dyes S1-1 to S1-13 described in Japanese Patent Application No. 7-104647 are particularly preferably used.

For the helium-neon light source, sensitizing dyes represented by general formula (I) as described from line 1 from the bottom of page 8 to line 4 on page 13 in JP-A-6-75322 are particularly preferred. Also, sensitizing dyes represented by general formula (I) of JP-A-6-75322 are preferably used. Specifically, dyes S2-1 to S2-10 described in Japanese Patent Application No. 7-104647 are particularly preferably used.

Further, sensitizing dyes represented by general formula (I) in JP-A-7-287338, specifically dyes I-1 to I-34, are preferably used.

For the LED source and infrared semiconductor laser, dyes S3-1 to S3-8 described in Japanese Patent Application No. 7-104647 are particularly preferably used.

For the infrared semiconductor laser source, dyes S4-1 to S4-9 described in Japanese Patent Application No. 7-104647 are particularly preferably used.

For the white light source for picture taking, sensitizing dyes represented by general formula (IV) described in JP-A-7-36139 are preferably used. Specifically, dyes S5-1 to S5-20 described in Japanese Patent Application No. 7-104647 are particularly preferably used.

In other embodiments, the hydrazine compound that is used for the particulate solid dispersion can be selected from more wide range than formula (II) in case that a silver halide emulsion is subjected to a selenium or tellurium sensitization and/or that the nucleation accelerator is used in combination.

Preferred known hydrazine compounds for use in the above described other embodiments are represented by the following general formula (N) and, of these, those belonging to the compounds of general formula (II) are particularly preferred:

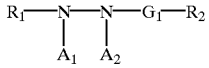

(N)

wherein $R_1$ represents an aliphatic group, an aromatic group or a heterocyclic group; $R_2$ represents a hydrogen atom, an alkyl group, an aryl group, a heterocyclic group, an alkoxy group, an aryloxy group, an amino group or a hydrazino group; $G_1$ represents a —CO— group, an —$SO_2$— group, an —SO— group, a

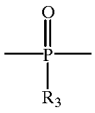

group, —CO—CO— group, a thiocarbonyl group or an iminomethylene group; $A_1$ and $A_2$ represent a hydrogen atom at the same time or one of $A_1$ and $A_2$ represents a hydrogen atom and the other represents a substituted or unsubstituted alkylsulfonyl, arylsulfonyl or acyl group; and $R_3$ is selected from those defined above as $R_2$ and may be different from $R_2$.

In general formula (N), the aliphatic group represented by $R_1$ is preferably a $C_{1-30}$ substituted or unsubstituted, straight-chain, branched or cyclic alkyl, alkenyl or alkynyl group.

In general formula (N), the aromatic group represented by $R_1$ is a monocyclic or bicyclic aryl group such as benzene ring and naphthalene ring. The heterocyclic group represented by $R_1$ is a monocyclic or bicyclic aromatic or nonaromatic heterocyclic group which may be condensed with an aryl group to form a heteroaryl group. Examples thereof include a pyridine ring, a pyrimidine ring, an imidazole ring, a pyrazole ring, a quinoline ring, an isoquinoline ring, a benzimidazole ring, a thiazole ring and a benzothiazole ring.

$R_1$ is preferably an aryl group. $R_1$ may be substituted by a substituent. Representative examples of the substituent include an alkyl group (including active methine group), an alkenyl group, an alkynyl group, an aryl group, a group containing a heterocycle, a group containing a heterocycle containing a quaternarized nitrogen atom (e.g., pyridinio group), a hydroxyl group, an alkoxy group (including a group containing an ethyleneoxy group or a propyleneoxy group as a repeating unit), an aryloxy group, an acyloxy group, an acyl group, an alkoxycarbonyl group, an aryloxycarbonyl group, a carbamoyl group, a urethane group, a carboxyl group, an imide group, an amino group, a carbonamido group, a sulfonamido group, a ureide group, a thioureide group, a sulfamoylamino group, a semicarbazide group, a thiosemicarbazide group, a group containing a hydrazino group, a group containing a quaternary ammonio group, an (alkyl, aryl or heterocyclic)thio group, an (alkyl or aryl)sulfonyl group, an (alkyl or aryl)sulfinyl group, a sulfo group, a sulfamoyl group, an acylsulfamoyl group, an (alkyl or aryl)sylfonylureide group, an (alkyl or aryl) sulfonylcarbamoyl group, a halogen atom, a cyano group, a nitro group, an amide phosphate group, a group containing a phosphoric acid ester structure, a group having a acylurea structure, a group containing a selenium atom or a tellurium atom, and a group having a tertiary sulfonium structure or a quaternary sulfonium structure.

Preferred examples of these substituents include a straight-chain, branched or cyclic alkyl group (preferably having from 1 to 20 carbon atoms), an aralkyl group (preferably having from 1 to 20 carbon atoms), an alkoxy group (preferably having from 1 to 20 carbon atoms), a substituted amino group (preferably having from 1 to 20 carbon atoms), an acylamino group (preferably having from 2 to 30 carbon atoms), a sulfonamido group (preferably having from 1 to 30 carbon atoms), a ureide group (preferably having from 1 to 30 carbon atoms), a carbamoyl group (preferably having from 1 to 30 carbon atoms) and a phosphoric acid amido group (preferably having from 1 to 30 carbon atoms).

In general formula (N), the alkyl group represented by $R_2$ is preferably a $C_{1-10}$ alkyl group. The aryl group represented by $R_2$ is preferably a monocyclic or bicyclic aryl group, e.g., those containing a benzene ring.

The heterocyclic group represented by $R_2$ is a 5- or 6-membered compound containing at least one nitrogen, oxygen and sulfur atom. Examples of such a 5- or 6-membered compound include an imidazolyl group, a pyrazolyl group, a triazolyl group, a tetrazolyl group, a pyridyl group, a pyridinio group, a quinolinio group and a quinolinyl group. Particularly preferred among these compounds are a pyridyl group and a pyridinio group.

The alkoxy group represented by $R_2$ is preferably a $C_{1-8}$ alkoxy group. The aryloxy group represented by $R_2$ is preferably a monocyclic aryloxy group. The amino group represented by $R_2$ is preferably an unsubstituted amino group, a $C_{1-10}$ alkylamino group, an arylamino group or a heterocyclic amino group.

$R_2$ may be substituted by substituents. Preferred examples of these substituents include those listed as the substituent on $R_1$.

If $G_1$ is a —CO— group, preferred examples of the group represented by $R_2$ include a hydrogen atom, an alkyl group (e.g., methyl, trifluoromethyl, difluoromethyl, 2-carboxytetrafluoroethyl, pyridiniomethyl, 3-hydroxypropyl, 3-methanesulfonamidopropyl, phenylsulfonylmethyl), an aralkyl group (e.g., o-hydroxybenzyl) and an aryl group (e.g., phenyl, 3,5-dichlorophenyl, o-methanesulfonamidophenyl, o-carbamoylphenyl, 4-cyanophenyl, 2-hydroxymethylphenyl). Particularly preferred among these groups are a hydrogen atom and an alkyl group.

If $G_1$ is an —$SO_2$— group, preferred examples of the group represented by $R_2$ include an alkyl group (e.g., methyl), an aralkyl group (e.g., o-hyroxybenzyl), an aryl group (e.g., phenyl) or a substituted amino group (e.g., dimethylamino).

If $G_1$ is a —COCO— group, preferred examples of the group represented by $R_2$ include an alkoxy group, an aryloxy group or an amino group. Particularly, substituted amino groups (e.g., 2,2,6,6-tetramethylpipieridine-4-ilamino, propylamino, anilino, o-hydroxyanilino, 5-benzotriazolylamino, N-benzyl-3-pyridinioamino) are preferred. Alternatively, $R_2$ may be a group which allows the $G_1$-$R_2$ moiety to be separated from the rest of the molecule to cause cyclization reaction that produces a cyclic structure containing atoms constituting —$G_1$—$R_2$ moiety. Examples of such a group include those described in JP-A-63-29751.

$A_1$ and $A_2$ each are a hydrogen atom, an alkylsulfonyl or arylsulfonyl group having 20 or less carbon atoms (preferably a phenylsulfonyl group or a phenylsulfonyl group substituted such that the sum of Hammett's substituent constants is not less than −0.5), an acyl group having 20 or less carbon atoms (preferably a benzoyl group or a benzoyl group substituted such that the sum of Hammett's substituent constants is not less than −0.5) or straight-chain, branched or cyclic, substituted or unsubstituted aliphatic acyl group (examples of the substituent including a halogen atom, an ether group, a sulfonamido group, a carbonamido group, a hydroxyl group, a carboxyl group and a sulfonic acid group).

$A_1$ and $A_2$ each are most preferably a hydrogen atom.

In general formula (N), the substituents on $R_1$ and $R_2$ may be substituted by a substituent. Preferred examples of these substituents include those listed as the substituent on $R_1$. These substituents may be further substituted by a substituent, which may be in turn substituted by a substituent. This substitution structure may be repeated. Examples of these substituents also include those listed as the substituent on $R_1$.

In general formula (N), $R_1$ and $R_2$ may comprise a ballast group or a polymer commonly used in immobile photographic additive such as coupler. The ballast group is a group having 8 or more carbon atoms which is relatively inert to photographic properties. Examples thereof include an alkyl group, an aralkyl group, an alkoxy group, a phenyl group, an alkylphenyl group, a phenoxy group and an alkylphenoxy group. Examples of the polymer include those described in JP-A-1-100530.

In general formula (N), $R_1$ and $R_2$ may comprise an adsorptive group which is adsorbed by silver halide. Examples of such an adsorptive group include groups described in U.S. Pat. Nos. 4,385,108, 4,459,347, JP-A-59-195233, JP-A-59-200231, JP-A-59-201045, JP-A-59-

201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as an alkylthio group, an arylthio group, a thiourea group, a thioamido group, a mercaptoheterocyclic group and a triazole group. These adsorptive groups for silver halide may be in the form of precursor. Examples of the precursor include those described in JP-A-2-285344.

In general formula (N), $R_1$ and $R_2$ may contain a plurality of hydrazino groups as a substituent. In this case, the compound represented by general formula (N) represents a polymer of hydrazino group. Specific examples of such a compound include those described in JP-A-64-86134, JP-A-4-16938, and JP-A-5-197091.

Particularly preferred hydrazine compounds represented by general formula (N) is described below.

A particularly preferred example of $R_1$ is a substituted phenyl group. The substituted phenyl group is preferably substituted by a ballast group, an adsorptive group for silver halide, a group containing a quaternary ammonio group, a group containing an ethyleneoxy group as a repeating unit, an alkylthio group, an arylthio group, a heterocyclic thio group, a group capable of being dissociated in an alkaline developer (e.g., carboxyl group, sulfo group, acylsulfamoyl group) or a hydrazino group capable of forming a polymer, via a sulfonamido group, an acylamino group, a ureide group or a carbamoyl group.

$R_1$ is most preferably a phenyl group substituted by benzenesulfonamido group. The benzenesulfonamido group preferably has a substituent selected from the above described examples of the substituent of the substituted phenyl group.

$G_1$ is preferably a —CO— group or a —COCO— group, particularly preferably a —CO— group. If $G_1$ is a —CO— group, $R_2$ is preferably a hydrogen atom, a substituted alkyl group or a substituted aryl group (the substituent is preferably an electron attractive group or an o-hydroxymethyl group). If $G_1$ is a —COCO— group, $R_2$ is preferably a substituted amino group.

Specific examples of the compound represented by general formula (N) are shown below. However, the present invention is not limited to the following compounds.

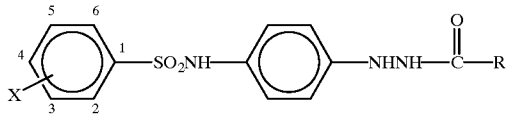
| | X = | R = —H | —$C_2F_4$—COOH or —$C_2F_4COO^{\ominus}K^{\oplus}$ | 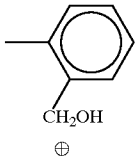 | 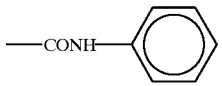 |
|---|---|---|---|---|---|
| 1' | 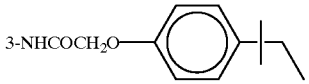 | 1a' | 1b' | 1c' | 1d' |
| 2' | 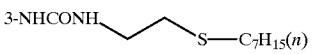 | 2a' | 2b' | 2c' | 2d' |
| 3' | 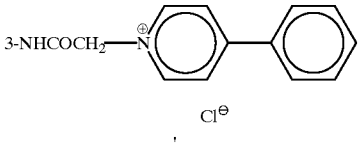 | 3a' | 3b' | 3c' | 3d' |
| 4' | 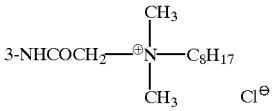 | 4a' | 4b' | 4c' | 4d' |
| 5' | 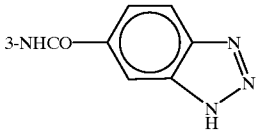 | 5a' | 5b' | 5c' | 5d' |

-continued
| | | | | | |
|---|---|---|---|---|---|
| 6' | 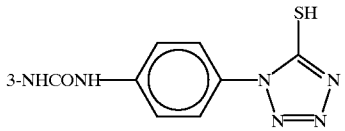 | 6a' | 6b' | 6c' | 6d' |
| 7' | 2-$CH_3$<br>4-$CH_3$<br>3-$SC_2H_4$—$(OC_2H_4)_4$—$OC_8H_{17}$ | 7a' | 7b' | 7c' | 7d' |
| | | R = | | | |
| | X = | —H | —$CF_2H$ | —$CH_2$—$N^{\oplus}$ 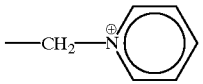 $Cl^{\ominus}$ | —CONH— 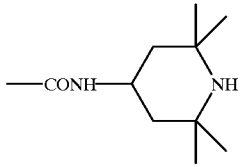 |
| 8' | 3-$CONHCH_2CH(C_2H_5)C_4H_9$ | 8a' | 8e' | 8f' | 8g' |
| 9' | 6-$OCH_3$-3-$C_5H_{11}$(t) | 9a' | 9e' | 9f' | 9g' |
| 10' | 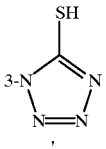 | 10a' | 10e' | 10f' | 10g' |
| 11' | 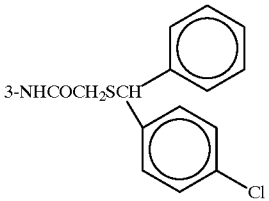 | 11a' | 11e' | 11f' | 11g' |

-continued
| | | | | | |
|---|---|---|---|---|---|
| 12' | 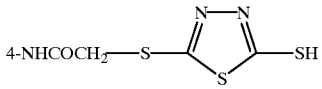 | 12a' | 12e' | 12f' | 12g' |
| 13' | 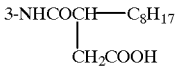 | 13a' | 13e' | 13f' | 13g' |
| 14' | 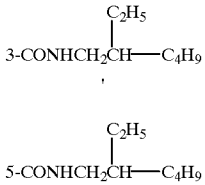 | 14a' | 14e' | 14f' | 14g' |
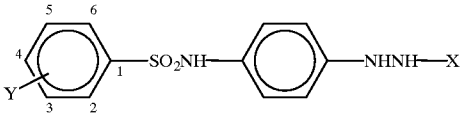
| | | X = | | | |
|---|---|---|---|---|---|
| | | | | $-P(=O)(OC_2H_5)_2$ | |
| Y = | —CHO | —$COCF_3$ | —$SO_2CH_3$ | | |
| 15' | 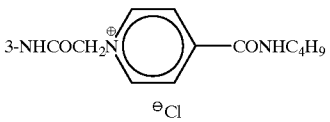 | 15a' | 15h' | 15i' | 15j' |
| 16' | 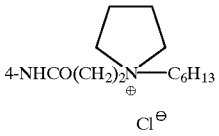 | 16a' | 16h' | 16i' | 16j' |

-continued
| | | | | | |
|---|---|---|---|---|---|
| 17' | 3-$SO_2NH$—(O—$CH_2$—$CH_2$)$_4$—$OC_4H_9$, | 17a' | 17h' | 17i' | 17j' |
| 18' | 3-COO(CH$_3$)CHCOO$C_4H_9$, 4-COO(CH$_3$)CHCOO$C_4H_9$, | 18a' | 18h' | 18i' | 18j' |
| 19' | 3-NHCO—(CH$_2$)$_4$— 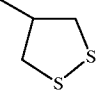 , | 19a' | 19h' | 19i' | 19j' |
| 20' | 3-$NHSO_2NH$—$C_8H_{17}$ | 20a' | 20h' | 20i' | 20j' |
| 21' | 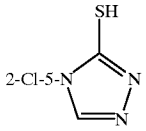 | 21a' | 21h' | 21i' | 21j' |
| | R = | | | |
|---|---|---|---|---|
| | —H | —$CF_2H$ | 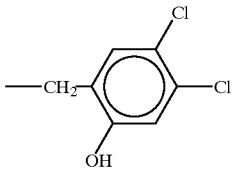 | —$CONHC_3H_7$ |

-continued
| | | | | | |
|---|---|---|---|---|---|
| 22' | 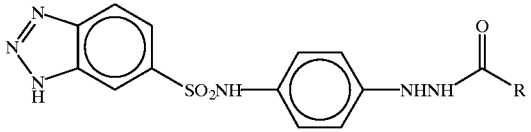 | 22a' | 22e' | 22k' | 22l' |
| 23' | 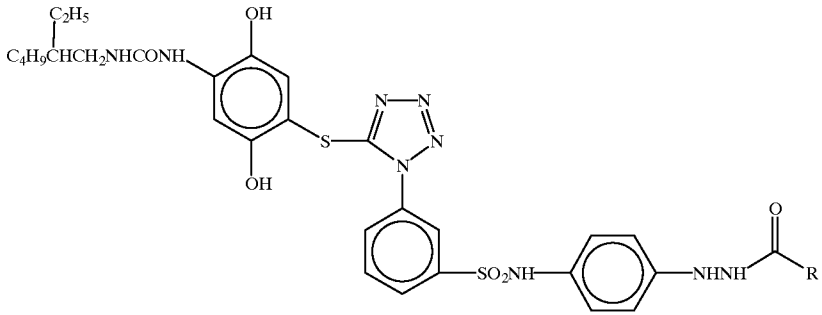 | 23a' | 23e' | 23k' | 23l' |
| 24' | 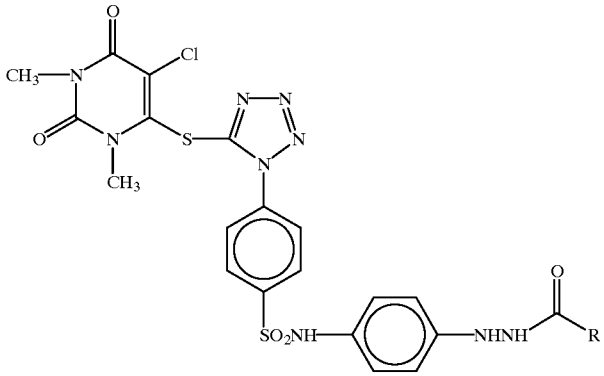 | 24a' | 24e' | 24k' | 24l' |

-continued
| | | | | |
|---|---|---|---|---|
| 25' 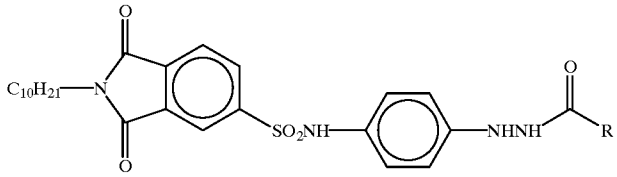 | 25a' | 25e' | 25k' | 25l' |
| 26' 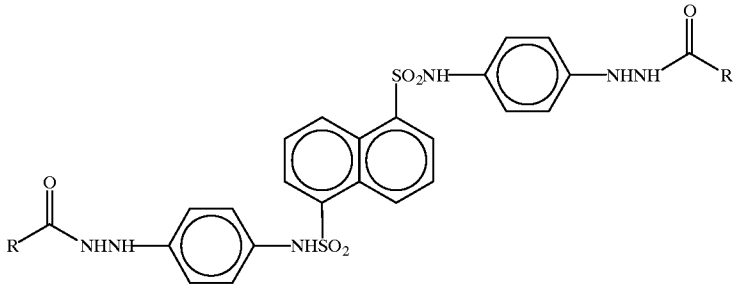 | 26a' | 26e' | 26k' | 26l' |
| 27' 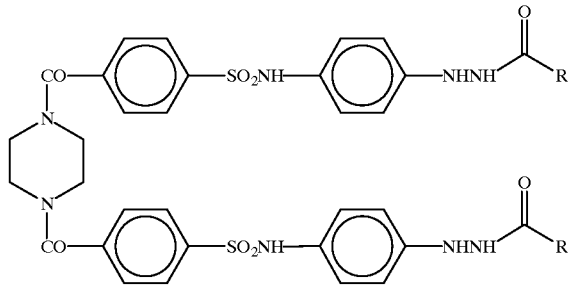 | 27a' | 27e' | 27k' | 27l' |

-continued
| | | | | | |
|---|---|---|---|---|---|
| 28' | 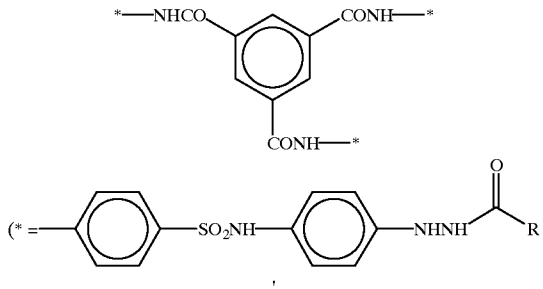 | 28a' | 28e' | 28k' | 28l' |
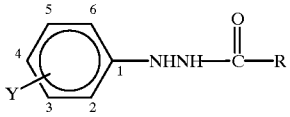
| | | R = | | | |
|---|---|---|---|---|---|
| | Y = | —H | —$CH_2OCH_3$ | 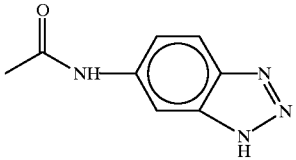 | 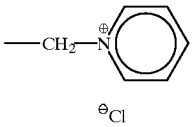 |
| 29' | 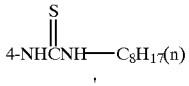 | 29a' | 29m' | 29n' | 29f' |
| 30' | 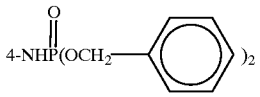 | 30a' | 30m' | 30n' | 30f' |
| 31' | 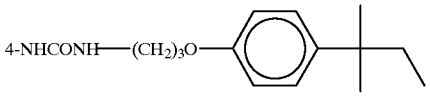 | 31a' | 31m' | 31n' | 31f' |

-continued
| | | | | | |
|---|---|---|---|---|---|
| 32' | 4-OH<br>3-NHCONHCH$_2$CH(C$_2$H$_5$)—C$_4$H$_9$ | 32a' | 32m' | 32n' | 32f' |
| 33' | 4-NHSO$_2$(CH$_2$)$_2$NHCO— 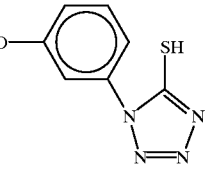 | 33a' | 33m' | 33n' | 33f' |
| 34' | 4-OCH$_2$— 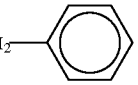 | 34a' | 34m' | 34n' | 34f' |
| 35' | 4-NHCONHN—(CH$_2$— 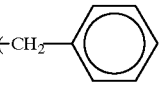 )$_2$ | 35a' | 35m' | 35n' | 35f' |
| | | R = | | | |
|---|---|---|---|---|---|
| | Y = | —H | —C$_3$F$_3$—COOH | —CONHCH$_3$ | 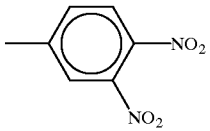 |
| 36' | 2-NHSO$_2$CH$_3$—<br>4-NHCONH(CH$_2$)$_3$S— 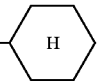 | 36a' | 36o' | 36p' | 36q' |
| 37' | 2-OCH$_3$—<br>4-NHSO$_2$C$_{12}$H$_{25}$ | 37a' | 37o' | 37p' | 37q' |
| 38' | 3-NHCOC$_{11}$H$_{23}$—<br>4-NHSO$_2$CF$_3$ | 38a' | 38o' | 38p' | 38q' |

-continued
| | | | | | |
|---|---|---|---|---|---|
| 39' | 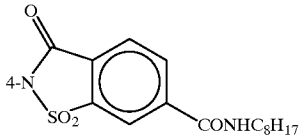 | 39a' | 39o' | 39p' | 39q' |
| 40' | $4\text{-}OCO(CH_2)_2COOC_6H_{13}$ | 40a' | 40o' | 40p' | 40q' |
| 41' | 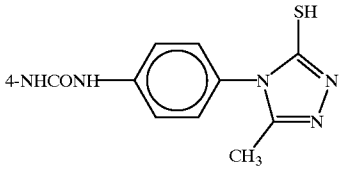 | 41a' | 41o' | 41p' | 41q' |
| 42' | 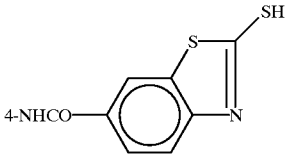 | 42a' | 42o' | 42p' | 42q' |
43'
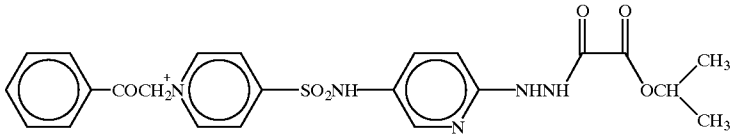
44'
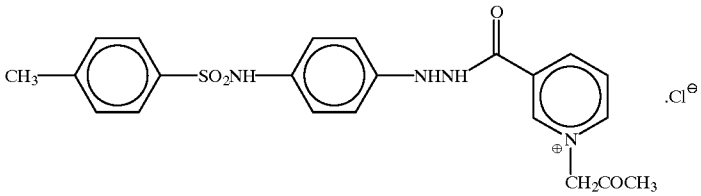

-continued
45'
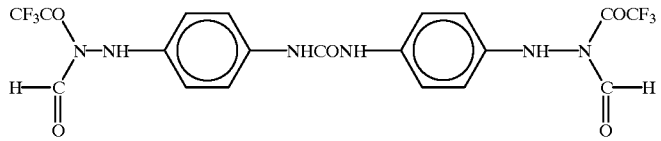
,
46'
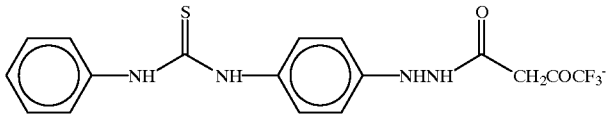
,
47'
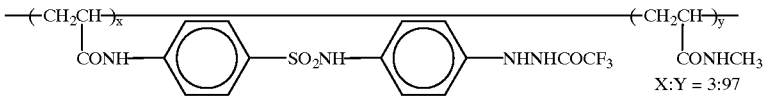
X:Y = 3:97
average molecular weight = 100,000
,
48'
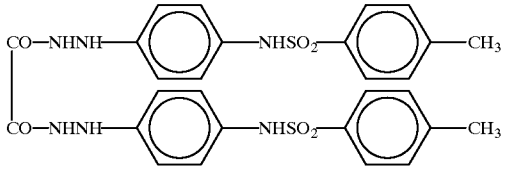
,
49'
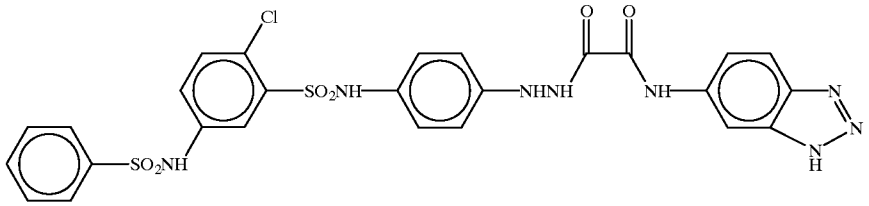
, -continued
50'
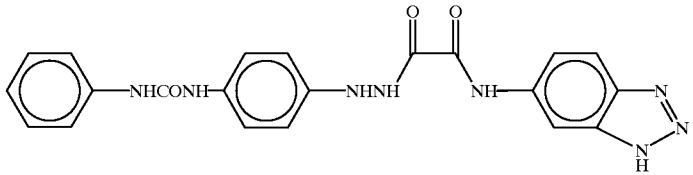
,
51'
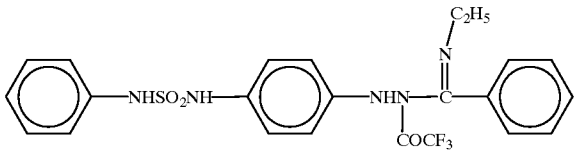
,
52'
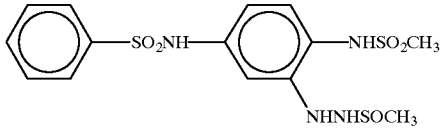
,
53'
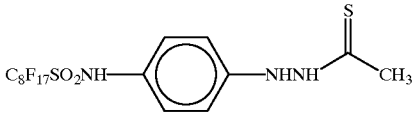
,
54'
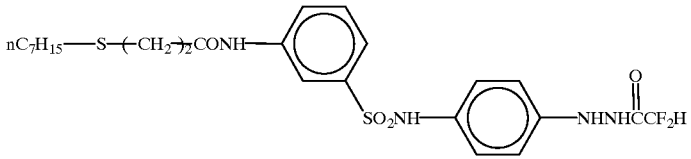
, Preferred selenium and tellurium sensitizations are described below.

The selenium sensitization or tellurium sensitization in this embodiment may be conducted singly or in combination with a sulfur sensitization, a noble metal sensitization, a reduction sensitization or the like. Preferred examples of such a combination include a combination of a sulfur sensitization, the selenium sensitization and a gold sensitization, and a combination of a sulfur sensitization, the tellurium sensitization and a gold sensitization.

The selenium sensitizer for use in this embodiment may be any selenium compound disclosed in known patents. The selenium sensitization is usually performed by adding a labile and/or non-labile selenium compound and stirring the emulsion at a high temperature of 40° C. or higher for a predetermined time. Examples of the labile selenium compound preferably used herein include compounds described in JP-B-44-15748, JP-B-43-13489, JP-A-4-25832 and JP-A-4-109240. Specific examples of the labile selenium sensitizer include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl)selenide), selenophosphates, phosphineselenides and colloidal metal seleniums.

Preferred examples of labile selenium compound have been given above, but the present invention is not limited thereto. Referring to labile selenium compounds for use as sensitizer for photographic emulsion, the structure of the compound is considered, by those skilled in the art, to be not so important as long as selenium is labile. It is generally understood that the organic moiety of the selenium sensitizer molecule plays no role other than carrying selenium and allowing it to be present in the emulsion in an unstable form. In this embodiment, labile selenium compounds within such a wide conception can be used advantageously.

Examples of the non-labile selenium compound for use herein include compounds described in JP-B-46-4553, JP-B-52-34492 and JP-B-52-34491. Specific examples of such a non-labile selenium compound include selenious acid, potassium selenocyanate, selenazoles, quaternary salts of a selenazole, diaryl selenide, diaryl diselenide, dialkyl selenide, dialkyl diselenide, 2-selenazolidine dione, 2-selenooxazolidine thione, and derivatives thereof.

Preferred among these selenium compounds are the compounds represented by the following general formulae (A) and (B).

(A)

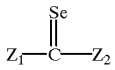

In general formula (A), $Z_1$ and $Z_2$ may be the same or different and each represents an alkyl group (e.g., methyl, ethyl, t-butyl, adamantyl, t-octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, chenyl, furyl, imidazolyl), —$NR_1(R_2)$, —$OR_3$ or —$SR_4$.

$R_1$, $R_2$, $R_3$ and $R_4$ may be the same or different and each represents an alkyl group, an aralkyl group, an aryl group or a heterocyclic group. Examples of the alkyl group, aralkyl group, aryl group or heterocyclic group represented by $R_1$, $R_2$, $R_3$ or $R_4$ include those listed above as $Z_1$.

$R_1$ and $R_2$ each may be a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl).

In general formula (A), $Z_1$ is preferably an alkyl group, an aryl group or —$NR_1(R_2)$, and $Z_2$ is preferably —$NR_5(R_6)$, wherein $R_1$, $R_2$, $R_5$ and $R_6$ may be the same or different and each represents a hydrogen atom, an alkyl group, an aryl group or an acyl group.

Preferred examples of the group represented by general formula (A) include N,N-dialkylselenourea, N,N,N'-trialkyl-N'-acylselenourea, tetraalkylselenourea, N,N-dialkylarylselenoamide and N-alkyl-N-aryl-arylselenoamide.

(B)

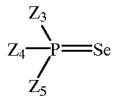

In general formula (B), $Z_3$, $Z_4$ and $Z_5$ may be the same or different and each represents an aliphatic group, an aromatic group, a heterocyclic group, —$OR_7$, —$NR_8(R_9)$, —$SR_{10}$, —$SeR_{11}$, X or a hydrogen atom.

$R_7$, $R_{10}$ and $R_{11}$ each represents an aliphatic group, an aromatic group, a heterocyclic group, a hydrogen atom or a cation. $R_8$ and $R_9$ each represent an aliphatic group, an aromatic group, a heterocyclic group or a hydrogen atom. X represents a halogen atom.

In general formula (B), the aliphatic group represented by $Z_3$, $Z_4$, $Z_5$, $R_7$, $R_8$, $R_9$, $R_{10}$ or $R_{11}$ represents a straight-chain, branched or cyclic alkyl group, an alkenyl group, an alkynyl group or an aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl).

In general formula (B), the aromatic group represented by $Z_3$, $Z_4$, $Z_5$, $R_7$, $R_8$, $R_9$, $R_{10}$ or $R_{11}$ represents a monocyclic or condensed aryl group (e.g., phenyl, pentafluorophenyl, 4-chlorophenyl, 3-sulfophenyl, α-naphthyl, 4-methylphenyl).

In general formula (B), the heterocyclic group represented by $Z_3$, $Z_4$, $Z_5$, $R_7$, $R_8$, $R_9$, $R_{10}$ or $R_{11}$ represents a 3- to 10-membered, saturated or unsaturated heterocyclic group containing at least one of nitrogen atom, oxygen atom and sulfur atom (e.g., pyridyl, phenyl, furyl, thiazolyl, imidazolyl, benzimidazolyl).

In general formula (B), the cation represented by $R_7$, $R_{10}$ or $R_{11}$ represents an alkaline metal atom or ammonium. The halogen atom represented by X represents, for example, a fluorine atom, chlorine atom, bromine atom or iodine atom.

In general formula (B), $Z_3$, $Z_4$ and $Z_5$ each preferably represents an aliphatic group, an aromatic group or —$OR_7$, wherein $R_7$ represents an aliphatic group or an aromatic group.

Preferred among the groups represented by general formula (B) are trialkylphosphine selselenide, trylphosphine selenide, trialkylselenophosphate and triarylselenophosphate.

Specific examples of the compounds represented by general formulae (A) and (B) are shown below, but the present invention is not limited thereto.

S-1.

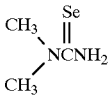

S-2.

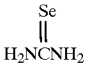

S-3.

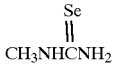

S-4.

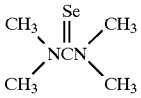

S-5.

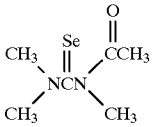

S-6.

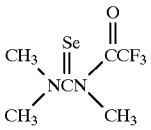

S-7.

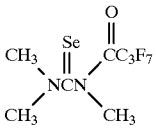

S-8.

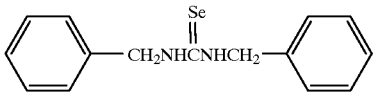

S-9.

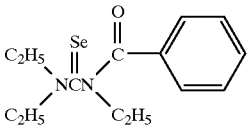

S-10.

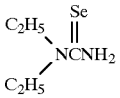

-continued

S-11.

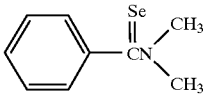

S-12.

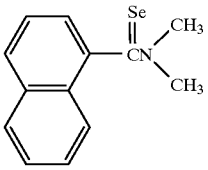

S-13.

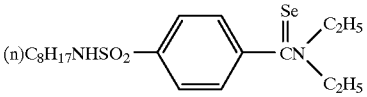

S-14.

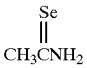

S-15.

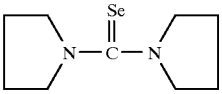

S-16.

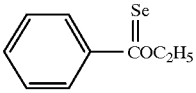

S-17.

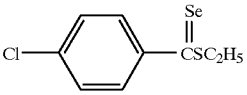

S-18.

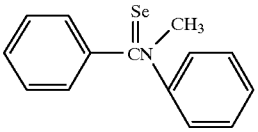

S-19.

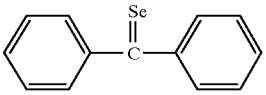

S-20.

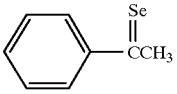

S-21.

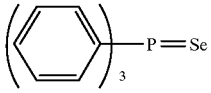

S-22.

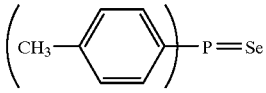

S-23.

-continued

S-24.

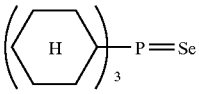

S-25.

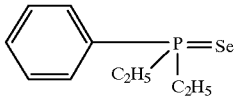

S-26.

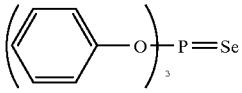

S-27.

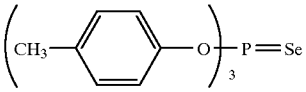

S-28.

$(nC_4H_9O)_3P{=}Se$

29.

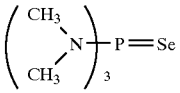

S-30.

$(C_2H_5O)_3P{=}Se$

S-31.

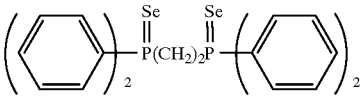

S-32.

$(nC_8H_{17})_3P{=}Se$

S-33.

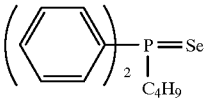

S-34.

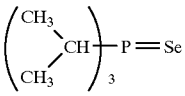

S-35.

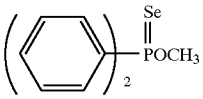

S-36.

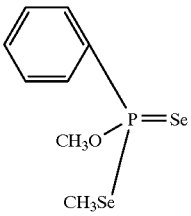

S-37.

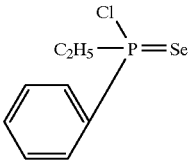

-continued

S-38.

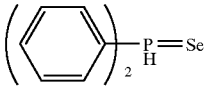

S-39.

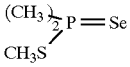

For selenium sensitization, reference can be made to U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, JP-A-3-4221, JP-A-3-148648, JP-A-3-111838, JP-A-3-116132, JP-A-3-237450, JP-A-4-16838, JP-A-4-25832, JP-A-4-32831, JP-A-4-109240, British Patents 255,846 and 861,984, and H. E. Spencer et al., "Journal of Photographic Science", vol. 31, pp. 158 to 169, 1983.

These selenium sensitizers may be added to the emulsion in the form of solution in water or organic solvents such as methanol and ethanol, singly or in admixture, or in the form as described in JP-A-4-140738 and JP-A-4-140739, during chemical sensitization. Preferably, it is added before the beginning of the chemical sensitization. The selenium sensitizer for use herein is not limited to one kind of selenium sensitizer. Two or more kinds of the above described selenium sensitizers may be used in combination. An labile selenium compound and a non-labile selenium compound may be used in combination.

Preferred examples of the tellurium sensitizer for use herein include compounds described in U.S. Pat. Nos. 1,623,499, 3,320,069, and 3,772,031, British Patents 235,211, 1,121,496, 1,295,462 and 1,396,696, Canadian Patent 800,958, Journal of Chemical Society Chemical Communication", 635 (1980), ibid 1102 (1979), ibid 645 (1979), and Journal of Chemical Society Perkin Transaction", 1, 2191 (1980).

Specific examples of the tellurium sensitizers include colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea, N,N'-diphenylethylenetellurourea), isotellurocyanates (e.g., allylisotellurocyanate), telluroketones (e.g., telluroacetone, telluroacetonephenone), telluroamides (e.g., telluroacetamide, N,N-dimethyltellurobenzamide), tellurohydrazides (e.g., N,N',N'-trimethyltellurobenzhydrazide), telluroesters (e.g., t-butyl-t-hexyltelluroester), phosphinetellurides (e.g., tributylphosphinetelluride, tricyclohexylphosphinetelluride, triisopropylphosphinetelluride, butyl-diisopropylphosphinetelluride, dibutylphenylphosphinetelluride), and other tellurium compounds (e.g., negatively-charged telluride ion-containing gelatin, potassium telluride, potassium tellurocyanate, telluropentathionate sodium salt and allyltellurocyanate described in British Patent 1,295,462).

Preferred among these tellurium compounds are the compounds represented by the following general formulae (C) and (D).

(C)

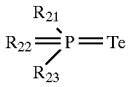

In formula (C), $R_{21}$, $R_{22}$ and $R_{23}$ each represents an aliphatic group, an aromatic group, a heterocyclic group, $OR_{24}$, $NR_5(R_6)$, $SR_7$, $OSiR_8(R_9)(R_{10})$, X or a hydrogen atom. $R_4$ and $R_7$ each represents an aliphatic group, an aromatic group, a heterocyclic group, a hydrogen atom or a cation. $R_5$ and $R_6$ each represents an aliphatic group, an aromatic group, a heterocyclic group or a hydrogen atom. $R_8$, $R_9$ and $R_{10}$ each represents an aliphatic group. X represents a halogen atom.

(D)

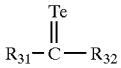

In formula (D), $R_{31}$ represents an aliphatic group, an aromatic group, a heterocyclic group or $—NR_{13}(R_{14})$; and $R_{32}$ represents $—NR_{15}(R_{16})$, $—N(R_{17})N(R_{18})R_{19}$ or $—OR_{20}$. $R_{13}$, $R_{14}$, $R_{15}$, $R_{16}$, $R_{17}$, $R_{18}$, $R_{19}$ and $R_{20}$ each represents a hydrogen atom, an aliphatic group, an aromatic group, a heterocyclic group or an acyl group. $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ may be connected to each other to form a ring.

Specific examples of the compounds represented by general formulae (C) and (D) are shown below, but the present invention is not limited thereto.

T-1.

$(nC_4H_9)_3P{=}Te$

T-2.

$(tC_4H_9)_3P{=}Te$

T-3.

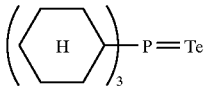

T-4.

$((i)C_3H_7)_3P{=}Te$

T-5.

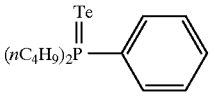

T-6.

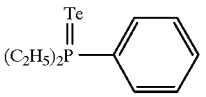

T-7.

$((i)C_4H_9)_3P{=}Te$

-continued

T-8.

$((i)C_4H_9)_2PC_4H_9(n)$ (Te)

T-9.

$(i)C_3H_7P(C_4H_9(n))_2$ (Te)

T-10.

$((i)C_3H_7)_2PC_4H_9(n)$ (Te)

T-11.

$(i)C_3H_7P(C_4H_9(i))_2$ (Te)

T-12.

$((i)C_3H_7)_2PC_4H_9(i)$ (Te)

T-13.

$((i)C_3H_7)_2PC_8H_{17}(n)$ (Te)

T-14.

$C_2H_5P(OC_2H_5)_2$ (Te)

T-15.

$(n\text{-}C_4H_9O)_3P{=}Te$

T-16.

$C_2H_5P{=}N(CH_3)_2)_2$ (Te)

T-17.

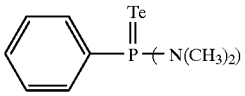

T-18.

$((CH_3)_2N)_3P{=}Te$

T-19.

$((CH_3)_3SiO)_2PH$ (Te)

T-20.

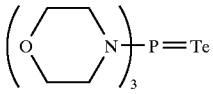

T-21.

$(C_2H_5)_2PN(C_2H_5)_2$ (Te)

T-22.

$H_2PNH_2$ (Te)

T-23.

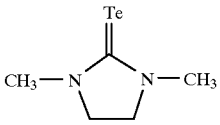

-continued

T-24.

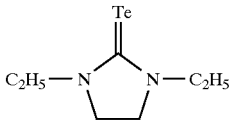

T-25.

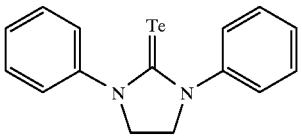

T-26.

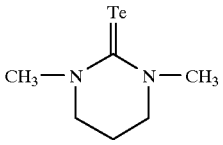

T-27.

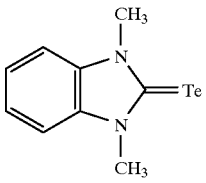

T-28.

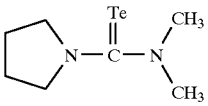

T-29.

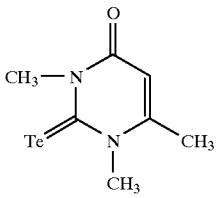

T-30.

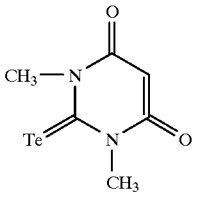

T-31.

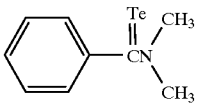

T-32.

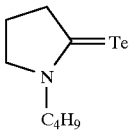

-continued

T-33.

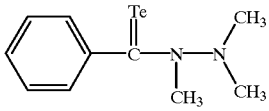

T-34.

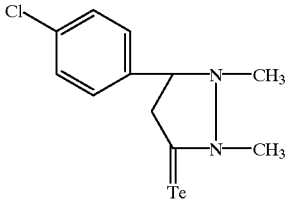

T-35.

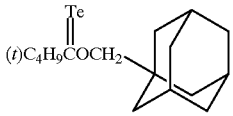

T-36.

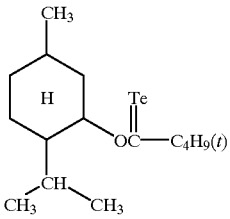

T-37.

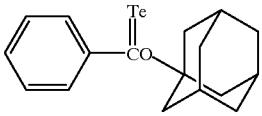

T-38.

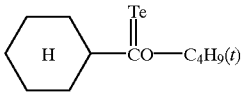

The synthesis of the compounds represented by general formulae (C) and (D) can be accomplished according to a known method, as described in Journal of Chemical Society (A), 1969, 2927, Journal of Organometallic Chemistry, 4, 320 (1965), ibid, 1, 200 (1963), ibid, 113, C35 (1976), Phosphorus Sulfur, 15, 155 (1983), Chem. Ber., 109, 2996 (1976), Journal of Chemical Society Chemical Communication, 635 (1980), ibid, 1102 (1979), ibid, 645 (1979), ibid, 820 (1987), Journal of Chemical Society Perkin Transaction, 1, 2191 (1980), and The Chemistry of Organo Selenium and Tellurium Compounds, vol. 2, pp. 216 to 267 (1987).

The use amount of the selenium or tellurium sensitizer for use in this embodiment varies depending on the activity of the sensitizer used, the kind and size of the silver halide, the ripening temperature and time, etc. but is preferably not less than $1\times10^{-8}$ mol, more preferably from not less than $1\times10^{-7}$ mol to not more than $1\times10^{-5}$ mol per mol of silver halide. In the case where a sensitizer is used, the chemical ripening temperature is preferably not lower than 45° C, more preferably from not lower than 50° C. to not higher than 80° C. The pAg and pH values are arbitrary. For example, the pH value may be selected as wide as 4 to 9 to obtain the desired effect. The selenium sensitization and tellurium sensitization in this embodiment may be effected in the presence of silver halide solvent to effectively conduct a sensitization.

Various additives to be incorporated in the photographic light-sensitive material of the present invention are not particularly limited. For example, the following compounds are preferably used.

Polyhydroxybenzene compounds described in JP-A-3-39948, from line 11, lower right column, page 10 to line 5, lower left column, page 12, specifically, Compounds (III)-1 to (III)-25;

Compounds represented by general formula (I) having substantially no absorption maxima in visible region as described in JP-A-1-118832, specifically Compounds I-1 to I-26;

Fog inhibitors described in JP-A-2-103536, from line 19, lower right column, page 17 to line 4, upper right column, page 18;

Polymer latices described in JP-A-2-103536, from line 12, lower left column to line 20, lower left column, page 18;

Matting agents, lubricants and plasticizers described in JP-A-2-103536, from line 15, upper left column to line 15, upper right column, page 19;

Harding agents described in JP-A-2-103536, from line 5, upper right column to line 17, upper right column, page 18;

Compounds having an acid group described in JP-A-2-103536, from line 6, lower right column, page 18 to line 1, upper left column, page 19;

Electrically-conductive substances described in JP-A-2-18542, from line 13, lower left column, page 2 to line 7, upper right column, page 3, specifically, metal oxides described from line 2, lower right column to line 10, lower right column, page 2 and electrically-conductive high molecular compounds (Compounds P-1 to P-7) described therein;

Water-soluble dyes described in JP-A-2-103536, from line 1, lower right column to line 18, upper right column, page 17;

Solid-dispersed dyes described in JP-A-2-294638 and JP-A-5-11382;

Surface active agents described in JP-A-2-12236, from line 7, upper right column to line 3, lower right column, page 9; PEG surface active agents described in JP-A-2-103536, from line 4, lower left column to line 7, lower left column, page 18; fluorine-containing surface active agents described in JP-A-3-39948, from line 6, lower left column, page 12 to line 5, lower right column, page 13, specifically, Compounds VI-1 to VI-15;

Redox compounds which undergoes oxidation to release a development inhibitor described in JP-A-5-274826, preferably redox compounds represented by general formulae (R-1), (R-2) and (R-3), specifically, Compounds R-1 to R-68;

Binders described in JP-A-2-18542, from line 1 to line 20, lower right column, page 3.

Examples of the support employable in the present invention include baryta paper, polyethylene-coated paper, polypropylene synthetic paper, glass plate, cellulose acetate, cellulose nitrate, and polyester film such as polyethylene terephthalate. These supports may be appropriately used depending on the purpose of the silver halide photographic material.

The developer for developing the photographic light-sensitive material of the present invention may comprise commonly used additives (e.g., developing agent, alkaline agent, pH buffer, preservative, chelating agent) incorporated therein. The development of the photographic light-sensitive material of the present invention may be accomplished by any known method. Further, known developers may be used for the development.

The developing agent for the developer for use in the present invention is not particularly limited. The developing agent preferably comprises a dihydroxybenzene compound or an ascorbic acid derivative. From the standpoint of developing capacity, a combination of a dihydroxybenzene compound and an 1-phenyl-3-pyrazolidone compound, a combination of a dihydroxybenzene compound and a p-aminophenol compound, a combination of an ascorbic acid derivative and a 1-phenyl-3-pyrazolidone compound, and a combination of an ascorbic acid derivative and a p-aminophenol compound are preferred. Most preferred among these combinations is a combination of an ascorbic acid derivative and a p-aminophenol compound.

Examples of the dihydroxybenzene developing agent for use in the present invention include hydroquinone, chlorohydroquinone, isopropylhydroquinone, methylhydroquinone and hydroquinone monosulfonate. Particularly preferred among these dihydroxybenzene developing agents is hydroquinone.

The ascorbic acid derivative developing agent which is preferably used in the present invention is a compound represented by general formula (1):

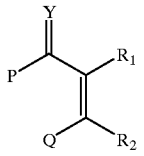

(1)

wherein $R_1$ and $R_2$ each represents a hydroxyl group, an amino group (including those containing as a substituent a $C_{1-10}$ alkyl group such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., methoxycarbonylamino), a mercapto group or an alkylthio group (e.g., methylthio, ethylthio). Preferred examples of $R_1$ and $R_2$ include a hydroxyl group, an amino group, an alkylsulfonylamino group and an arylsulfonylamino group.

P and Q each represents a hydroxyl group, a hydroxylalkyl group, a carboxyl group, a carboxylalkyl group, a sulfo group, a sulfoalkyl group, an amino group, an aminoalkyl group, an alkyl group, an alkoxy group or a mercapto group. P and Q represent atomic groups which are necessary to form a 5- to 7-membered ring when connected to each other with the two vinyl carbon atoms on which $R_1$ and $R_2$ substitute and with the carbon atom on which Y substitutes. Specific examples of the ring structure include those comprising a combination composed of —O—, —C($R_4$)($R_5$)—, —C($R_6$)=, —C(=O)—, —N($R_7$)— and —N=, wherein $R_4$, $R_5$, $R_6$ and $R_7$ each represents a hydrogen atom, a $C_{1-10}$ alkyl group which may be substituted (Examples of the substituent include a hydroxyl group, a carboxyl group and a sulfo group), a hydroxyl group or a carboxyl group. Further, a saturated or unsaturated condensed ring may be formed in the 5- to 7-membered ring.

Examples of the 5- to 7-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and a uracil ring. Preferred among these rings are a dihydrofuranone ring, a cyclopentenone ring, a cyclohexenone ring, a pyrazolinone ring, an azacyclohexenone ring and a uracil ring.

Y is a group composed of ═O or ═N—$R_3$, wherein $R_3$ represents a hydrogen atom, a hydroxyl group, an alkyl group (e.g., methyl, ethyl), an acyl group (e.g., acetyl), a hydroxylalkyl group (e.g., hydroxylmethyl, hydroxylethyl), a sulfoalkyl group (e.g., sulfomethyl, sulfoethyl) or a carboxylalkyl group (e.g., carboxylmethyl, carboxylethyl).

Specific examples of the compound represented by general formula (I) are shown below, but the present invention is not limited thereto.

1-1

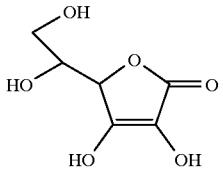

1-2

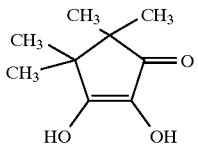

1-3

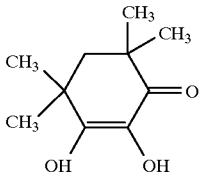

1-4

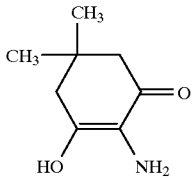

-continued 1-5

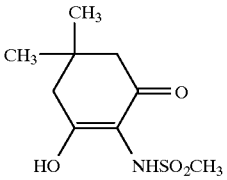

1-6

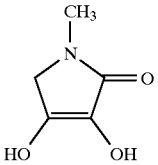

1-7

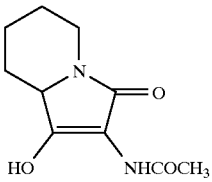

1-8

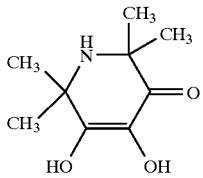

1-9

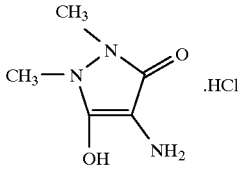

1-10

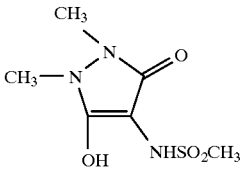

1-11

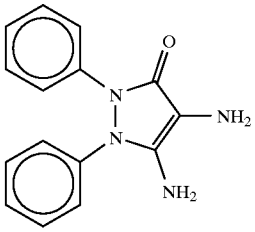

-continued
1-12
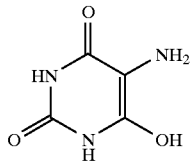
1-13
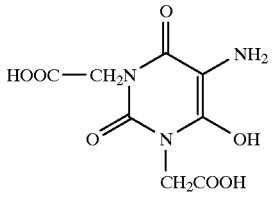
1-14
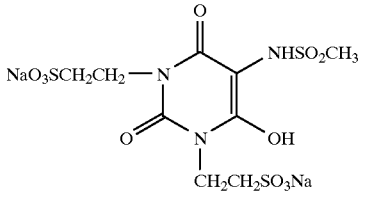
1-15
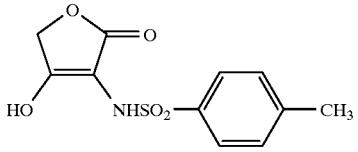
1-16
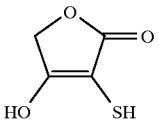
1-17
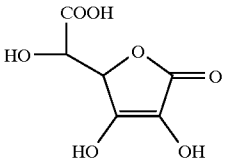
1-18
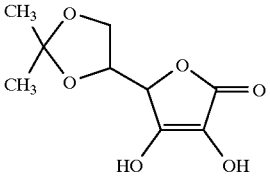
-continued
1-19
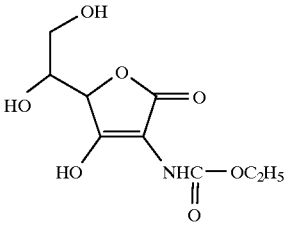
1-20
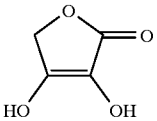
1-21
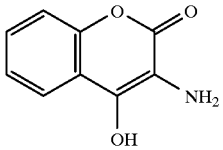
1-22
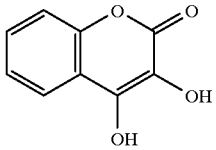
1-23
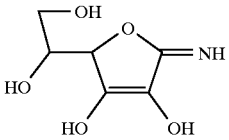
1-24
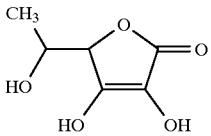
1-25
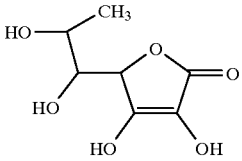

-continued 1-26

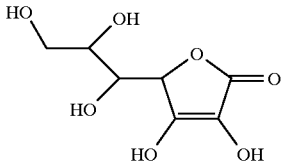

1-27

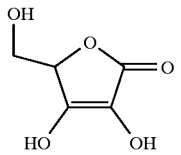

1-28

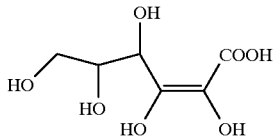

1-29

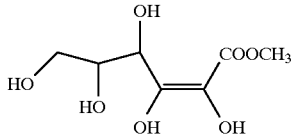

1-30

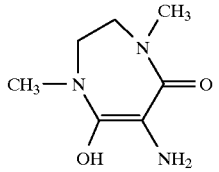

1-31

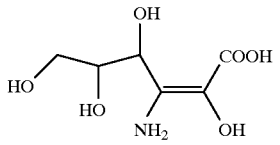

Preferred among these compounds is an ascorbic acid or an erythorbic acid (diasteromer of ascorbic acid).

The use amount of the compound represented by general formula (1) is preferably from $5\times10^{-3}$ to 1 mol, particularly preferably from $10^{-2}$ to 0.5 mol per l of the developer.

Examples of 1-phenyl-3-pyrazolidone and derivatives thereof for use as a developing agent include 1-phenyl-3-pyrazolidone, 1-phenyl-4,4-dimethyl-4-pyrazolidone and 1-phenyl-4-methyl-4-hydroxymethyl-3-pyrazolidone.

Examples of the p-aminophenol developing agent for use used in the present invention include N-methyl-p-aminophenol, p-aminophenol, N-(β-hydroxyethyl)-p-aminophenol and N-(4-hydroxyphenyl)glycine. Particularly preferred among these p-aminophenol developing agents is N-methyl-p-aminophenol.

In general, the dihydroxybenzene developing agent is preferably used in an amount of from 0.05 mol/l to 0.8 mol/l, particularly preferably from 0.2 to 0.6 mol/l. When the dihydroxybenzene compound is used in combination with the 1-phenyl-3-pyrazolidone compound or the p-amino-phenol compound, the former is preferably used in an amount of from 0.05 mol/l to 0.6 mol/l, more preferably from 0.2 to 0.5 mol/l while the latter is preferably used in an amount of from not more than 0.06 mol/l, more preferably not more than 0.03 mol/l.

In general, the ascorbic acid derivative developing agent is preferably used in an amount of from 0.05 to 1.0 mol/l, particularly from 0.1 to 0.5 mol/l. When the ascorbic acid derivative is used in combination with the 1-phenyl-3-pyrazolidone compound or the p-amino-phenol compound, the former is preferably used in an amount of from 0.05 mol/l to 1.0 mol/l, more preferably from 0.1 to 0.5 mol/l while the latter is preferably used in an amount of not more than 0.2 mol/l, more preferably not more than 0.1 mol/l.

Examples of the preservative for use in the present invention include sodium sulfite, potassium sulfite, lithium sulfite, ammonium sulfite, sodium bisulfite, potassium metabisulfite and sodium formaldehydebisulfite. If the dihydroxybenzene developing agent is used, the sulfite is preferably used in an amount of not less than 0.20 mol/l, particularly preferably not less than 0.3 mol/l. However, if a too large amount of the sulfite is added, it causes silver stain in the developer. Therefore, the upper limit of the amount of the sulfite is preferably 1.2 mol/l. On the other hand, if the ascorbic acid derivative developing agent is used, the amount of the sulfite to be used may be as small as not more than 0.5 mol/l.

If the dihydroxybenzene developing agent is used, an ascorbic acid derivative may be used in a small amount as a preservative in combination with the sulfite. Examples of the ascorbic acid derivative for use herein include an ascorbic acid, an erythorbic acid (stereoisomer of ascorbic acid) and an alkaline metal (sodium, potassium) salt thereof. Sodium erythorbate is desirable from the standpoint of material cost. The addition amount of the ascorbic acid derivative is preferably from 0.03 to 0.12 mol, particularly preferably from 0.05 to 0.10 mol per mol of the dihydroxybenzene developing agent. If the ascorbic acid derivative is used as a preservative, it is preferred that no boron compounds be contained in the developer.

Examples of additives other than those described above include a development inhibitor such as sodium bromide and potassium bromide; an organic solvent such as ethylene glycol, diethylene glycol, triethylene glycol and dimethylformamide; a development accelerator such as alkanolamine (e.g., diethanolamine, triethanolamine), imidazole and a derivative thereof; and an antifoggant or a black pepper inhibitor such as a mercapto-base compound, an imidazole-base compound, a benzotriazole-base compound and a benzimidazole-base compound. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The antifoggant is usually used in an amount of from 0.01 to 10 mmol, preferably from 0.1 to 2 mmol, per l of the developer.

The developer of the present invention can further contain various organic or inorganic chelating agent in combination. Examples of the inorganic chelating agent include sodium tetrapolyphosphate and sodium hexametaphosphate.

Examples of the organic chelating agent which can be predominantly used, include an organic carboxylic acid, an aminopolycarboxylic acid, an organic phosphonic acid, an aminophosphonic acid and an organic phosphonocarboxylic acid.

Examples of the organic carboxylic acid include an acrylic acid, an oxalic acid, a malonic acid, a succinic acid, a glutaric acid, an adipic acid, a pimelic acid, an azelaic acid, a sebacic acid, a nonanedicarboxylic acid, a decanedicarboxylic acid, an undecanedicarboxylic acid, a maleic acid, an itaconic acid, a malic acid, a citric acid and a tartaric acid, however, the organic carboxylic acid is not limited thereto.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and the compounds described in JP-A-52-25632, JP-A-55-67747, JP-A-57-102624 and JP-B-53-40900.

Examples of the organic phosphonic acid include hydroxyalkylidenediphosphonic acid described in U.S. Pat. Nos. 3,214,454 and 3,794,591 and German Patent Application (OLS) No. 2,227,639, and the compounds described in *Research Disclosure*, Vol. 181, Item 18170 (May, 1979).

Examples of the aminophosphonic acid include aminotris (methylenephosphonic acid), ethylenediaminetetramethylenephosphonic acid, aminotrimethylenephosphonic acid, and the compounds described in *Research Disclosure* (supra), No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure* (supra), No. 18170.

These chelating agents each may be used in the form of an alkali metal salt or an ammonium salt. The chelating agent is preferably added in an amount of from $1\times10^{-4}$ to $1\times10^{-1}$ mol, more preferably from $1\times10^{-3}$ to $1\times10^{-2}$ mol, per l of the developer.

The developer may contain the compound described in JP-A-56-24347, JP-B-56-46585, JP-B-62-2849 or JP-A-4-362942 as a silver stain inhibitor.

Further, the developer may contain the compound described in JP-A-62-212651 as a development unevenness inhibitor, and the compound described in JP-A-61-267759 as a dissolution aid.

Furthermore, the developer may contain a color toner, a surface active agent, a defoaming agent or a hardening agent, if desired.

The development temperature and the development time are mutually related to each other and determined in connection with the total processing time. In general, the development temperature is from about 20° C. to about 50° C., preferably from 25° C. to 45° C., and the development time is from 5 seconds to 2 minutes, preferably from 7 seconds to 90 seconds.

In the present invention, both the development initiator and the developer replenisher preferably show a pH rise of not more than 0.25 when sodium hydroxide is added in an amount of 0.1 mol per l thereof. In order to confirm that both the development initiator and the developer replenisher have the above described properties, first, the pH value of the development initiator and the developer replenisher is. adjusted to 10.0. To 1 l of these solutions is then added 0.1 mol of sodium hydroxide. The pH value of these solution is then measured. When the pH rise is not more than 0.25, it is judged that these solutions have the properties defined above. In the present invention, a development initiator and a developer replenisher which show a pH rise of not more than 0.2 in the above described test are particularly preferably used.

In order to provide the development initiator and the developer replenisher with the above described properties, a buffer is preferably used. Examples of the buffer for use herein include carbonates, boric acids described in JP-A-62-186259, saccharides (e.g., saccharose) described in JP-A-60-93433, oxims (e.g., acetoxim), phenol (e.g., 5-sulfosalicyclic acid), and tribasic phosphate (e.g., sodium salt, potassium salt). Preferred among these buffers are carbonates and boric acids. The use amount of the buffer, particularly carbonate, is preferably not less than 0.5 mol/l, particularly from 0.5 to 1.5 mol/l.

Known water-soluble inorganic alkaline metal salts (e.g., sodium hydroxide, potassium-hydroxide, sodium carbonate, potassium carbonate) may be used as an alkaline agent for adjusting pH.

In the present invention, the pH value of the development initiator is preferably from 8.5 to 12.0, particularly preferably from 8.5 to 11.0. The preferred pH value of the developer replenisher and the developer in the development tank during continuous processing are also within this range.

The developer replenishment rate per $m^2$ of silver halide photographic material to be processed is not more than 225 ml, preferably from 30 to 225 ml, particularly preferably from 50 to 180 ml.

The developer replenisher may have the same composition as the development initiator. Alternatively, in the developer replenisher, the concentration of components to be consumed in development may be higher than that of the development initiator.

For reducing the transportation cost of the processing solution and the wrapping material cost and for saving the space, the processing solution is preferably stored in a concentrated form which is then diluted before use. To this end, salt components contained in the developer are preferably in the form of potassium salt.

The fixing solution for use in the fixing step of the present invention is an aqueous solution containing sodium thiosulfate or ammonium thiosulfate and if desired, tartaric acid, citric acid, gluconic acid, boric acid, iminodiacetic acid, 5-sulfosalicylic acid, glucoheptanoic acid, tylon, ethylenediaminetetraacetic acid, diethylenetriaminepentaacetic acid, nitrilotriacetic acid or a salt thereof. In view of environmental consideration in recent years, the fixing solution preferably contains no boric acid.

The fixing agent in the fixing solution for use in the present invention includes sodium thiosulfate and ammonium thiosulfate, and in view of the fixing rate, ammonium thiosulfate is preferred. However, when taken account of environmental consideration in recent years, sodium thiosulfate may be used. The use amount of these known fixing agents may be varied appropriately, however, it is generally from about 0.1 to about 2 mol/l, preferably from 0.2 to 1.5 mol/l.

The fixing solution may contain, if desired, a hardening agent (e.g., water-soluble aluminum compound), a preservative (e.g., sulfite, bisulfite), a pH buffer (e.g., acetic acid), a pH adjusting agent (e.g., ammonia, sulfuric acid), a chelating agent, a surface active agent, a wetting agent or a fixing accelerator.

Examples of the surface active agent include an anionic surface active agent such as sulfated product and sulfonated product, a polyethylene-base surface active agent, and an amphoteric surface active agent described in JP-A-57-6740. A known defoaming agent may also be added. Examples of the wetting agent include alkanolamines and alkylene glycols. Examples of the fixing accelerator include thiourea derivatives described in JP-B-45-35754, JP-B-58-122535 and JP-B-58-122536, alcohols having a triple bond within a molecule, thioether compounds described in U.S. Pat. No. 4,126,459, meso-ionic compounds described in JP-A-4-229860, and the compounds described in JP-A-2-44355.

Examples of the pH buffer include an organic acid such as acetic acid, malic acid, succinic acid, tartaric acid, citric acid, oxalic acid, maleic acid, glycolic acid and adipic acid, and an inorganic buffer such as boric acid, phosphate and sulfite. Among these, preferred are acetic acid, tartaric acid and sulfite.

The pH buffer is used here to prevent an increase of the pH value of the fixing agent due to carrying over of the developer, and it is used in an amount of from 0.01 to 1.0 mol/l, preferably approximately from 0.02 to 0.6 mol/l.

The fixing solution may also contain the compound described in JP-A-64-4739 as a dye elution accelerator.

Examples of the hardening agent in the fixing solution of the present invention include a water-soluble aluminum salt and a chromium salt. Of these, a water-soluble aluminum salt is preferred and examples thereof include aluminum chloride, aluminum sulfate and potassium alum. The addition amount thereof is preferably from 0.01 to 0.2 mol/l, more preferably from 0.03 to 0.08 mol/l .

The fixing temperature is generally from about 20° C. to about 50° C., preferably from 25 to 45° C., and the fixing time is generally from 5 seconds to 1 minute, preferably from 7 to 50 seconds.

The replenishing amount of the fixing solution is generally 500 ml/$m^2$ or less, preferably 200 ml/$m^2$ or less, based on the light-sensitive material processed.

The light-sensitive material processed through development and fixing is then subjected to water washing or stabilization.

The water washing or stabilization is usually performed using water in an amount of 20 l or less per $m^2$ of the silver halide light-sensitive material and they may be performed at a replenishing amount of 3 l or less (including 0, namely, standing water washing). More specifically, the processing can not only be performed with saved water but also dispense with piping for installation of an automatic developing machine.

As a method for reducing the replenishing amount of washing water, a multi-stage countercurrent system (for example, two stages or three stages) has been known. When the multi-stage countercurrent system is applied to the present invention, the light-sensitive material after fixing is processed gradually toward the correct direction, namely, while coming into contact in sequence with processing solutions unstained with the fixing solution, and as a result, water washing can be performed more efficiently.

When water washing is performed with a small amount of water, a rinsing tank such as squeeze roller or cross-over roller described in JP-A-63-18350 and JP-A-62-28725 is preferably provided. Alternatively, addition of various oxidizing agents or filter filtration may be combined so as to reduce the pollution load which is a problem to be caused in water washing with a small amount of water.

The over-flow solution from the water washing or stabilization bath, which is generated as a result of replenishing water with an antimold means to the water washing or stabilization bath by the method of the present invention, may be partially or wholly used in the processing solution having fixing ability as the previous processing step thereof as described in JP-A-60-235133.

Also, a water-soluble surface active agent or a defoaming agent may be added so as to prevent uneven processing due to bubbling which is liable to occur at the time of water washing with a small amount of water, and/or to prevent a processing agent component adhering to the squeeze roller from transferring onto the processed film.

Further, a dye adsorbent described in JP-A-63-163456 may be provided in the water washing tank so as to prevent stain due to a dye dissolved out from the light-sensitive material.

In some cases, stabilization may be performed following the above-described water washing, and an example thereof is the bath containing the compound described in JP-A-2-201357, JP-A-2-132435, JP-A-1-102553 or JP-A-46-44446 used as a final bath of the light-sensitive material.

The stabilizing bath may also contain, if desired, an ammonium compound, a metal compound such as Bi and Al, a fluorescent brightening agent, various chelating agents, a film pH adjusting agent, a hardening agent, a sterilizer, an antimold, an alkanolamine or a surface active agent. Water for use in the water washing or stabilization step may be tap water, but deionized water or water subjected to sterilization-with a halogen or ultraviolet bactericidal lamp or various oxidizing agents (e.g., ozone, hydrogen peroxide, chlorate) is preferably used. Further, washing water containing the compound described in JP-A-4-39652 or JP-A-5-241309 may also be used.

The temperature and the time in water washing or stabilization are preferably from 0 to 50° C. and from 5 seconds to 2 minutes, respectively.

The processing solution for use in the present invention is preferably stored in a packaging material having a low oxygen permeability described in JP-A-61-73147.

The processing solution for use in the present invention may be formed into powder or a solid. To this effect, the methods described in JP-A-61-259921, JP-A-4-85533 and JP-A-4-16841 are preferably used. In particular, the method described in JP-A-61-259921 is preferred.

When the replenishing amount is reduced, the contact area of the processing tank with air is preferably made small so as to prevent evaporation or air oxidation of the solution. The roller transportation-type automatic developing machine is described in U.S. Pat. Nos. 3,025,779 and 3,545,971. In the present invention, the developing machine of this type is simply referred to as a roller transportation-type processor. The roller transportation-type processor generally composed of four processing steps of development, fixing, water washing and drying. It is most preferred that this four-step system is followed also in the present invention, though use of other steps (for example, stopping) is not excluded. In the four-step system, water washing may be replaced by stabilization.

The present invention will be described in more detail with reference to the following Examples, but the present invention should not be construed as being limited thereto.

EXAMPLE 1-1

<Preparation of solid dispersion of hydrazide compound>

A 25% aqueous solution of Demol SNB (available from Kao Corp.) was prepared. To 1 g of the hydrazine compound shown in Table 1-1 were added 1.2 g of the above described aqueous solution of Demol SNB and 59 g of water. The mixture was then stirred to make a slurry. The slurry was then subjected to dispersion in a dispersing machine (1/16 gallon; sand grinder mill, available from Aimex Co., Ltd.) with 170 g of glass beads having a diameter of from 0.8 to 1.2 mm as a medium for 15 hours. An aqueous solution of gelatin was then added to the dispersion in such an amount that the concentration of the hydrazine compound and the gelatin reached 1% and 5%, respectively. Proxel as an antiseptic was then added to the dispersion in an amount of 2,000 ppm based on gelatin. Finally, an ascorbic acid was then added to the dispersion so that the pH value of the dispersion was adjusted to 5.0.

For comparison, the following hydrazine compounds were also used.

TABLE 1-1

Comparative compound 1:

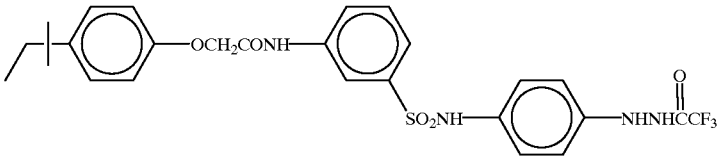

Comparative compound 2:

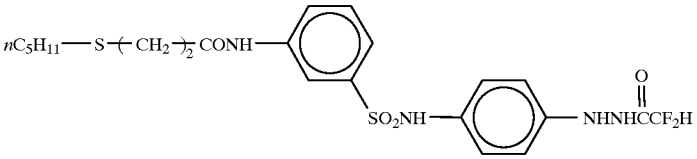

Comparative compound 3:

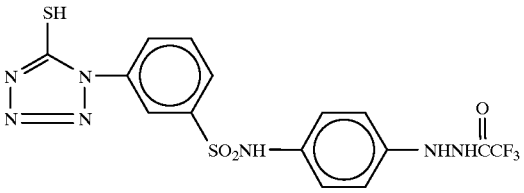

| Solid dispersion No. | Hydrazine compound | Average particle size (μm) |
|---|---|---|
| K-1 | Comparative Compound 1 | 0.35 |
| K-2 | Comparative Compound 2 | 0.38 |
| K-3 | Comparative Compound 3 | 0.29 |
| K-4 | 2e | 0.45 |
| K-5 | 2k | 0.48 |
| K-6 | 2l | 0.46 |
| K-7 | 3e | 0.42 |
| K-8 | 5e | 0.45 |
| K-9 | 12e | 0.45 |
| K-10 | 12s | 0.44 |
| K-11 | 21 | 0.49 |
| K-12 | 22 | 0.43 |

TABLE 1-1-continued

| | | |
|---|---|---|
| K-13 | 1e | 0.42 |
| K-14 | 1k | 0.43 |
| K-15 | 1l | 0.43 |
| K-16 | 9e | 0.46 |
| K-17 | 9p | 0.46 |
| K-18 | 9r | 0.47 |
| K-19 | 13e | 0.45 |
| K-20 | 13s | 0.48 |
| K-21 | 13g | 0.49 |

EXAMPLE 1-2

<Preparation of silver halide photographic material>

Preparation of emulsion A

An aqueous solution of silver nitrate and an aqueous solution of halide containing potassium bromide, sodium chloride, $K_3IrCl_6$ in an amount of $3.5\times10^{-7}$ mol per mol of silver and $K_2Rh(H_2O)Cl_5$ in an a mount of $2.0\times10^{-7}$ per mol of silver were added to an aqueous solution of gelatin containing sodium chloride and 1,3-dimethyl-2-imidazolidiniethione by a double jet process with stirring to prepare a particulate silver bromochloride having an average particle size of 0.25 $\mu$m and a silver chloride content of 70 mol %.

The emulsion was then rinsed by an ordinary flocculation method. To the emulsion was then added gelatin in an amount of 40 g per mol of silver. To the emulsion were then added sodium benzenethiosulfonate and benzenesulfinic acid in an amount of 7 mg and 2 mg per mol of silver, respectively. The pH value and pAg value of the emulsion were then adjusted to 6.0 and 7.5, respectively. To the emulsion were then added sodium thiosulfate and chloroauric acid in an amount of 2 mg and 4 mg per mol of silver, respectively. The emulsion was then subjected to a chemical sensitization at a temperature of 60° C. so that the optimum sensitivity was obtained. 150 mg of 4-hydroxy-6-methyl-1,3,3a,7-tetrazaindene as a stabilizer and 100 mg of proxel as an antiseptic were added to the system. As a result, an emulsion o f cubic silver bromochloride grains having an average size of 0.25 $\mu$m and a silver chloride content of 70 mol % was obtained (fluctuation coefficient: 10%).

Preparation of coating specimen

To a polyethylene terephthalate film support having a moistureproof undercoating layer containing vinylidene chloride were applied sequentially a UL layer, an EM layer, a PC layer and an OC layer to prepare a specimen.

The preparation method and the coated amount of the components of the layers is described below.

(UL layer)

To an aqueous solution of gelatin was added a polyethylacrylate dispersion in an amount of 30% by weight based on gelatin. The coating solution thus obtained was applied to the support in such an amount that the coated amount of gelatin reached 0.5 g/m$^2$.

(EM layer)

To Emulsion A was added the following compounds (S-1) and (S-2) as sensitizing dyes in an amount of $5\times10^{-4}$ mol and $5\times10^{-4}$ mol per mol of silver, respectively. To the emulsion were then added a mercapto compound represented by the following general formula (a) in an amount of $3\times10^{-4}$ mol per mol of silver, a mercapto compound represented by the following general formula (b) in an amount of $4\times10^{-4}$ mol per mol of silver, a triazine compound represented by the following general formula (c) in an amount of $4\times10^{-4}$ mol per mol of silver, 5-chloro-8-hydroxyquinoline in an amount of $2\times10^{-3}$ mol per mol of silver, the nucleating agent represented by formula (A) shown below in an amount of $5.0\times 10^{-4}$ mol per mol of silver, and a surface active agent represented by formula (p) below in an amount of $5\times10^{-4}$ mol per mol of silver. To the emulsion were then added hydroquinone and N-oleyl-N-methyltaurine sodium salt in such an amount that the coated amount reached 100 mg/m$^2$ and 30 mg/m$^2$, respectively. To the emulsion was then added the solid dispersion of hydrazide compound prepared in Example 1-1 or a methanol solution of hydrazide compound as a nucleating agent in an amount of $5\times10^{-4}$ mol/Ag-mol as calculated in terms of hydrazide compound in the manner as shown in Table 1-2. To the emulsion were then added 200 mg/m$^2$ of a water-soluble latex represented by the following formula (d), 200 mg/m$^2$ of a polyethyl acrylate dispersion, 200 mg/m$^2$ of a latex copolymer of methyl acrylate, sodium 2-acrylamido-2-methylpropanesylfonate and 2-acetoacetoxyethyl methacrylate (88:5:7 by weight), 200 mg/m$^2$ of colloidal silica having an average particle diameter of 0.02 $\mu$m, 200 mg/m$^2$ of 1,3-divinylsulfonyl-2-propanol as a hardening agent, and 30 mg/m$^2$ of sodium polystyrenesulfonate as a thickener. The pH value of the solution was adjusted with acetic acid to 5.65. The coating solution thus obtained was then applied to a support in such an amount that the coated amount of silver reached 2.6 g/m$^2$.

TABLE 1-2

| Specimen No. | Hydrazine compound | Way of Addition |
|---|---|---|
| 1-1 | Comparative Compound 1 | Methanol solution |
| 1-2 | Comparative Compound 2 | Methanol solution |
| 1-3 | Comparative Compound 3 | Methanol solution |
| 1-4 | K-1 | Solid dispersion |
| 1-5 | K-2 | Solid dispersion |
| 1-6 | K-3 | Solid dispersion |
| 1-7 | 2e | Methanol solution |
| 1-8 | 2k | Methanol solution |
| 1-9 | 2l | Methanol solution |
| 1-10 | K-4 | Solid dispersion |
| 1-11 | K-5 | Solid dispersion |
| 1-12 | K-6 | Solid dispersion |
| 1-13 | K-7 | Solid dispersion |
| 1-14 | K-8 | Solid dispersion |
| 1-15 | K-9 | Solid dispersion |
| 1-16 | K-10 | Solid dispersion |
| 1-17 | K-11 | Solid dispersion |
| 1-18 | K-12 | Solid dispersion |

(The hydrazine compound added in the form of solid dispersion was prepared in Example 1-1)

(PC layer)

To an aqueous solution of gelatin were added an ethyl acrylate dispersion in an amount of 50% by weight based on gelatin, the surface active agent (w) shown below in an amount of 5 mg/m$^2$, and 1,5-dihydroxy-2-benzaldoxim in an amount of 10 mg/m$^2$. The coating solution thus prepared was then applied in such an amount that the coated amount of gelatin reached 0.5 g/m$^2$.

(OC layer)

Gelatin, an amorphous $SiO_2$ matting agent having an average grain size of about 3.5 $\mu$m, methanol silica, a polyacrylamide, and a silicone oil were applied in an amount of 0.5 g/m$^2$, 40 mg/m$^2$, 0.1 g/m$^2$, 100 mg/m$^2$ and 20 mg/m$^2$, respectively. As coating aids there were applied the fluorine surface active agent represented by formula (e) shown below and sodium dodecylbenzenesulfonate in an amount of 5 mg/m$^2$ and 100 mg/m$^2$, respectively.

(S-1)

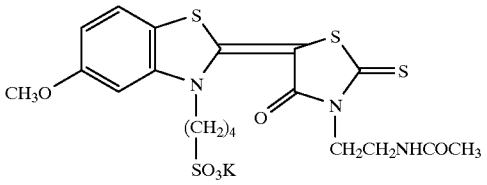

(S-2)

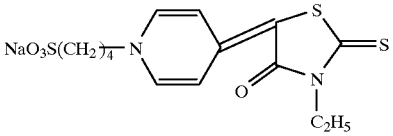

(a)

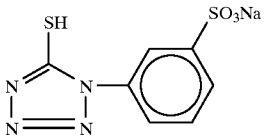

(b)

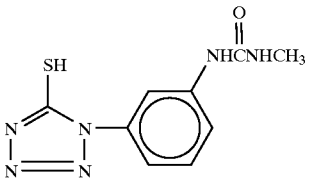

(c)

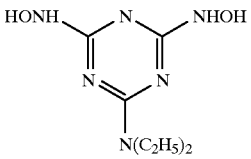

(A)

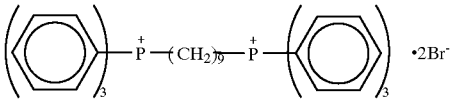

-continued (p)

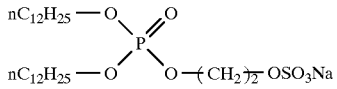

(d)

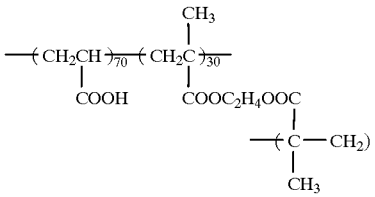

(e)

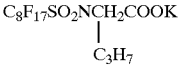

(w)

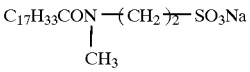

These coated specimens had a back layer and a back protective layer having the following composition:

(Back layer)

| | | |
|---|---|---|
| Gelatin | 3 | g/m$^2$ |
| Latex: Polyethyl acrylate | 2 | g/m$^2$ |
| Surface active agent: | | |
| Sodium p-dodecylbenzenesulfonate | 40 | mg/m$^2$ |
| $CH_2{=}CHSO_2CH_2CONH$ — $(CH_2)_2$ — $CH_2{=}CHSO_2CH_2CONH$ | 110 | mg/m$^2$ |
| $SnO_2$/Sb (weight ratio: 90/10; average grain diameter: 0.20 $\mu$m) | 200 | mg/m$^2$ |
| Dye: Mixture of Dye (a), Dye (b) and Dye (c) | | |
| Dye (a) | 70 | mg/m$^2$ |
| Dye (b) | 70 | mg/m$^2$ |
| Dye (c) | 90 | mg/m$^2$ |

Dye (a)

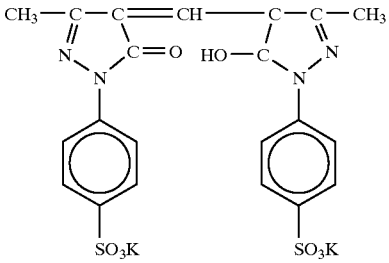

Dye (b)

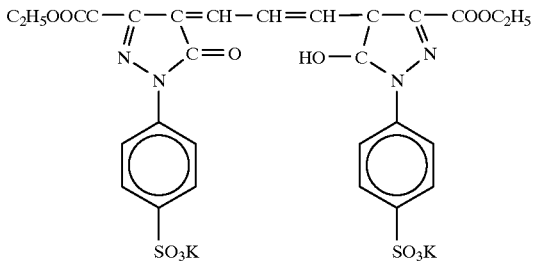

Dye (c)

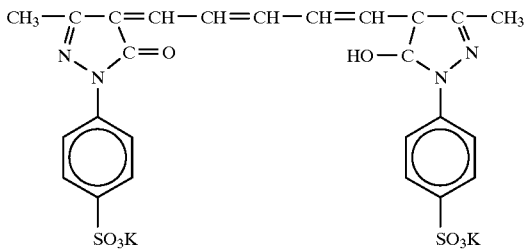

(Back protective layer)

| | |
|---|---|
| Gelatin | 0.8 mg/m$^2$ |
| Particulate polymethyl methacrylate (average grain diameter: 4.5 $\mu$m) | 30 mg/m$^2$ |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

<Preparation of developer>

Developer B having the following composition was prepared.

<Developer B>

| | | |
|---|---|---|
| Sodium hydroxide | 1.71 | g |
| Diethylenetriaminepentaacetic acid | 4 | g |
| Potassium carbonate | 55 | g |
| Sodium metabisulfite | 51 | g |
| Sodium erythorbate | 45 | g |
| N-methyl-p-aminophenol | 7.5 | g |
| KBr | 2 | g |
| 5-Methylbenzotriazole | 0.1 | g |
| 1-Phenyl-5-mercaptotetrazole | 0.02 | g |
| Sodium sulfite | 5 | g |
| Glacial acetic acid | 9 | g |
| Water to make | 1 | l |
| pH | 9.7 | |

Further, Developer B' was prepared by adding acetic acid to Developer B to have a pH adjusted to 9.4. Also Developer B" was prepared by adding sodium hydroxide to Developer B to have a pH adjusted to 10.0.

<Evaluation>

(1) Exposure and development

The above described specimen was exposed to light from a xenon flash lamp having an emission time of $10^{-5}$ sec. through an interference filter having a peak at 488 nm and a stepwedge, developed with Developers B, B' or B" by means of an automatic developing machine FG-680AG available from Fuji Photo Film Co., Ltd. at 35° C. for 20 seconds, fixed, rinsed, and then dried. The replenishment rate of the developer and the fixing solution during processing were each 100 ml per m$^2$.

As the fixing solution there was used the fixing solution A having the following formulation.

<Fixing solution A>

| | | |
|---|---|---|
| Ammonium thiosulfate | 119.7 | g |
| Disodium ethylenediamine-tetraacetate dihydrate | 0.03 | g |
| Sodium thiosulfate pentahydrate | 10.9 | g |
| Sodium sulfite | 25.0 | g |
| NaOH (pure content) | 12.4 | g |
| Glacial acetic acid | 29.1 | g |
| Tartaric acid | 2.92 | g |
| Sodium gluconate | 1.74 | g |
| Aluminum sulfate | 8.4 | g |
| pH adjusted with sulfuric acid or sodium hydroxide to | 4.8 | |
| Water to make | 1 | l |

(2) Contrast

For the evaluation of the index representing the image contrast ($\gamma$), the inclination of the straight line between the point of (fog+density 0.1) and the point of (fog+density 3.0) on the characteristic curve was determined. In other words, $\gamma$ is represented by (3.0–0.1)/(log(exposure amount giving a density of 3.0)– (exposure amount giving a density of 0.1)). The more $\gamma$ value is, the higher is the contrast.

(3) Photographic sensitivity

The sensitivity is represented by the reciprocal of the exposure giving an exposure of 1.5. The sensitivity of the various specimens were calculated as $S_{1.5}$ relative to that of reference specimen as 100. The more this value is, the higher is the sensitivity.

(4) Developer's pH dependency of photographic properties

From the sensitivity obtained upon the development with Developers B' and B", the dependency of sensitivity on pH of developer was calculated by the following equation:

$$\text{pH Dependency of sensitivity } (\Delta S_{1.5}) = S_{1.5}\ (\text{Developer B"}) - S_{1.5}\ (\text{Developer B'})$$

The smaller this value is, the smaller is the dependency of sensitivity on pH of developer, i.e., the higher is the processing stability.

(5) Aging stability of emulsion layer (EM layer) coating solution.

For the evaluation of the aging stability of the emulsion layer (EM layer) coating solution, two photographic light-sensitive materials were prepared from the same formulation. In some detail, a photographic light-sensitive material was prepared by applying the emulsion layer coating solution immediately after the preparation of the coating solution. On the other hand, another emulsion layer coating solution having the same formulation was aged at 40° C. for 10 hours after the preparation thereof, and then applied to the support to prepare the other specimen. Thus obtained specimens were then measured for sensitivity. The sensitivity change is represented by the following equation:

$$\text{Sensitivity change with time } (\Delta S_{1.5}) = S_{1.5}\ (\text{light-sensitive material prepared from emulsion which was aged at 40° C. for 10 hours}) - S_{1.5}\ (\text{light-sensitive material prepared from emulsion which was prepared immediately})$$

The greater this value is, the greater is the sensitized range.

The results are shown in Table 1-3.

TABLE 1-3

| Specimen No. | γ | Sensitivity change ($\Delta S_{1.5}$) | Dependency on pH ($\Delta S_{1.5}$) | Remarks |
|---|---|---|---|---|
| 1-1 | 12 | 0.25 | 0.30 | Comparative Example |
| 1-2 | 14 | 0.29 | 0.41 | Comparative Example |
| 1-3 | 15 | 0.33 | 0.46 | Comparative Example |
| 1-4 | 11 | 0.12 | 0.32 | Comparative Example |
| 1-5 | 12 | 0.19 | 0.43 | Comparative Example |
| 1-6 | 14 | 0.19 | 0.47 | Comparative Example |
| 1-7 | 22 | 0.28 | 0.05 | Comparative Example |
| 1-8 | 25 | 0.32 | 0.07 | Comparative Example |
| 1-9 | 23 | 0.31 | 0.09 | Comparative Example |
| 1-10 | 20 | 0.02 | 0.04 | Present Invention |
| 1-11 | 23 | 0.04 | 0.06 | Present Invention |
| 1-12 | 22 | 0.03 | 0.08 | Present Invention |
| 1-13 | 21 | 0.03 | 0.06 | Present Invention |
| 1-14 | 20 | 0.05 | 0.07 | Present Invention |
| 1-15 | 19 | 0.04 | 0.05 | Present Invention |
| 1-16 | 19 | 0.04 | 0.04 | Present Invention |
| 1-17 | 22 | 0.05 | 0.05 | Present Invention |
| 1-18 | 21 | 0.02 | 0.08 | Present Invention |

<Results>

Only the use of the hydrazine compound of the present invention as a nucleating agent could provide scanner light-sensitive materials for argon laser which exhibit an ultrahigh contrast and an excellent processing stability with a low pH developer and an excellent storage stability of coating solution.

EXAMPLE 1-3

<Preparation of silver halide photographic material>

Preparation of emulsion

Emulsion B was prepared in the following manner.

Emulsion B was prepared in the same manner as Emulsion A, except that the chemical sensitization was effected with a selenium sensitizer having the following structural formula, sodium thiosulfate and chloroauric acid in an amount of 1 mg, 1 mg and 4 mg per mol of silver, respectively, at a temperature of 60° C. so that the optimum sensitivity was obtained.

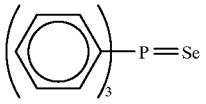

Preparation of coated specimen

A coated specimen was prepared in the same manner as in Example 1-2, except that the following compound (S-3) was added in an amount of $2.1\times10^{-4}$ mol per mol of silver instead of the sensitizing dye to be incorporated in EM layer and that Emulsion B was used as the emulsion to be incorporated in EM layer.

(S-3)

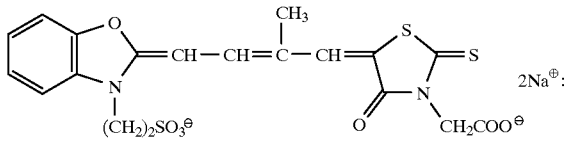

<Evaluation>

(1) Exposure and development

The above described specimen was exposed to light from a xenon flash lamp having an emission time of $10^{-6}$ sec. through an interference filter having a peak at 633 nm and a stepwedge. The specimen thus exposed was developed with Developer B, B' or B" set forth in Example 1-2 by means of an automatic developing machine FG-680AG available from Fuji Photo Film Co., Ltd. at a temperature of 35° C. for 20 seconds, fixed (in the same manner as in Example 1-2), rinsed, and then dried. The replenishment rate of the developer and the fixing solution during processing were each 100 ml per $m^2$.

The specimen was then evaluated for contrast, dependency of the sensitivity on pH of a developer, aging stability of the emulsion layer coating solution in the same manner as in Example 1-2.

<Results>

Similarly to Example 1-2, only the use of the hydrazine compound of the present invention as a nucleating agent could provide scanner light-sensitive materials for helium neon laser which exhibit an ultrahigh contrast and an excellent processing stability with a low pH developer and an excellent storage stability of coating solution.

EXAMPLE 1-4

<Preparation of silver halide photographic material>

A specimen was prepared in the same manner as in Example 1-2, except that the sensitizing dye to be incorporated in EM layer was changed to the following compound (S-4).

(S-4):

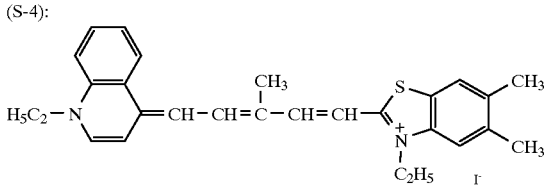

<Evaluation>

The above described specimen was exposed to light from a xenon flash lamp having an emission time of $10^{-6}$ sec. through an interference filter having a peak at 780 nm and a stepwedge. The specimen thus exposed was developed with Developers B, B' or B" set forth in Example 1-2 by means of an automatic developing machine FG-680AG available-from Fuji Photo Film Co., Ltd. at a temperature of 35° C. for 20 seconds, fixed (in the same manner as in Example 1-2), rinsed, and then dried. The replenishment rate of the developer and the fixing solution during processing were each 100 ml per $m^2$.

The specimen was then evaluated for contrast, dependency of the sensitivity on pH of a developer, aging stability of the emulsion layer coating solution in the same manner as in Example 1-2.

<Results>

Similarly to Example 1-2, only the use of the hydrazine compound of the present invention as a nucleating agent could provide scanner light-sensitive materials for semiconductor laser which exhibit an ultrahigh contrast and an excellent processing stability with a low pH developer and an excellent storage stability of coating solution.

EXAMPLE 1-5

<Preparation of silver halide photographic material>

A specimen was prepared in the same manner as in Example 1-2, except that the sensitizing dye to be incorporated in EM layer was changed to the following compound (S-5).

(S-5):

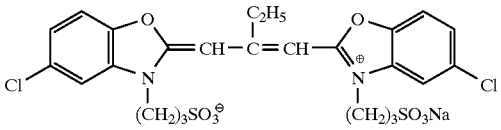

<Evaluation>

The above described specimen was exposed to light from a 3200° K tungsten lamp through a stepwedge. The specimen thus exposed was developed with Developer B, B' or B" set forth in Example 1-2 by means of an automatic developing machine FG-680AG available from Fuji Photo Film Co., Ltd. at a temperature of 35° C. for 20 seconds, fixed (in the same manner as in Example 1-2), rinsed, and then dried. The replenishment rate of the developer and the fixing solution during processing were each 100 ml per $m^2$.

The specimen was then evaluated for contrast, dependency of the sensitivity on pH of a developer, aging stability of the emulsion layer coating solution in the same manner as in Example 1-2.

<Results>

Similarly to Example 1-2, only the use of the hydrazine compound of the present invention as a nucleating agent could provide scanner light-sensitive materials for camera work which exhibit an ultrahigh contrast and an excellent processing stability with a low pH developer and an excellent storage stability of coating solution.

EXAMPLE 1-6

<Preparation of silver halide photographic material>

Preparation of Emulsion C

To a 1.5% aqueous solution of gelatin having pH 2.0 containing sodium chloride, sodium benezenethiosulfonate in an amount of $3\times10^{-3}$ mol per mol of silver and 4-hydroxy-6-methyl-1,3,3a,7-tetraazaindene in an amount of $5\times10^{-3}$ mol per mol of silver which had been kept at 35° C. was added an aqueous solution of silver nitrate and an aqueous solution of sodium chloride containing $K_2Ru(NO)Cl_5$ in an amount of $5\times10^{-5}$ mol per mol of silver by a double jet process at a potential of 95 mV in such a manner that half of the amount of silver required for the formation of final grains was reached over 3 minutes and 30 seconds. Thus, cores having a grain size of 0.12 $\mu$m were prepared. Thereafter, to the emulsion were then added an aqueous solution of silver nitrate and an aqueous solution of sodium chloride containing $K_2Ru(NO)Cl_5$ in an amount of $5\times10^{-5}$ mol per mol of silver over 7 minutes in the same manner as above to prepare an emulsion of cubic grains of silver chloride having an average grain size of 0.13 $\mu$m (fluctuation coefficient: 12%).

The emulsion was then rinsed by a flocculation method well known in the art to remove soluble salts therefrom. To the emulsion was then added gelatin. To the emulsion were then added compound F and phenoxyethanol as preservatives in an amount of 60 mg per mol of silver each. The emulsion was then adjusted to pH 5.5 and pAg 7.5. To the emulsion were then added chloroauric acid, selenium compound SE and sodium thiosulfate in an amount of $4\times10^{-5}$ mol, $1\times10^{-5}$ mol and $1\times10^{-5}$ mol per mol of silver, respectively. The emulsion was then heated to a temperature of 60° C. for 60 minutes to undergo chemical sensitization. To the emulsion was then added 4-hydroxy-6-methyl-1,3,3a,7-tetraazaindene as a stabilizer in an amount of $1\times10^{-3}$ mol per mol of silver. (The final grains exhibited a pH value of 5.7, a pAg value of 7.5 and an Ru content of $5\times10^{-5}$ mol/mol Ag.)

(SE):

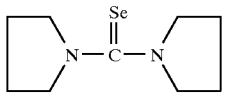

(F):

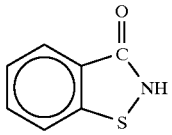

Preparation of coated specimen (Silver halide emulsion layer)

To Emulsion C were then added the following compounds. The coating solution thus obtained was then applied to a support comprising an undercoating layer described below in such an amount that the coated amount of gelatin and silver reached 0.9 g/$m^2$ and 2.75 g/$m^2$, respectively, to form a silver halide emulsion layer thereon.

| | |
|---|---|
| N-oleyl-N-methyltaurin sodium salt | 19 mg/$m^2$ |
| Solid dispersion of hydrazide compound shown in Table 1-4 prepared in Example 1-1 or methanol solution of hydrazide compound (calculated in terms of hydrazide compound) | 15 mg/$m^2$ |
| Nucleation accelerator Z shown below | 20 mg/$m^2$ |
| Sodium 3-(5-Mercaptotetrazole)-benzenesulfonate | 11 mg/$m^2$ |
| Compound A | 13 mg/$m^2$ |
| Ascorbic acid | 1 mg/$m^2$ |
| Compound B | 15 mg/$m^2$ |
| Compound C | 70 mg/$m^2$ |

-continued

| | |
|---|---|
| Acetic acid to make film pH | 5.2–6.0 |
| Compound D | 950 mg/m$^2$ |
| Liboran-1400 (available from Lion Corp.) | 47 mg/m$^2$ |
| Compound E (hardening agent) to make percent swell with water | 80% |

The following lower emulsion protective layer and the upper emulsion protective layer were applied onto the above described emulsion layer.

(Lower emulsion protective layer)

To an aqueous solution of gelatin were added the following compounds. The coating solution thus obtained was then applied to the emulsion layer in such an amount that the coated amount of gelatin reached 0.8 g/m$^2$.

| | |
|---|---|
| Gelatin ($Ca^{++}$ content: 2,700 ppm) | 0.8 g/m$^2$ |
| Compound F | 1 mg/m$^2$ |
| 1,5-Dihydroxy-2-benzaldoxim | 14 mg/m$^2$ |
| $C_2H_5SO_2SNa$ | 3 mg/m$^2$ |
| Compound C | 3 mg/m$^2$ |
| Sodium p-dodecylbenzenesulfonate | 7 mg/m$^2$ |

(Preparation and coating of upper emulsion protective layer coating solution)

To an aqueous solution of gelatin were added the following compounds. The coating solution thus obtained was then applied to the emulsion layer in such an amount that the coated amount of gelatin reached 0.45 g/m$^2$.

| | |
|---|---|
| Gelatin ($Ca^{++}$ content: 2,700 ppm) | 0.45 g/m$^2$ |
| Amorphous silica matting agent (average grain diameter: 4.4 $\mu$m) | 40 mg/m$^2$ |
| Amorphous silica matting agent (average grain diameter: 3.6 $\mu$m) | 10 mg/m$^2$ |
| Compound F | 1 mg/m$^2$ |
| Compound C | 8 mg/m$^2$ |
| Solid-dispersed dye $G_1$ | 68 mg/m$^2$ |
| Liquid paraffin | 21 mg/m$^2$ |
| N-perfluorooctanesulfonyl-N-propylglycin potassium | 5 mg/m$^2$ |
| Sodium p-dodecylbenzenesulfonate | 29 mg/m$^2$ |

To the other side of the support were then applied the following electrically-conductive layer and back layer.

(Electrically-conductive layer)

To an aqueous solution were added the following compounds. The coating solution thus obtained was then applied to the support in such an amount that the coated amount of gelatin reached 0.06 g/m$^2$.

| | |
|---|---|
| $SnO_2$/Sb (9/1 by weight; average grain diameter: 0.25 $\mu$m) | 186 mg/m$^2$ |
| Gelatin ($Ca^{++}$ content: 2,700 ppm) | 0.06 g/m$^2$ |
| Sodium p-dodecylbenzenesulfonate | 13 mg/m$^2$ |
| Sodium dihexyl-$\alpha$-sulfosuccinate | 12 mg/m$^2$ |
| Compound C | 12 mg/m$^2$ |
| Compound F | 1 mg/m$^2$ |

(Back layer)

To an aqueous so lution were added the following compounds. The coating solution thus obtained was then applied to the support in such an amount that the coated amount of gelatin reached 1.94 g/m$^2$.

| | |
|---|---|
| Gelatin ($Ca^{++}$ content: 30 ppm) | 1.94 g/m$^2$ |
| Particulate polymethyl methacrylate (average grain diameter: 4.7 $\mu$m) | 7 mg/m$^2$ |
| Compound H | 233 mg/m$^2$ |
| Compound I | 21 mg/m$^2$ |
| Compound G | 146 mg/m$^2$ |
| Compound F | 3 mg/m$^2$ |
| Sodium p-dodecylbenzenesulfonate | 68 mg/m$^2$ |
| Sodium dihexyl-$\alpha$-sulfosuccinate | 21 mg/m$^2$ |
| $C_8F_{17}SO_3Li$ | 4 mg/m$^2$ |
| N-perfluorooctanesulfonyl-N-propylglycin potassium | 6 mg/m$^2$ |
| Sodium sulfate | 177 mg/m$^2$ |
| Compound E (hardening agent) to make percent swelling with water | 90% |

(Support, undercoating layer)

A first undercoating layer and a second undercoating layer having the following formulations were applied to both sides of a biaxially-oriented polyethylene terephthalate support (thickness: 100 $\mu$m).

(First undercoating layer)

| | |
|---|---|
| Core-shell type vinylidene chloride copolymer (1) | 15 g |
| 2,4-Dichloro-6-hydroxy-s-triazine | 0.25 g |
| Particulate polystyrene (average grain diameter: 3 $\mu$m) | 0.05 g |
| Colloidal silica (Snowtex ZL; grain diameter: 70 to 100 $\mu$m; available from Nissan Chemical Industries, Ltd.) | 0.12 g |
| Water to make | 100 g |

To the solution was then added a 10 wt % KOH to adjust the pH value thereof to 6. The coating solution was then applied to the support in such an amount that the dry thickness (dried at 180° C. for 2 minutes) reached 0.9 $\mu$m.

(Second undercoating layer)

| | |
|---|---|
| Gelatin | 1 g |
| Methyl cellulose | 0.05 g |
| Compound J | 0.02 g |
| $C_{12}H_{25}O(CH_2CH_2O)_{10}H$ | 0.03 g |
| Compound F | $3.5 \times 10^{-3}$ g |
| Acetic acid | 0.2 g |
| Water to make | 100 g |

The coating solution thus obtained was then applied to the support in such an amount that the dry thickness (dried at 170° C. for 2 minutes) reached 0.1 $\mu$m to prepare an undercoated support.

Nucleation accelerator Z:

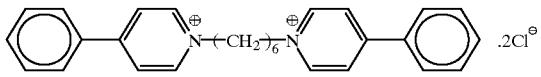

Compound A:

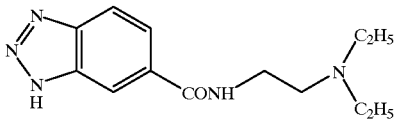

-continued

Compound B:

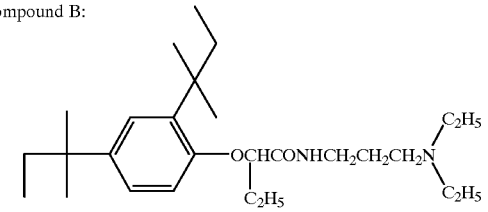

Compound C:

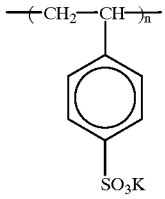

Compound D: Core/shell = 50/50

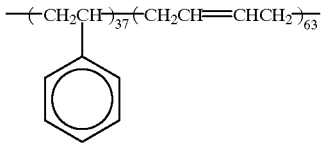

<Core portion: St/Bu = 37/63>

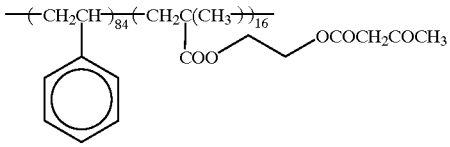

<Shell portion: St/AAEMA = 84/16>

Compound E:

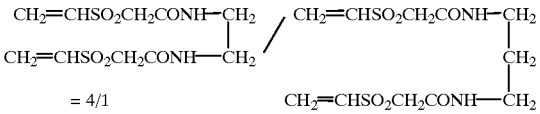

= 4/1

Compound F:

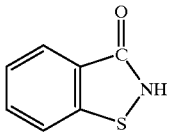

Compound G:

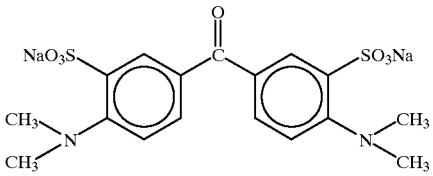

Solid-dispersed dye $G_1$:

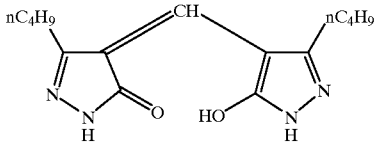

Compound H:

-continued

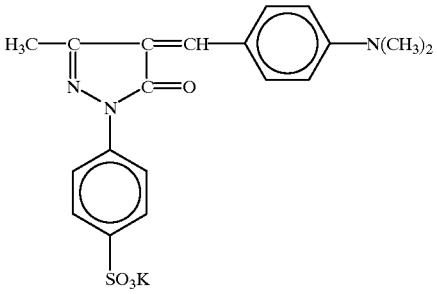

Compound I:

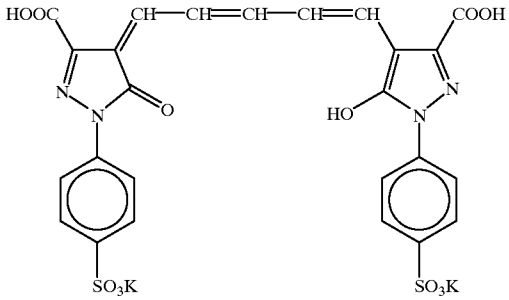

Compound J:

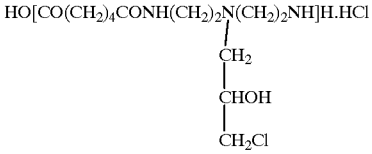

Core-shell type vinylidene chloride copolymer (1):

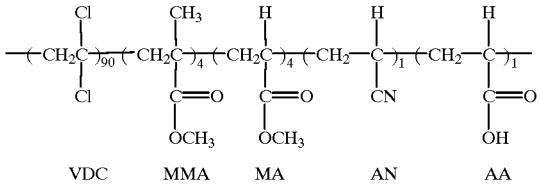

VDC MMA MA AN AA

Core: VDC/MMA/MA (80% by weight)

Shell: VDC/AN/AA (20% by weight)

Average particle size: 70nm

The coating and drying were effected under the following conditions:

<Coating method>

To the emulsion layer side of the above described undercoated support were simultaneously applied the emulsion layer, the lower emulsion protective layer and the upper emulsion protective layer in this order from the support at a temperature of 35° C. while a hardening agent solution was being supplied by a slide hopper process. The coated material was then passed through a cold air set zone (5° C.). To the other side of the above described undercoated support were then simultaneously applied the electrically-conductive layer and the back layer in this order from the support while a hardening agent solution was being supplied by a slide hopper process. The coated material was then passed through a cold air set zone (5° C.). When the coated material was passed through these set zones, the coating solutions exhibited sufficient settability. Subsequently, the both sides of the coated material were simultaneously dried in a drying zone under the following drying conditions. After the application to the back layer side of the support, the coated material was carried without being in contact with rollers and other members until being wound. The coating speed during this process was 120 m/min.

<Drying condition>

The coated material which had been thus set was dried by a 30° C. drying air until the water/gelatin weight ratio reached 800%. The coated material was then dried by a 35° C.-30% drying air until the water/gelatin weight ratio reached 200%. The coated material was then kept blown by the drying air. When the surface temperature of the coated material reached 34° C., it was considered completion of drying. After 30 seconds from the completion, the coated material was dried by a 48° C.-2% air for 1 minute. After all, the drying was effected for 50 seconds between the beginning of drying and the time at which the water/gelatin ratio reached 800%, for 35 seconds until the water/gelatin ratio reached 200% and for 5 seconds until the drying was completed.

The photographic light-sensitive material thus obtained was wound and slit at 23° C. and 40% RH, moisture-conditioned at 40° C. and 10% RH for 8 hours in a barrier bag which had been moisture-conditioned for 6 hours, and then enclosed with a cardboard which had been moisture-conditioned at 23° C. and 40% RH for 2 hours to prepare a specimen.

The humidity in the barrier bag was measured. The result was 40%.

Thus, specimens as shown in Table 1-4 were prepared.

TABLE 1-4

| Specimen No. | Hydrazine compound | Way of Addition |
|---|---|---|
| 2-1 | Comparative Compound 1 | Methanol solution |
| 2-2 | Comparative Compound 2 | Methanol solution |
| 2-3 | Comparative Compound 3 | Methanol solution |
| 2-4 | K-1 | Solid dispersion |
| 2-5 | K-2 | Solid dispersion |
| 2-6 | K-3 | Solid dispersion |
| 2-7 | 1e | Methanol solution |
| 2-8 | 1k | Methanol solution |
| 2-9 | 1l | Methanol solution |
| 2-10 | K-13 | Solid dispersion |
| 2-11 | K-14 | Solid dispersion |
| 2-12 | K-15 | Solid dispersion |
| 2-13 | K-16 | Solid dispersion |
| 2-14 | K-17 | Solid dispersion |
| 2-15 | K-18 | Solid dispersion |
| 2-16 | K-19 | Soiid dispersion |
| 2-17 | K-20 | Solid dispersion |
| 2-18 | K-21 | Solid dispersion |

(The hydrazine compound added in the form of solid dispersion was prepared in Example 1-1)

<Evaluation>

The above described specimen was exposed to light in a printer P-627FM available from Dainippon Screen Mfg. Co., Ltd. through a stepwedge. The specimen thus exposed was developed with Developers B, B' or B" set forth in Example 1-2 by means of an automatic developing machine FG-680AG available from Fuji Photo Film Co., Ltd. at a temperature of 35° C. for 20 seconds, fixed (in the same manner as in Example 1-2), rinsed, and then dried. The replenishment rate of the developer and the fixing solution during processing were each 100 ml per $m^2$.

The specimen was then evaluated for contrast, dependency of the sensitivity on pH of a developer, aging stability of the emulsion layer coating solution in the same manner as in Example 1-2.

The results are shown in Table 1-5.

TABLE 1-5

| Specimen No. | γ | Sensitivity change ($\Delta S_{1.5}$) | Dependency on pH ($\Delta S_{1.5}$) | Remarks |
|---|---|---|---|---|
| 2-1 | 8 | 0.19 | 0.12 | Comparative Example |
| 2-2 | 11 | 0.22 | 0.15 | Comparative Example |
| 2-3 | 14 | 0.25 | 0.38 | Comparative Example |
| 2-4 | 7 | 0.11 | 0.10 | Comparative Example |
| 2-5 | 10 | 0.14 | 0.12 | Comparative Example |
| 2-6 | 13 | 0.18 | 0.39 | Comparative Example |
| 2-7 | 25 | 0.21 | 0.03 | Comparative Example |
| 2-8 | 26 | 0.23 | 0.06 | Comparative Example |
| 2-9 | 23 | 0.25 | 0.08 | Comparative Example |
| 2-10 | 23 | 0.01 | 0.02 | Present Invention |
| 2-11 | 20 | 0.02 | 0.05 | Present Invention |
| 2-12 | 21 | 0.01 | 0.06 | Present Invention |
| 2-13 | 24 | 0.03 | 0.02 | Present Invention |
| 2-14 | 24 | 0.02 | 0.03 | Present Invention |
| 2-15 | 22 | 0.02 | 0.04 | Present Invention |
| 2-16 | 21 | 0.01 | 0.04 | Present Invention |
| 2-17 | 20 | 0.02 | 0.04 | Present Invention |
| 2-18 | 21 | 0.02 | 0.03 | Present Invention |

<Results>

Similarly to Example 1-2, only the use of the hydrazine compound of the present invention as a nucleating agent could provide light-sensitive materials for dot to dot work in a bright room, which exhibit an ultrahigh contrast and an excellent processing stability with a low pH developer and an excellent storage stability of coating solution.

EXAMPLE 1-7

Even when Developer D or E having the following formulations was used instead of Developer B used in Examples 1-2 to 1-6 or when Fixing solution B having the following formulation was used instead of Fixing solution A used in Examples 1-2 to 1-6, only the use of the hydrazide compound of the present invention as a nucleating agent could provide photographic light-sensitive materials which exhibit an ultrahigh contrast and a high processing stability with a low pH developer and an excellent aging stability of coating solution. However, the effect was smaller than obtained by the use of Developer B. In order to examine the photographic light-sensitive materials for dependency of photographic properties on pH of developer, the solution obtained by adding acetic acid to the developer to lower the pH value thereof by 0.3, and the solution obtained by adding sodium hydroxide to the developer to raise the pH value thereof by 0.3 were used.

<Developer D>

| | |
|---|---|
| Potassium hydroxide | 40.0 g |
| Diethylenetriaminepentaacetic acid | 2.0 g |
| Potassium carbonate | 60.0 g |
| Sodium metabisulfite | 70.0 g |
| Potassium bromide | 7.0 g |
| Hydroquinone | 40.0 g |
| 5-Methylbenzotriazole | 0.35 g |
| 4-Hydroxymethyl-4-methyl-1-phenyl-3-pyrazolidone | 1.50 g |
| Sodium 2-mercaptobenzimidazole-5-sulfonate | 0.30 g |
| Sodium 3-(5-mercaptotetrazole-1-il) benzenesulfonate | 0.10 g |
| Sodium erythorbate | 6.0 g |
| Diethylene glycol | 5.0 g |
| Potassium hydroxide to adjust pH | |
| Water to make | 1 l |
| pH | 10.65 |

<Developer E>

To the solid developer having the following formulation was added water to make 1 l before use.

The formulation of the solid developer is as follows:

| | |
|---|---|
| 99.5% Sodium hydroxide (bead) | 11.5 g |
| Potassium sulfite (raw powder) | 63.0 g |
| Sodium sulfite (raw powder) | 46.0 g |
| Potassium carbonate | 62.0 g |
| Hydroquinone (briquette) | |
| (The following components were collectively briquetted) | |
| Diethylenetriaminepentaacetic acid | 2.0 g |
| 5-Methylbenzotriazole | 0.35 g |
| 4-Hydroxymethyl-4-methyl-1-phenyl-3-pyrazolidone | 1.5 g |
| Sodium 2-mercaptobenzoimidazole-5 sulfonate | 0.3 g |
| Sodium 3-(5-mercaptotetrazole-1-il) benzenesulfonate | 0.1 g |
| Sodium erythorbate | 6.0 g |
| Potassium bromide | 6.6 g |
| Water to make | 1 l |
| pH | 10.65 |

The raw materials in the form of raw powder were used as they were in the form of general industrial product. As the alkaline metal salt beads there were used commercially available products.

As the raw materials in briquetted form there were used products which had been compacted by a briquetting machine to an undefined rugby ball-shaped piece having a length of from 4 to 6 mm. These products were then crushed before use. The components to be used in a small amount were blended, and then briquetted.

<Fixing solution B>

To the following solid agents and liquid agents was added water to make 10 l before use. The solid agent part and was packed together with the liquid agent part in a high density polyethylene vessel (average thickness: 500 μm; width: 200 to 1,000 μm) to prepare Fixing solution B. The fixing solution was dissolved to make 10 l. The pH value of the solution was 4.85.

<Solid agent part>

| | |
|---|---|
| Ammonium thiosulfate | 1,200 g |
| Sodium thiosulfate | 150 g |
| Sodium acetate | 400 g |
| Sodium metabisulfate | 200 g |

<Liquid agent part>

| | |
|---|---|
| 27% Aluminum sulfate | 300 g |
| 75% Sulfuric acid | 30 g |
| Sodium gluconate | 20 g |
| EDTA | 0.3 g |
| Citric acid | 40 g |

The solid agent part was packed in admixture.

EXAMPLE 2-1

<Preparation of solid dispersion of hydrazide compound>

A 25% aqueous solution of Demol SNB (available from Kao Corp.) was prepared. To 1 g of the hydrazine compound shown in Table 2-1 were added 1.2 g of the above described aqueous solution of Demol SNB and 59 g of water. The mixture was then stirred to make a slurry. The slurry was then subjected to dispersion in a dispersing machine (1/16 gallon; sand grinder mill, available from Aimex Co., Ltd.) with 200 g of glass beads having a diameter of from 0.8 to 1.2 mm as a medium for 10 hours. An aqueous solution of gelatin was then added to the dispersion in such an amount that the concentration of the hydrazine compound and the gelatin reached 1% and 5%, respectively. Proxel as an antiseptic was then added to the dispersion in an amount of 2,000 ppm based on gelatin. Finally, an ascorbic acid was then added to the dispersion so that the pH value of the dispersion was adjusted to 5.0.

TABLE 2-1

| Solid dispersion No. | Hydrazine compound | Average particle size (μm) |
|---|---|---|
| K-1' | 1c' | 0.37 |
| K-2' | 8e' | 0.37 |
| K-3' | 9e' | 0.40 |
| K-4' | 10e' | 0.35 |
| K-5' | 22e' | 0.39 |
| K-6' | 54' | 0.38 |

EXAMPLE 2-2

<Preparation of silver halide photographic material>

Preparation of emulsion A

An aqueous solution of silver nitrate and an aqueous solution of halide containing potassium bromide, sodium chloride, $K_3IrCl_6$ in an amount of $3.5\times10^{-7}$ mol per mol of silver and $K_2Rh(H_2O)Cl_5$ in an amount of $2.0\times10^{-7}$ mol per mol of silver were added to an aqueous solution of gelatin containing sodium chloride and 1,3-dimethyl-2-imidazolidinethione by a double jet process with stirring to prepare a particulate silver bromochloride having an average particle size of 0.25 μm and a silver chloride content of 70 mol %.

The emulsion was then rinsed by an ordinary flocculation method. To the emulsion was then added gelatin in an amount of 40 g per mol of silver. To the emulsion were then added sodium benzenethiosulfonate and benzenesulfinic acid in an amount of 7 mg and 2 mg per mol of silver, respectively. The pH value and pAg value of the emulsion were then adjusted to 6.0 and 7.5, respectively. To the emulsion were then added sodium thiosulfate and chloroauric acid in an amount of 1 mg and 4 mg per mol of silver, respectively. The emulsion was then subjected to a chemical sensitization at a temperature of 60° C. so that the optimum sensitivity was obtained. 150 mg of 4-hydroxy-6-methyl-1,3,3a,7-tetrazaindene as a stabilizer and 100 mg of proxel as an antiseptic were added to the system. As a result, an emulsion of cubic silver bromochloride grains having an average size of 0.25 $\mu$m and a silver chloride content of 70 mol % was obtained (fluctuation coefficient: 10%).

Preparation of coating specimen

To a polyethylene terephthalate film support having a moistureproof undercoating layer containing vinylidene chloride were applied sequentially a UL layer, an EM layer, a PC layer and an OC layer to prepare a specimen.

The preparation method and the coated amount of the components of the layers is described below.

(UL layer)

To an aqueous solution of gelatin was added a polyethylacrylate dispersion in an amount of 30% by weight based on gelatin. The coating solution thus obtained was applied to the support in such an amount that the coated amount of gelatin reached 0.5 g/m$^2$.

(EM layer)

To Emulsion A was added the following compounds (S-1) and (S-2) as sensitizing dyes in an amount of $5\times10^{-4}$ mol and $5\times10^{-4}$ mol per mol of silver, respectively. To the emulsion were then added a mercapto compound represented by the following general formula (a) in an amount of $3\times10^{-4}$ mol per mol of silver, a mercapto compound represented by the following general formula (b) in an amount of $4\times10^{-4}$ mol per mol of silver, a triazine compound represented by the following general formula (c) in an amount of $4\times10^{-4}$ mol per mol of silver, 5-chloro-8-hydroxyquinoline in an amount of $2\times10^{-3}$ mol per mol of silver, a nucleating agent shown in Table 2-2 in an amount of $5.0\times10^{-4}$ mol per mol of silver, and a surface active agent represented by formula (p) below in an amount of $5\times10^{-4}$ mol per mol of silver. To the emulsion were then added hydroquinone and N-oleyl-N-methyltaurine sodium salt in such an amount that the coated amount reached 100 mg/m$^2$ and 30 mg/m$^2$, respectively. To the emulsion was then added the solid dispersion of hydrazide compound prepared in Example 2-1 or a methanol solution of hydrazide compound as a nucleating agent in an amount of $5\times10^{-4}$ mol/Ag-mol as calculated in terms of hydrazide compound in the manner as shown in Table 2-2. To the emulsion were then added 200 mg/m$^2$ of a water-soluble latex represented by the following formula (d), 200 mg/m$^2$ of a polyethyl acrylate dispersion, 200 mg/m$^2$ of a latex copolymer of methyl acrylate, sodium 2-acrylamido-2-methylpropanesylfonate and 2-acetoacetoxyethyl methacrylate (88:5:7 by weight), 200 mg/m$^2$ of colloidal silica having an average particle diameter of 0.02 $\mu$m, 200 mg/m$^2$ of 1,3-divinylsulfonyl-2-propanol as a hardening agent, and 30 mg/m$^2$ of sodium polystyrenesulfonate as a thickener. The pH value of the solution was adjusted with acetic acid to 5.60. The coating solution thus obtained was then applied to a support in such an amount that the coated amount of silver reached 2.5 g/m$^2$. As comparative nucleation accelerators there were used the following compounds.

TABLE 2-2

Comparative Compound 1':
(Compound 1-12 described in JP-A-7-175159)

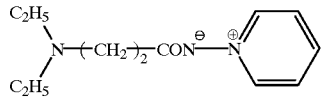

Comparative Compound 2':
(Compound 1-21 described in JP-A-7-175159)

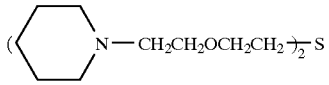

| Specimen No. | Nucleation accelerator | Hydrazine compound | Way of Addition |
|---|---|---|---|
| 1-1 | Comparative Compound 1' | 8e' | Methanol solution |
| 1-2 | Comparative Compound 1' | K-2' | Solid dispersion |
| 1-3 | Comparative Compound 2' | 8e' | Methanol solution |
| 1-4 | Comparative Compound 2' | K-2' | Solid dispersion |
| 1-5 | A-12 | K-2' | Methanol solution |
| 1-6 | A-12 | K-2' | Solid dispersion |
| 1-7 | A-10 | K-2' | Solid dispersion |
| 1-8 | A-14 | K-2' | Solid dispersion |
| 1-9 | A-21 | K-2' | Solid dispersion |
| 1-10 | A-23 | K-2' | Solid dispersion |
| 1-11 | A-12 | K-1' | Solid dispersion |
| 1-12 | A-12 | K-3' | Solid dispersion |

(The hydrazine compound added in the form of solid dispersion was prepared in Example 2-1)

(PC layer)

To an aqueous solution of gelatin were added an ethyl acrylate dispersion in an amount of 50% by weight based on gelatin, the surface active agent (w) shown below in an amount of 5 mg/m$^2$, and 1,5-dihydroxy-2-benzaldoxim in an amount of 10 mg/m$^2$. The coating solution thus prepared was then applied in such an amount that the coated amount of gelatin reached 0.5 g/m$^2$.

(OC layer)

Gelatin, an amorphous $SiO_2$ matting agent having an average grain size of about 3.5 $\mu$m, methanol silica, a polyacrylamide, and a silicone oil were applied in an amount of 0.5 g/m$^2$, 40 mg/m$^2$, 0.1 g/m$^2$, 100 mg/m$^2$ and 20 mg/m$^2$, respectively. As coating aids there were applied the fluorine surface active agent represented by formula (e) shown below and sodium dodecylbenzenesulfonate in an amount of 5 mg/m$^2$ and 100 mg/m$^2$, respectively.

(S-1)

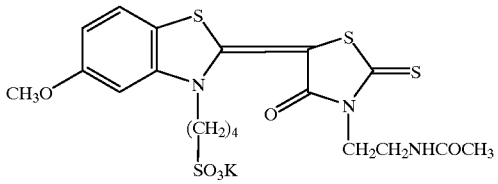

(S-2)

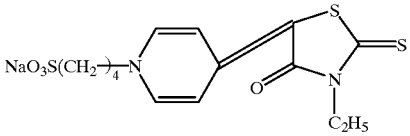

(a)

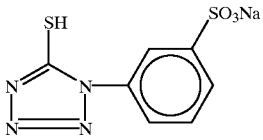

(b)

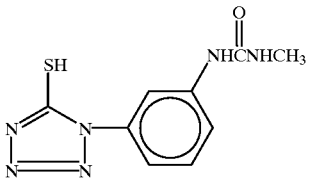

(c)

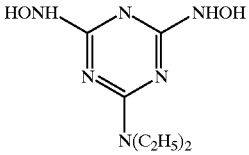

(p)

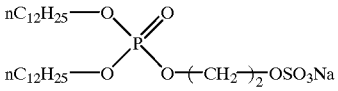

(d)

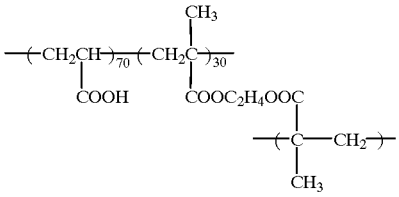

(e)

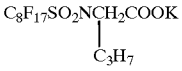

(w)

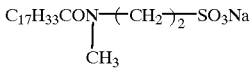

These coated specimens had a back layer and a back protective layer having the following composition:

(Back layer)

| | | |
|---|---|---|
| Gelatin | 3 | $g/m^2$ |
| Latex: Polyethyl acrylate | 2 | $g/m^2$ |
| Surface active agent: | | |
| Sodium p-dodecylbenzenesulfonate | 40 | $mg/m^2$ |
| 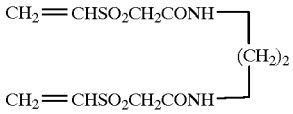 | 110 | $mg/m^2$ |
| $SnO_2$/Sb (weight ratio: 90/10; average grain diameter: 0.20 $\mu$m) | 200 | $mg/m^2$ |
| Dye: Mixture of Dye (a), Dye (b) and Dye (c) | | |
| Dye (a) | 70 | $mg/m^2$ |
| Dye (b) | 70 | $mg/m^2$ |
| Dye (c) | 90 | $mg/m^2$ |

Dye (a)

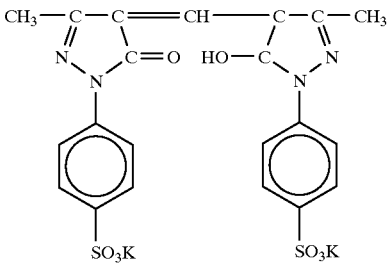

Dye (b)

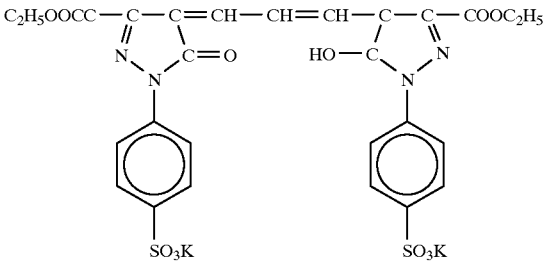

Dye (c)

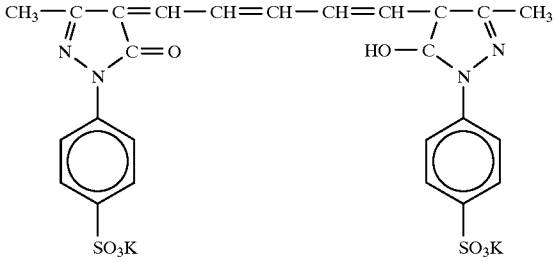

(Back protective layer)

| | |
|---|---|
| Gelatin | 0.8 mg/m$^2$ |
| Particulate polymethyl methacrylate (average grain diameter: 4.5 $\mu$m) | 30 mg/m$^2$ |
| Sodium dihexyl-$\alpha$-sulfosuccinate | 15 mg/m$^2$ |
| Sodium p-dodecylbenzenesulfonate | 15 mg/m$^2$ |
| Sodium acetate | 40 mg/m$^2$ |

<Preparation of developer>

Developers A and B having the following compositions were prepared.

<Developer A>

| | | |
|---|---|---|
| Potassium hydroxide | 40.0 | g |
| Diethylenetriaminepentaacetic acid | 2.0 | g |
| Potassium carbonate | 60.0 | g |
| Sodium metabisulfite | 70.0 | g |
| Potassium bromide | 7.0 | g |
| Hydroquinone | 40.0 | g |
| 5-Methylbenzotriazole | 0.35 | g |
| 4-Hydroxymethyl-4-methyl-1-phenyl-3-pyrazolidone | 1.50 | g |
| Sodium 2-mercaptobenzimidazole-5-sulfonate | 0.30 | g |
| Sodium 3-(5-mercaptotetrazole-1-il) benzenesulfonate | 0.10 | g |
| Sodium erythorbate | 6.0 | g |
| Diethylene glycol | 5.0 | g |
| Potassium hydroxide to make pH | 10.65 | |
| Water to make | 1 | l |

<Developer B>

| | | |
|---|---|---|
| Sodium hydroxide | 1.71 | g |
| Diethylenetriaminepentaacetic acid | 4 | g |
| Potassium carbonate | 55 | g |
| Sodium metabisulfite | 51 | g |
| Sodium erythorbate | 45 | g |
| N-methyl-p-aminophenol | 7.5 | g |
| KBr | 2 | g |
| 5-Methylbenzotriazole | 0.1 | g |
| 1-Phenyl-5-mercaptotetrazole | 0.02 | g |
| Sodium sulfite | 5 | g |
| Glacial acetic acid | 9 | g |
| Water to make | 1 | l |
| pH | 9.7 | |

<Evaluation>

(1) Exposure and development

The above described specimen was exposed to light from a xenon flash lamp having an emission time of $10^{-5}$ sec. through an interference filter having a peak at 488 nm and a stepwedge, developed with Developers A or B by means of an automatic developing machine FG-680AG available from Fuji Photo Film Co., Ltd. at 35° C. for 20 seconds, fixed, rinsed, and then dried. The replenishment rate of the developer and the fixing solution during processing were each 100 ml per m$^2$.

As the fixing solution there was used the fixing solution A having the following formulation.

<Fixing solution A>

| | | |
|---|---|---|
| Ammonium thiosulfate | 119.7 | g |
| Disodium ethylenediamine-tetraacetate dihydrate | 0.03 | g |
| Sodium thiosulfate pentahydrate | 10.9 | g |
| Sodium sulfite | 25.0 | g |

-continued

| | | |
|---|---|---|
| NaOH (pure content) | 12.4 | g |
| Glacial acetic acid | 29.1 | g |
| Tartaric acid | 2.92 | g |
| Sodium gluconate | 1.74 | g |
| Aluminum sulfate | 8.4 | g |
| pH adjusted with sulfuric acid or sodium hydroxide to | 4.8 | |
| Water to make | 1 | l |

(2) Contrast

For the evaluation of the index representing the image contrast ($\gamma$), the inclination of the straight line between the point of (fog+density 0.1) and the point of (fog+density 3.0) on the characteristic curve was determined. In other words, y is represented by (3.0–0.1)/(log(exposure amount giving a density of 3.0)– (exposure amount giving a density of 0.1)). The more $\gamma$ value is, the higher is the contrast.

(3) Photographic sensitivity

The sensitivity is represented by the reciprocal of the exposure giving an exposure of 1.5. The sensitivity of the various specimens were calculated as $S_{1.5}$ relative to that of reference specimen as 100. The more this value is, the higher is the sensitivity.

(4) Original reproducibility

For the evaluation of exposure latitude, the halftone gradation represented by the following equation was determined. The more this value is, the better is the original reproducibility.

Dot gradation=Exposure giving a dot percent of 95% (logE 95%)–exposure giving a dot percent of 5% (logE 5%)

(5) Aging stability of hydrazide compound in light-sensitive material

A photographic light-sensitive material which had been refrigerated after coating and a photographic light-sensitive material which had been stored at a temperature of 60° C. and a relative humidity of 65% for 3 days were each treated with an organic solvent to extract the hydrazide compound which was then determined by HPLC (high speed liquid chromatography). The percent residue of hydrazide compound was then calculated by the following equation:

Percent Residue of hydrazide compound after thermal processing={(Amount of hydrazide compound extracted from light-sensitive material which had been thermally processed)/(amount of hydrazide compound extracted from light-sensitive material which had been refrigerated after coating)}×100

In order to guarantee the properties of the light-sensitive material for about 2 years under natural aging conditions, it is necessary that this value be not less than 90%.

The results are shown in Table 2-3.

TABLE 2-3

| Specimen No. | Developer | $\gamma$ | Dot gradation | Residue (%) of hydrazide compound | Remarks |
|---|---|---|---|---|---|
| 1-1' | A | 14 | 1.16 | 56 | Compara. |
| 1-2' | A | 12 | 1.16 | 63 | Compara. |
| 1-3' | A | 15 | 1.13 | 42 | Compara. |
| 1-4' | A | 14 | 1.14 | 55 | Compara. |
| 1-5' | A | 22 | 1.21 | 61 | Compara. |

TABLE 2-3-continued

| Specimen No. | Developer | γ | Dot gradation | Residue (%) of hydrazide compound | Remarks |
|---|---|---|---|---|---|
| 1-6' | A | 21 | 1.24 | 93 | Invent. |
| 1-7' | A | 20 | 1.25 | 92 | Invent. |
| 1-8' | A | 23 | 1.24 | 91 | Invent. |
| 1-9' | A | 22 | 1.24 | 93 | Invent. |
| 1-10' | A | 22 | 1.25 | 95 | Invent. |
| 1-11' | A | 20 | 1.24 | 94 | Invent. |
| 1-12' | A | 21 | 1.25 | 94 | Invent. |
| 1-1' | B | 12 | 1.15 | 56 | Compara. |
| 1-2' | B | 10 | 1.15 | 63 | Compara. |
| 1-3' | B | 13 | 1.12 | 42 | Compara. |
| 1-4' | B | 11 | 1.13 | 55 | Compara. |
| 1-5' | B | 23 | 1.25 | 61 | Compara. |
| 1-6' | B | 23 | 1.26 | 93 | Invent. |
| 1-7' | B | 22 | 1.26 | 92 | Invent. |
| 1-8' | B | 25 | 1.25 | 91 | Invent. |
| 1-9' | B | 23 | 1.25 | 93 | Invent. |
| 1-10' | B | 23 | 1.26 | 95 | Invent. |
| 1-11' | B | 23 | 1.26 | 94 | Invent. |
| 1-12' | B | 24 | 1.26 | 94 | Invent. |

<Results>

Only the combinations of the present invention could provide scanner light-sensitive materials for argon laser which exhibit an ultrahigh contrast and an excellent original reproducibility with a low pH developer and an excellent storage stability. The use of Developer B, which comprises erythorbic acid as a developing agent, provided a higher effect.

EXAMPLE 2-3

<Preparation of silver halide photographic material>

Preparation of emulsion

Emulsion B was prepared in the following manner.

Emulsion B was prepared in the same manner as Emulsion A, except that the chemical sensitization was effected with a selenium sensitizer having the following structural formula, sodium thiosulfate and chloroauric acid in an amount of 1 mg, 1 mg and 4 mg per mol of silver, respectively, at a temperature of 60° C. so that the optimum sensitivity was obtained.

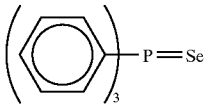

Preparation of coated specimen

A coated specimen was prepared in the same manner as in Example 2-2, except that the following compound (S-3) was added in an amount of $2.1\times10^{-4}$ mol per mol of silver instead of the sensitizing dye to be incorporated in EM layer and that Emulsion B was used as the emulsion to be incorporated in EM layer.

(S-3):

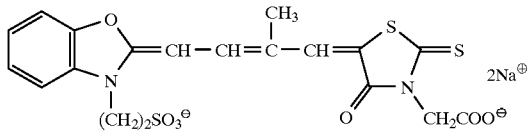

<Evaluation>

(1) Exposure and development

The above described specimen was exposed to light from a xenon flash lamp having an emission time of $10^{-6}$ sec. through an interference filter having a peak at 633 nm and a stepwedge. The specimen thus exposed was developed with Developer A or B set forth in Example 2-2 by means of an automatic developing machine FG-680AG available from Fuji Photo Film Co., Ltd. at a temperature of 35° C. for 20 seconds, fixed (in the same manner as in Example 2-2), rinsed, and then dried. The replenishment rate of the developer and the fixing solution during processing were each 100 ml per $m^2$.

The specimen was then evaluated for contrast, original reproducibility and aging stability of hydrazide compound in the light-sensitive material in the same manner as in Example-2-2.

<Results>

Similarly to Example 2-2, only the combinations of the present invention could provide scanner light-sensitive materials for helium neon laser which exhibit an ultrahigh contrast and an excellent original reproducibility with a low pH developer and an excellent storage stability. The use of Developer B, which comprises erythorbic acid as a developing agent, provided a higher effect.

EXAMPLE 2-4

<Preparation of silver halide photographic material>

A specimen was prepared in the same manner as in Example 2-2, except that the sensitizing dye to be incorporated in EM layer was changed to the following compound (S-4).

(S-4):

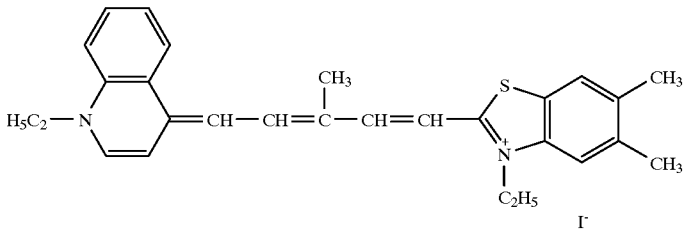

<Evaluation>

The above described specimen was exposed to light from a xenon flash lamp having an emission time of $10^{-6}$ sec. through an interference filter having a peak at 780 nm and a stepwedge. The specimen thus exposed was developed with Developers A or B set forth in Example 2-2 by means of an automatic developing machine FG-680AG available from Fuji Photo Film Co., Ltd. at a temperature of 35° C. for 20 seconds, fixed (in the same manner as in Example 2-2), rinsed, and then dried. The replenishment rate of the developer and the fixing solution during processing were each 100 ml per $m^2$.

The specimen was then evaluated for contrast, original reproducibility and aging stability of hydrazide compound in the light-sensitive material in the same manner as in Example 2-2.

<Results>

Similarly to Example 2-2, only the combinations of the present invention could provide scanner light-sensitive materials for semiconductor laser which exhibit an ultrahigh contrast and an excellent original reproducibility with a low pH developer and an excellent storage stability. The use of Developer B, which comprises erythorbic acid as a developing agent, provided a higher effect.

EXAMPLE 2-5

<Preparation of silver halide photographic material>

A specimen was prepared in the same manner as in Example 2-2, except that the sensitizing dye to be incorporated in EM layer was changed to the following compound (S-5).

(S-5):

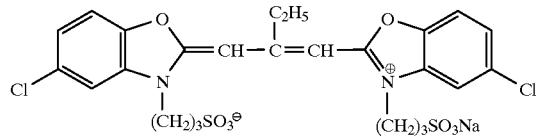

<Evaluation>

The above described specimen was exposed to light from a 3200° K. tungsten lamp through a stepwedge. The specimen thus exposed was developed with Developer A or B set forth in Example 2-2 by means of an automatic developing machine FG-680AG available from Fuji Photo Film Co., Ltd. at a temperature of 35° C. for 20 seconds, fixed (in the same manner as in Example 2-2), rinsed, and then dried. The replenishment rate of the developer and the fixing solution during processing were each 100 ml per $m^2$.

The specimen was then evaluated for contrast, original reproducibility and aging stability of hydrazide compound in the light-sensitive material in the same manner as in Example 2-2.

<Results>

Similarly to Example 2-2, only the combinations of the present invention could provide light-sensitive materials for camera work which exhibit an ultrahigh contrast and an excellent original reproducibility with a low pH developer and an excellent storage stability. The use of Developer B, which comprises erythorbic acid as a developing agent, provided a higher effect.

EXAMPLE 2-6

<Preparation of silver halide photographic material>

Preparation of Emulsion C

To a 1.5% aqueous solution of gelatin having pH 2.0 containing sodium chloride and 4-hydroxy-6-methyl-1,3,3a;7-tetraazaindene in an amount of $5\times10^{-3}$ mol per mol of silver which had been kept at 35° C. was added an aqueous solution of silver nitrate and an aqueous solution of sodium chloride containing $K_2Ru(NO)Cl_5$ in an amount of $5\times10^{-5}$ mol per mol of silver by a double jet process at a potential of 95 ml in such a manner that half of the amount of silver required for the formation of final grains was reached over 3 minutes and 30 seconds. Thus, cores having a grain size of 0.12 $\mu$m were prepared. Thereafter, to the emulsion were then added an aqueous solution of silver nitrate and an aqueous solution of sodium chloride containing $K_2Ru(NO)Cl_5$ in an amount of $5\times10^{-5}$ mol per mol of silver over 7 minutes in the same manner as above to prepare an emulsion of cubic grains of silver chloride having an average grain size of 0.13 $\mu$m (fluctuation coefficient: 12%).

The emulsion was then rinsed by a flocculation method well known in the art to remove soluble salts therefrom. To the emulsion was then added gelatin. To the emulsion were then added compound F and phenoxyethanol as preservatives in an amount of 60 mg per mol of silver each. The emulsion was then adjusted to pH 5.5 and pAg 7.5. To the emulsion were then added chloroauric acid, selenium compound SE and sodium thiosulfate in an amount of $4\times10^{-5}$ mol, $1\times10^{-5}$ mol and $1\times10^{-5}$ mol per mol of silver, respectively. The emulsion was then heated to a temperature of 60° C. for 60 minutes to undergo chemical sensitization. To the emulsion was then added 4-hydroxy-6-methyl-1,3,3a,7-tetraazaindene as a stabilizer in an amount of $1\times10^{-3}$ mol per mol of silver. (The final grains exhibited a pH value of 5.7, a pAg value of 7.5 and an Ru content of $5\times10^{-5}$ mol/mol Ag.)

(SE):

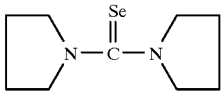

(F):

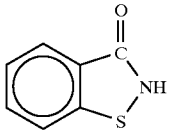

Preparation of coated specimen (Silver halide emulsion layer)

To Emulsion C were then added the following compounds. The coating solution thus obtained was then applied to a support comprising an undercoating layer described below in such an amount that the coated amount of gelatin and silver reached 0.9 g/m$^2$ and 2.75 g/m$^2$, respectively, to form a silver halide emulsion layer thereon.

| | |
|---|---|
| N-oleyl-N-methyltaurin sodium salt | 19 mg/m$^2$ |
| Solid dispersion of hydrazide compound shown in Table 2-4 prepared in Example 2-1 or methanol solution of hydrazide compound (calculated in terms of hydrazide compound) | 15 mg/m$^2$ |
| Nucleation accelerator set forth in Table 2-4 | 20 mg/m$^2$ |
| Sodium 3-(5-Mercaptotetrazole)-benzenesulfonate | 11 mg/m$^2$ |
| Compound A | 13 mg/m$^2$ |
| Ascorbic acid | 1 mg/m$^2$ |
| Compound B | 15 mg/m$^2$ |
| Compound C | 70 mg/m$^2$ |
| Acetic acid to make film pH | 5.2–6.0 |
| Compound D | 950 mg/m$^2$ |
| Liboran-1400 (available from Lion Corp.) | 47 mg/m$^2$ |
| Compound E (hardening agent) to make percent swell with water | 80% |

The following lower emulsion protective layer and the upper emulsion protective layer were applied onto the above described emulsion layer.

(Lower emulsion protective layer)

To an aqueous solution of gelatin were added the following compounds. The coating solution thus obtained was then applied to the emulsion layer in such an amount that the coated amount of gelatin reached 0.8 g/m$^2$.

| | |
|---|---|
| Gelatin ($Ca^{++}$ content: 2,700 ppm) | 0.8 g/m$^2$ |
| Compound F | 1 mg/m$^2$ |
| 1,5-Dihydroxy-2-benzaldoxim | 14 mg/m$^2$ |
| $C_2H_5SO_2SNa$ | 3 mg/m$^2$ |
| Compound C | 3 mg/m$^2$ |
| Sodium p-dodecylbenzenesulfonate | 7 mg/m$^2$ |

(Preparation and coating of upper emulsion protective layer coating solution)

To an-aqueous solution of gelatin were added the following compounds. The coating solution thus obtained was then applied to the emulsion layer in such an amount that the coated amount of gelatin reached 0.45 g/m$^2$.

| | |
|---|---|
| Gelatin ($Ca^{++}$ content: 2,700 ppm) | 0.45 g/m$^2$ |
| Amorphous silica matting agent (average grain diameter: 4.4 $\mu$m) | 40 mg/m$^2$ |
| Amorphous silica matting agent (average grain diameter: 3.6 $\mu$m) | 10 mg/m$^2$ |
| Compound F | 1 mg/m$^2$ |
| Compound C | 8 mg/m$^2$ |
| Solid-dispersed dye $G_1$ | 68 mg/m$^2$ |
| Liquid paraffin | 21 mg/m$^2$ |
| N-perfluorooctanesulfonyl-N-propylglycin potassium | 5 mg/m$^2$ |
| Sodium p-dodecylbenzenesulfonate | 29 mg/m$^2$ |

To the other side of the support were then applied the following electrically-conductive layer and back layer.

(Electrically-conductive layer)

To an aqueous solution were added the following compounds. The coating solution thus obtained was then applied to the support in such an amount that the coated amount of gelatin reached 0.06 gm$^2$.

| | |
|---|---|
| $SnO_2$/Sb (9/1 by weight; average grain diameter: 0.25 $\mu$m) | 186 mg/m$^2$ |
| Gelatin ($Ca^{++}$ content: 2,700 ppm) | 0.06 g/m$^2$ |
| Sodium p-dodecylbenzenesulfonate | 13 mg/m$^2$ |
| Sodium dihexyl-$\alpha$-sulfosuccinate | 12 mg/m$^2$ |
| Compound C | 12 mg/m$^2$ |
| Compound F | 1 mg/m$^2$ |

(Back layer)

To an aqueous solution were added the following compounds. The coating solution thus obtained was then applied to the support in such an amount that the coated amount of gelatin reached 1.94 g/m$^2$.

| | |
|---|---|
| Gelatin ($Ca^{++}$ content: 30 ppm) | 1.94 g/m$^2$ |
| Particulate polymethyl methacrylate (average grain diameter: 4.7 $\mu$m) | 7 mg/m$^2$ |
| Compound H | 233 mg/m$^2$ |
| Compound I | 21 mg/m$^2$ |
| Compound G | 146 mg/m$^2$ |
| Compound F | 3 mg/m$^2$ |
| Sodium p-dodecylbenzenesulfonate | 68 mg/m$^2$ |
| Sodium dihexyl-$\alpha$-sulfosuccinate | 21 mg/m$^2$ |
| $C_8F_{17}SO_3Li$ | 4 mg/m$^2$ |
| N-perfluorooctanesulfonyl-N-propylglycin potassium | 6 mg/m$^2$ |
| Sodium sulfate | 177 mg/m$^2$ |
| Compound E (hardening agent) to make percent swelling with water | 90% |

(Support, undercoating layer)

A first undercoating layer and a second undercoating layer having the following formulations were applied to both sides of a biaxially-oriented polyethylene terephthalate support (thickness: 100 $\mu$m).

(First undercoating layer)

| | |
|---|---|
| Core-shell type vinylidene chloride copolymer (1) | 15 g |
| 2,4-Dichloro-6-hydroxy-s-triazine | 0.25 g |
| Particulate polystyrene (average grain diameter: 3 $\mu$m) | 0.05 g |

-continued

| | |
|---|---|
| Colloidal silica (Snowtex ZL; grain diameter: 70 to 100 μm; available from Nissan Chemical Industries, Ltd.) | 0.12 g |
| Water to make | 100 g |

To the solution was then added a 10 wt % KOH to adjust the pH value thereof to 6. The coating solution was then applied to the support in such an amount that the dry thickness (dried at 180° C. for 2 minutes) reached 0.9 μm.

(Second undercoating layer)

| | | |
|---|---|---|
| Gelatin | 1 | g |
| Methyl cellulose | 0.05 | g |
| Compound J | 0.02 | g |
| $C_{12}H_{25}O(CH_2CH_2O)_{10}H$ | 0.03 | g |
| Compound F | $3.5 \times 10^{-3}$ | g |
| Acetic acid | 0.2 | g |
| Water to make | 100 | g |

The coating solution thus obtained was then applied to the support in such an amount that the dry thickness (dried at 170° C. for 2 minutes) reached 0.1 μm to prepare an undercoated support.

Compound A:

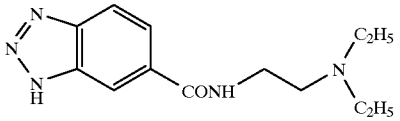

Compound B:

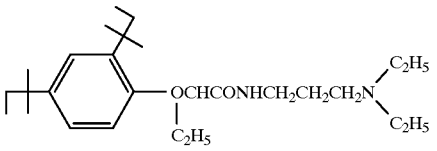

Compound C:

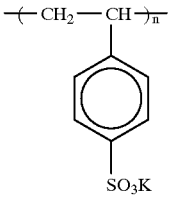

Compound D: Core/shell = 50/50

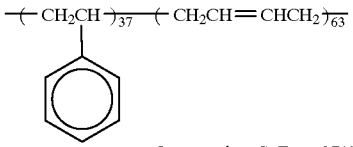

<Core portion: St/Bu = 37/63>

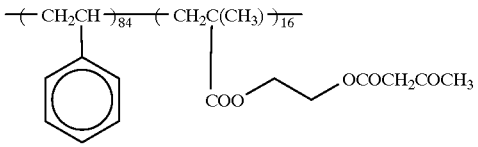

<Shell portion: St/AAEMA = 84/16>

Compound E:

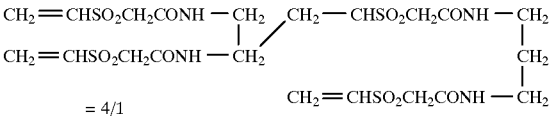

Compound F:

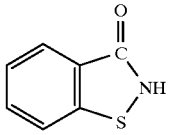

Compound G:

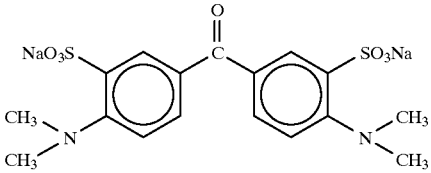

Solid-dispersed dye $G_1$:

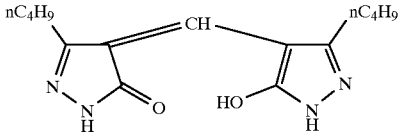

Compound H:

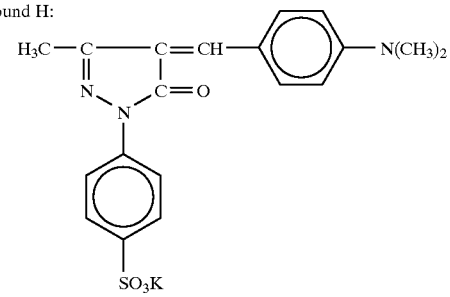

Compound I:

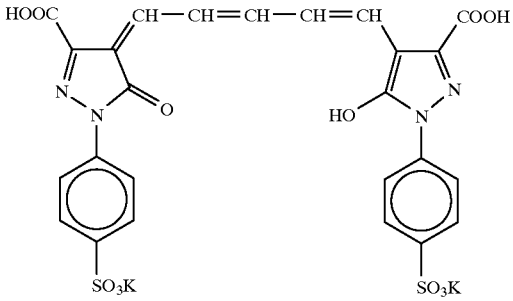

Compound J:

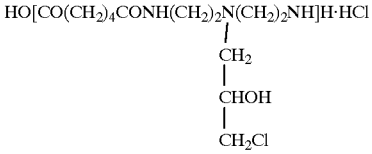

-continued

Core-shell type vinylidene chloride copolymer (1):

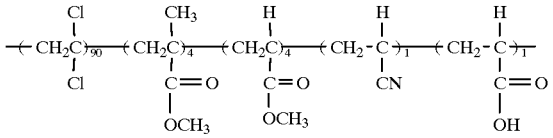

Core: VDC/MMA/MA (80% by weight)
Shell: VDC/AN/AA (20% by weight)
Average particle size: 70nm The coating and drying were effected under the following conditions:

<Coating method>

To the emulsion layer side of the above described undercoated support were simultaneously applied the emulsion layer, the lower emulsion protective layer and the upper emulsion protective layer in this order from the support at a temperature of 35° C. while a hardening agent solution was being supplied by a slide hopper process. The coated material was then passed through a cold air set zone (5° C.). To the other side of the above described undercoated support were then simultaneously applied the electrically-conductive layer and the back layer in this order from the support while a hardening agent solution was being supplied by a slide hopper process. The coated material was then passed through a cold air set zone (5° C.). When the coated material was passed through these set zones, the coating solutions exhibited sufficient settability. Subsequently, the both sides of the coated material were simultaneously dried in a drying zone under the following drying conditions. After the application to the back layer side of the support, the coated material was carried without being in contact with rollers and other members until being wound. The coating speed during this process was 120 m/min.

<Drying condition>

The coated material which had been thus set was dried by a 30° C. drying air until the water/gelatin weight ratio reached 800%. The coated material was then dried by a 35° C.-30% drying air until the water/gelatin weight ratio reached 200%. The coated material was then kept blown by the drying air. When the surface temperature of the coated material reached 34° C., it was considered completion of drying. After 30 seconds from the completion, the coated material was dried by a 48° C.-2% air for 1 minute. After all, the drying was effected for 50 seconds between the beginning of drying and the time at which the water/gelatin ratio reached 800%, for 35 seconds until the water/gelatin ratio reached 200% and for 5 seconds until the drying was completed.

The photographic light-sensitive material thus obtained was wound and slit at 23° C. and 40% RH, moisture-conditioned at 40° C. and 10% RH for 8 hours in a barrier bag which had been moisture-conditioned for 6 hours, and then enclosed with a cardboard which had been moisture-conditioned at 23° C. and 40% RH for 2 hours to prepare a specimen.

The humidity in the barrier bag was measured. The result was 40%.

Thus specimens as shown in Table 2-4 were prepared.

TABLE 2-4

| Specimen No. | Nucleation accelerator | Hydrazine compound | Way of Addition |
|---|---|---|---|
| 2-1' | Comparative Compound 1' | 54' | Methanol solution |
| 2-2' | Comparative Compound 1' | K-6' | Solid dispersion |
| 2-3' | Comparative Compound 2' | 54' | Methanol solution |
| 2-4' | Comparative Compound 2' | K-6' | Solid dispersion |
| 2-5' | B-14 | K-6' | Methanol solution |
| 2-6' | B-14 | K-6' | Solid dispersion |
| 2-7' | B-12 | K-6' | Solid dispersion |
| 2-8' | B-13 | K-6' | Solid dispersion |
| 2-9' | B-1 | K-6' | Solid dispersion |
| 2-10' | B-7 | K-6' | Solid dispersion |
| 2-11' | B-14 | K-4' | Solid dispersion |
| 2-12' | B-14 | K-5' | Solid dispersion |

(The hydrazine compound added in the form of solid dispersion was prepared in Example 2-1)

<Evaluation>

The above described specimen was exposed to light in a printer P-627FM available from Dainippon Screen Mfg. Co., Ltd. through a stepwedge. The specimen thus exposed was developed with Developers A or B set forth in Example 2-2 by means of an automatic developing machine FG-680AG available from Fuji Photo Film Co., Ltd. at a temperature of 35° C. for 20 seconds, fixed (in the same manner as in Example 2-2), rinsed, and then dried. The replenishment rate of the developer and the fixing solution during processing were each 100 ml per $m^2$.

The specimen was then evaluated for contrast, original reproducibility and aging stability of hydrazide compound in the light-sensitive material in the same manner as in Example 2-2.

The results are shown in Table 2-5.

TABLE 2-5

| Specimen No. | Developer | γ | Residue (%) of hydrazide compound | Remarks |
|---|---|---|---|---|
| 2-1' | A | 9 | 49 | Comparative |
| 2-2' | A | 7 | 56 | Comparative |
| 2-3' | A | 10 | 44 | Comparative |
| 2-4' | A | 9 | 49 | Comparative |
| 2-5' | A | 22 | 58 | Comparative |
| 2-6' | A | 21 | 91 | Inventive |
| 2-7' | A | 20 | 92 | Inventive |
| 2-8' | A | 21 | 90 | Inventive |
| 2-9' | A | 20 | 93 | Inventive |
| 2-10' | A | 19 | 93 | Inventive |
| 2-11' | A | 19 | 90 | Inventive |
| 2-12' | A | 20 | 91 | Inventive |
| 2-1' | B | 7 | 49 | Comparative |
| 2-2' | B | 7 | 56 | Comparative |
| 2-3' | B | 8 | 44 | Comparative |
| 2-4' | B | 7 | 49 | Comparative |
| 2-5' | B | 23 | 58 | Comparative |
| 2-6' | B | 22 | 91 | Inventive |
| 2-7' | B | 21 | 92 | Inventive |
| 2-8' | B | 22 | 90 | Inventive |
| 2-9' | B | 22 | 93 | Inventive |
| 2-10' | B | 21 | 93 | Inventive |

TABLE 2-5-continued

| Specimen No. | Developer | γ | Residue (%) of hydrazide compound | Remarks |
|---|---|---|---|---|
| 2-11' | B | 21 | 90 | Inventive |
| 2-12' | B | 21 | 91 | Inventive |

<Results>

Similarly to Example 2-2, only the combinations of the present invention could provide light-sensitive materials for dot to dot work in a bright room, which exhibit an ultrahigh contrast and an excellent original reproducibility with a low pH developer and an excellent storage stability. The use of Developer B, which comprises erythorbic acid as a developing agent, provided a higher effect.

EXAMPLE 2-7

Even when Developers A and B or the fixing solution A which had been stored in solid form was diluted with water prior to use in Examples 2-2 to 2-6, only the combinations of the present invention could provide photographic light-sensitive materials which exhibit an ultrahigh contrast and an excellent original reproducibility with a low pH developer and an excellent storage stability.

EXAMPLE 3-1

<Preparation of solid dispersion of hydrazide compound>

A 25% aqueous solution of Demol SNB (available from Kao Corp.) was prepared. To 1 g of the hydrazine compound shown in Table 3-1 were added 1.2 g of the above described aqueous solution of Demol SNB and 59 g of water. The mixture was then stirred to make a slurry. The slurry was then subjected to dispersion in a dispersing machine (1/16 gallon; sand grinder mill, available from Aimex Co., Ltd.) with 200 g of glass beads having a diameter of from 0.8 to 1.2 mm as a medium for 10 hours. An aqueous solution of gelatin was then added to the dispersion in such an amount that the concentration of the hydrazine compound and the gelatin reached 1% and 5%, respectively. Proxel as an antiseptic was then added to the dispersion in an amount of 2,000 ppm based on gelatin. Finally, an ascorbic acid was then added to the dispersion so that the pH value of the dispersion was adjusted to 5.0.

TABLE 3-1

| Solid dispersion No. | Hydrazine compound | Average particle size (μm) |
|---|---|---|
| K-1" | 1b' | 0.38 |
| K-2" | 2b' | 0.36 |
| K-3" | 3d' | 0.42 |
| K-4" | 10e' | 0.35 |
| K-5" | 22e' | 0.39 |
| K-6" | 54' | 0.38 |

EXAMPLE 3-2

<Preparation of silver halide photographic material>

Preparation of emulsion A

An aqueous solution of silver nitrate and an aqueous solution of halide containing potassium bromide, sodium chloride, $K_3IrCl_6$ in an amount of $3.5\times10^{-7}$ mol per mol of silver and $K_2Rh(H_2O)Cl_5$ in an amount of $2.0\times10^{-7}$ mol per mol of silver were added to an aqueous solution of gelatin containing sodium chloride and 1,3-dimethyl-2-imidazolidinethione by a double jet process with stirring to prepare a particulate silver bromochloride having an average particle size of 0.25 μm and a silver chloride content of 70 mol %.

The emulsion was then rinsed by an ordinary flocculation method. To the emulsion was then added gelatin in an amount of 40 g per mol of silver. To the emulsion were then added sodium benzenethiosulfonate and benzenesulfinic acid in an amount of 7 mg and 2 mg per mol of silver, respectively. The pH value and pAg value of the emulsion were then adjusted to 6.0 and 7.5, respectively. To the emulsion were then added sodium thiosulfate, chloroauric acid and the sensitizer shown in Table 3-2 in an amount of 1 mg, 4 mg and 1 mg per mol of silver, respectively. The emulsion was then subjected to a chemical sensitization at a temperature of 60° C. so that the optimum sensitivity was obtained. 150 mg of 4-hydroxy-6-methyl-1,3,3a,7-tetrazaindene as a stabilizer and 100 mg of proxel as an antiseptic were added to the system. As a result, an emulsion of cubic silver bromochloride grains having an average size of 0.25 μm and a silver chloride content of 70 mol % was obtained (fluctuation coefficient: 10%).

Preparation of coating specimen

To a polyethylene terephthalate film support having a moistureproof undercoating layer containing vinylidene chloride were applied sequentially a UL layer, an EM layer, a PC layer and an OC layer to prepare a specimen.

The preparation method and the coated amount of the components of the layers is described below.

(UL layer)

To an aqueous solution of gelatin was added a polyethylacrylate dispersion in an amount of 30% by weight based on gelatin. The coating solution thus obtained was applied to the support in such an amount that the coated amount of gelatin reached 0.5 g/m$^2$.

(EM layer)

To Emulsion A was added the following compounds (S-1) and (S-2) as sensitizing dyes in an amount of $5\times10^{-4}$ mol and $5\times10^{-4}$ mol per mol of silver, respectively. To the emulsion were then added a mercapto compound represented by the following general formula (a) in an amount of $3\times10^{-4}$ mol per mol of silver, a mercapto compound represented by the following general formula (b) in an amount of $4\times10^{-4}$ mol per mol of silver, a triazine compound represented by the following general formula (c) in an amount of $4\times10^{-4}$ mol per mol of silver, 5-chloro-8-hydroxyquinoline in an amount of $2\times10^{-3}$ mol per mol of silver, the nucleation accelerator shown in Table 3-2 in an amount of $5.0\times10^{-4}$ mol per mol of silver, and a surface active agent represented by formula (p) below in an amount of $5\times10^{-4}$ mol per mol of silver. To the emulsion were then added hydroquinone and N-oleyl-N-methyltaurine sodium salt in such an amount that the coated amount reached 100 mg/m$^2$ and 30 mg/m$^2$, respectively. To the emulsion was then added the solid dispersion of hydrazide compound prepared in Example 3-1 or a methanol solution of hydrazide compound as a nucleating agent in an amount of $5\times10^{-4}$ mol/Ag-mol as calculated in terms of hydrazide compound in the manner as shown in Table 3-2. To the emulsion were then added 200 mg/m$^2$ of a water-soluble latex represented by the following formula (d), 200 mg/m$^2$ of a polyethyl acrylate dispersion, 200 mg/m$^2$ of a latex copolymer of methyl acrylate, sodium 2-acrylamido-2-methylpropanesylfonate and 2-acetoacetoxyethyl methacrylate (88:5:7 by weight), 200 mg/m$^2$ of colloidal silica having an average particle diameter of 0.02 $\mu$m, 200 mg/m$^2$ of 1,3-divinylsulfonyl-2-propanol as a hardening agent, and 30 mg/m$^2$ of sodium polystyrenesulfonate as a thickener. The pH value of the solution was adjusted with acetic acid to 5.50. The coating solution thus obtained was then applied to a support in such an amount that the coated amount of silver reached 2.4 g/m$^2$.

TABLE 3-2

| Specimen No. | Sensitizer | Hydrazine compound | Way of Addition |
|---|---|---|---|
| 1-1" | — | 2b' | Methanol solution |
| 1-2" | — | K-2' | Solid dispersion |
| 1-3" | S-21 | 2b' | Methanol solution |
| 1-4" | S-21 | K-2' | Solid dispersion |
| 1-5" | T-24 | 2b' | Methanol solution |
| 1-6" | T-24 | K-2' | Solid dispersion |
| 1-7" | S-21 | K-1' | Solid dispersion |
| 1-8" | S-21 | K-3' | Solid dispersion |

(The hydrazine compound added in the form of solid dispersion was prepared in Example 3-1)

(PC layer)

To an aqueous solution of gelatin were added an ethyl acrylate dispersion in an amount of 50% by weight based on gelatin, the surface active agent (w) shown below in an amount of 5 mg/m$^2$, and 1,5-dihydroxy-2-benzaldoxim in an amount of 10 mg/m$^2$. The coating solution thus prepared was then applied in such an amount that the coated amount of gelatin reached 0.5 g/m$^2$.

(OC layer)

Gelatin, an amorphous $SiO_2$ matting agent having an average grain size of about 3.5 $\mu$m, methanol silica, a polyacrylamide, and a silicone oil were applied in an amount of 0.5 g/m$^2$, 40 mg/m$^2$, 0.1 g/m$^2$, 100 mg/m$^2$ and 20 mg/m$^2$, respectively. As coating aids there were applied the fluorine surface active agent represented by formula (e) shown below and sodium dodecylbenzenesulfonate in an amount of 5 mg/m$^2$ and 100 mg/m$^2$, respectively.

(S-1)

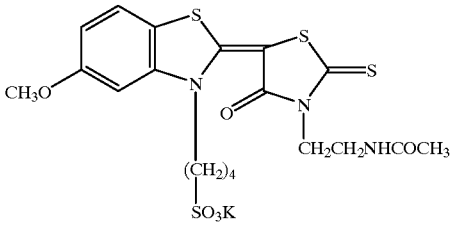

(S-2)

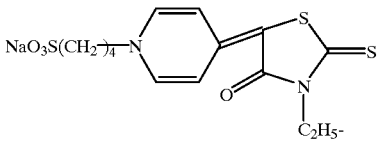

-continued (a)

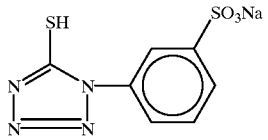

(b)

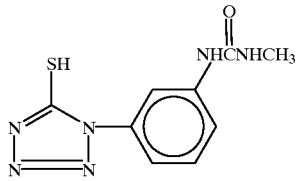

(c)

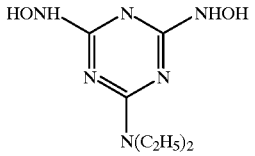

(A)

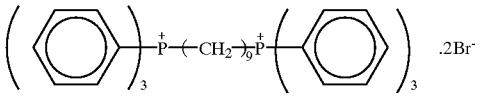

(p)

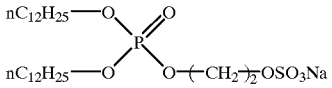

(d)

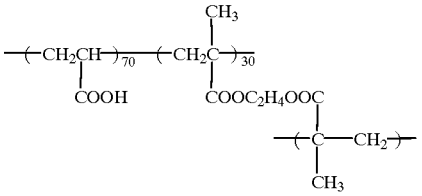

(e)

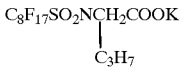

(w)

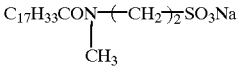

These coated specimens had a back layer and a back protective layer having the following composition:

(Back layer)

| | | |
|---|---|---|
| Gelatin | 3 | g/m$^2$ |
| Latex: Polyethyl acrylate | 2 | g/m$^2$ |
| Surface active agent: | | |
| Sodium p-dodecylbenzenesulfonate | 40 | mg/m$^2$ |
| $CH_2{=}CHSO_2CH_2CONH$ — $(CH_2)_2$ — $CH_2{=}CHSO_2CH_2CONH$ | 110 | mg/m$^2$ |
| $SnO_2$/Sb (weight ratio: 90/10; | 200 | mg/m$^2$ |

-continued

| | | |
|---|---|---|
| average grain diameter: 0.20 μm) | | |
| Dye: Mixture of Dye (a), Dye (b) and Dye (c) | | |
| Dye (a) | 70 | mg/m$^2$ |
| Dye (b) | 70 | mg/m$^2$ |
| Dye (c) | 90 | mg/m$^2$ |

Dye (a)

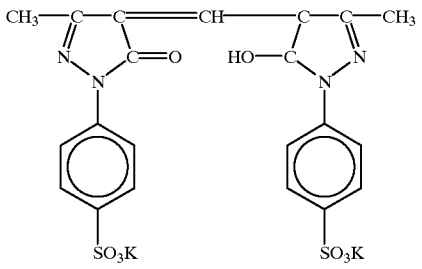

Dye (b)

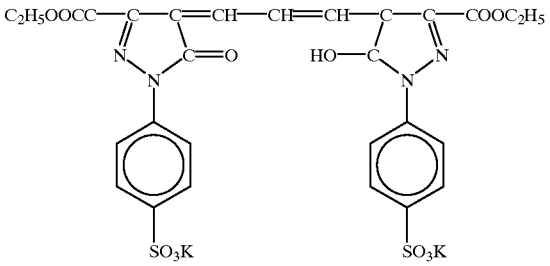

Dye (c)

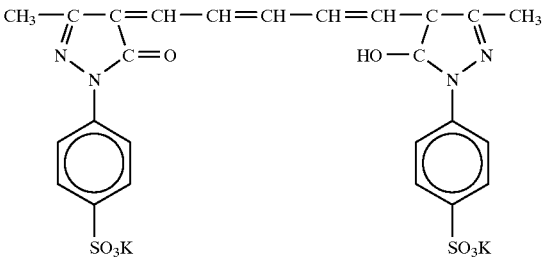

(Back protective layer)

| | |
|---|---|
| Gelatin | 0.8 mg/m$^2$ |
| Particulate polymethyl methacrylate (average grain diameter: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

<Preparation of developer>

Developers A and B having the following compositions were prepared.

<Developer A>

| | | |
|---|---|---|
| Potassium hydroxide | 40.0 | g |
| Diethylenetriaminepentaacetic acid | 2.0 | g |
| Potassium carbonate | 60.0 | g |
| Sodium metabisulfite | 70.0 | g |
| Potassium bromide | 7.0 | g |
| Hydroquinone | 40.0 | g |
| 5-Methylbenzotriazole | 0.35 | g |
| 4-Hydroxymethyl-4-methyl-1-phenyl-3-pyrazolidone | 1.50 | g |
| Sodium 2-mercaptobenzimidazole-5-sulfonate | 0.30 | g |
| Sodium 3-(5-mercaptotetrazole-1-il) benzenesulfonate | 0.10 | g |
| Sodium erythorbate | 6.0 | g |
| Diethylene glycol | 5.0 | g |
| Potassium hydroxide to make pH | 10.65 | |
| Water to make | 1 | l |

<Developer B>

| | | |
|---|---|---|
| Sodium hydroxide | 1.71 | g |
| Diethylenetriaminepentaacetic acid | 4 | g |
| Potassium carbonate | 55 | g |
| Sodium metabisulfite | 51 | g |
| Sodium erythorbate | 45 | g |
| N-methyl-p-aminophenol | 7.5 | g |
| KBr | 2 | g |
| 5-Methylbenzotriazole | 0.1 | g |
| 1-Phenyl-5-mercaptotetrazole | 0.02 | g |
| Sodium sulfite | 5 | g |
| Glacial acetic acid | 9 | g |
| Water to make | 1 | l |
| pH | 9.7 | |

<Evaluation>

(1) Exposure and development

The above described specimen was exposed to light from a xenon flash lamp having an emission time of $10^{-5}$ sec. through an interference filter having a peak at 488 nm and a stepwedge, developed with Developers A or B by means of an automatic developing machine FG-680AG available from Fuji Photo Film Co., Ltd. at 35° C. for 20 seconds, fixed, rinsed, and then dried. The replenishment rate of the developer and the fixing solution during processing were each 100 ml per m$^2$.

As the fixing solution there was used the fixing solution A having the following formulation.

<Fixing solution A>

| | | |
|---|---|---|
| Ammonium thiosulfate | 119.7 | g |
| Disodium ethylenediamine-tetraacetate dihydrate | 0.03 | g |
| Sodium thiosulfate pentahydrate | 10.9 | g |
| Sodium sulfite | 25.0 | g |
| NaOH (pure content) | 12.4 | g |
| Glacial acetic acid | 29.1 | g |
| Tartaric acid | 2.92 | g |
| Sodium gluconate | 1.74 | g |
| Aluminum sulfate | 8.4 | g |
| pH adjusted with sulfuric acid or sodium hydroxide to | 4.8 | |
| Water to make | 1 | l |

(2) Contrast

For the evaluation of the index representing the image contrast (γ), the inclination of the straight line between the point of (fog+density 0.1) and the point of (fog+density 3.0) on the characteristic curve was determined. In other words, γ is represented by (3.0–0.1)/(log(exposure amount giving a density of 3.0)− (exposure amount giving a density of 0.1)). The more γ value is, the higher is the contrast.

(3) Photographic sensitivity

The sensitivity is represented by the reciprocal of the exposure giving an exposure of 1.5. The sensitivity of the various specimens were calculated as $S_{1.5}$ relative to that of reference specimen as 100. The more this value is, the higher is the sensitivity.

(4) Black pepper

The unexposed specimen was developed in the same manner as described above, except that the development time was changed to 40 seconds. The developed specimen was then observed under a microscope. The results were evaluated in accordance with the following 5-step criterion.

The level "5" indicates the generation of no black pepper and the best. The level "1" indicates the generation of remarkable black pepper and the worst. The step "3" indicates a practically acceptable limit level.

(5) Aging stability of photographic light-sensitive material

The photographic light-sensitive material was stored at a temperature of 60° C. and a humidity of 65% for 3 days. The photographic light-sensitive material thus aged was then developed with Developer A in the manner as described above. The photographic light-sensitive material was then measured for sensitivity. The change of photographic properties between the above described aged photographic light-sensitive material and the photographic light-sensitive material which was stored at ordinary temperature and humidity for 3 days was represented by the following equation:

Sensitivity change with time ($\Delta S_{1.5}$)=$S_{1.5}$ (specimen which was stored at 60° C.-65% RH for 3 days)−$S_{1.5}$ (specimen which was stored at ordinary temperature and humidity for 3 days)

The closer to zero this value is, the higher is the aging stability of the photographic light-sensitive material.

The results obtained are shown in Table 3-3.

TABLE 3-3

| Specimen No. | Developer | γ | Black pepper | Sensitivity change ($\Delta S_{1.5}$) | Remarks |
|---|---|---|---|---|---|
| 1-1" | A | 10 | 4 | 0.14 | Compara. |
| 1-2" | A | 8 | 4 | 0.09 | Compara. |
| 1-3" | A | 17 | 2 | 0.31 | Compara. |
| 1-4" | A | 15 | 3 | 0.06 | Invent. |
| 1-5" | A | 17 | 2 | 0.34 | Compara. |
| 1-6" | A | 16 | 3 | 0.05 | Invent. |
| 1-7" | A | 16 | 3 | 0.04 | Invent. |
| 1-8" | A | 17 | 3 | 0.04 | Invent. |
| 1-1" | B | 9 | 4 | 0.12 | Compara. |
| 1-2" | B | 7 | 4 | 0.07 | Compara. |
| 1-3" | B | 19 | 2 | 0.32 | Compara. |
| 1-4" | B | 17 | 5 | 0.05 | Invent. |
| 1-5" | B | 18 | 2 | 0.35 | Compara. |
| 1-6" | B | 17 | 4 | 0.04 | Invent. |
| 1-7" | B | 18 | 5 | 0.03 | Invent. |
| 1-8" | B | 19 | 4 | 0.04 | Invent. |

Only the combinations of the present invention could provide scanner light-sensitive materials for argon laser which exhibit an ultrahigh contrast and little black pepper with a low pH developer and an excellent storage stability. The use of Developer B, which comprises erythorbic acid as a developing agent, provided a higher effect.

EXAMPLE 3-3

<Preparation of silver halide photographic material>

Preparation of emulsion

A specimen was prepared in the same manner as in Example 3-2, except that the following compound (S-3) was added in an amount of $2.1\times10^{-4}$ mol per mol of silver instead of the sensitizing dye to be incorporated in EM layer.

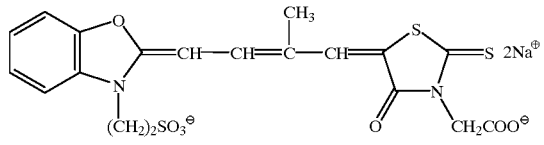

<Evaluation>

(1) Exposure and development

The above described specimen was exposed to light from a xenon flash lamp having an emission time of $10^{-6}$ sec. through an interference filter having a peak at 633 nm and a stepwedge. The specimen thus exposed was developed with Developer A or B set forth in Example 3-2 by means of an automatic developing machine FG-680AG available from Fuji Photo Film Co., Ltd. at a temperature of 35° C. for 20 seconds, fixed (in the same manner as in Example 3-2), rinsed, and then dried. The replenishment rate of the developer and the fixing solution during processing were each 100 ml per $m^2$.

The specimen was then evaluated for contrast, black pepper and aging stability of the light-sensitive material in the same manner as in Example 3-2.

<Results>

Similarly to Example 3-2, only the combinations of the present invention could provide scanner light-sensitive materials for helium neon laser which exhibit an ultrahigh contrast and little black pepper with a low pH developer and an excellent storage stability. The use of Developer B, which comprises erythorbic acid as a developing agent, provided a higher effect.

EXAMPLE 3-4

<Preparation of silver halide photographic material>

A specimen was prepared in the same manner as in Example 3-2, except that the sensitizing dye to be incorporated in EM layer was changed to the following compound (S-4).

(S-4):

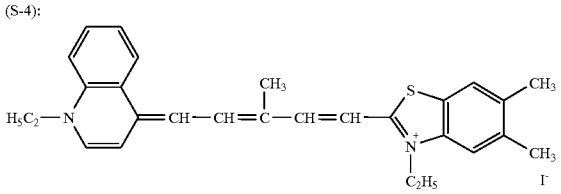

<Evaluation>

The above described specimen was exposed to light from a xenon flash lamp having an emission time of $10^{-6}$ sec. through an interference filter having a peak at 780 nm and a stepwedge. The specimen thus exposed was developed with Developers A or B set forth in Example 3-2 by means of an automatic developing machine FG-680AG available from Fuji Photo Film Co., Ltd. at a temperature of 35° C. for 20 seconds, fixed (in the same manner as in Example 3-2), rinsed, and then dried. The replenishment rate of the developer and the fixing solution during processing were each 100 ml per $m^2$.

The specimen was then evaluated for contrast, black pepper and aging stability of the light-sensitive material in the same manner as in Example 3-2.

<Results>

Similarly to Example 3-2, only the combinations of the present invention could provide scanner light-sensitive materials for semiconductor laser which exhibit an ultrahigh contrast and little black paper with a low pH developer and an excellent storage stability. The use of Developer B, which comprises erythorbic acid as a developing agent, provided a higher effect.

EXAMPLE 3-5

<Preparation of silver halide photographic material>

A specimen was prepared in the same manner as in Example 3-2, except that the sensitizing dye to be incorporated in EM layer was changed to the following compound (S-5).

(S-5):

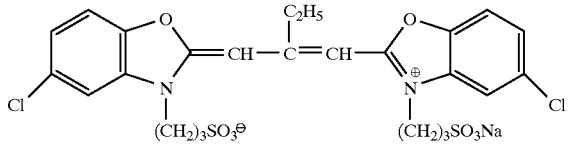

<Evaluation>

The above described specimen was exposed to light from a 3200° K. tungsten lamp through a stepwedge. The specimen thus exposed was developed with Developer A or B set forth in Example 3-2 by means of an automatic developing machine FG-680AG available from Fuji Photo Film Co., Ltd. at a temperature of 35° C. for 20 seconds, fixed (in the same manner as in Example 3-2), rinsed, and then dried. The replenishment rate of the developer and the fixing solution during processing were each 100 ml per $m^2$.

The specimen was then evaluated for contrast, black pepper and aging stability of the light-sensitive material in the same manner as in Example 3-2.

<Results>

Similarly to Example 3-2, only the combinations of the present invention could provide light-sensitive materials for camera work which exhibit an ultrahigh contrast and little black pepper with a low pH developer and an excellent storage stability. The use of Developer B, which comprises erythorbic acid as a developing agent, provided a higher effect.

EXAMPLE 3-6

<Preparation of silver halide photographic material>

Preparation of Emulsion C

To a 1.5% aqueous solution of gelatin having pH 2.0 containing sodium chloride and 4-hydroxy-6-methyl-1,3,3a,7-tetraazaindene in an amount of $5\times10^{-3}$ mol per mol of silver which had been kept at 38° C. was added an aqueous solution of silver nitrate and an aqueous solution of sodium chloride containing $K_2Ru(NO)Cl_5$ in an amount of $5\times10^{-5}$ mol per mol of silver by a double jet process at a potential of 95 mV in such a manner that half of the amount of silver required for the formation of final grains was reached over 3 minutes and 30 seconds. Thus, cores having a grain size of 0.12 $\mu$m were prepared. Thereafter, to the emulsion were then added an aqueous solution of silver nitrate and an aqueous solution of sodium chloride containing $K_2Ru(NO)Cl_5$ in an amount of $5\times10^{-5}$ mol per mol of silver over 7 minutes in the same manner as above to prepare an emulsion of cubic grains of silver chloride having an average grain size of 0.13 $\mu$m (fluctuation coefficient: 12%).

The emulsion was then rinsed by a flocculation method well known in the art to remove soluble salts therefrom. To the emulsion was then added gelatin. To the emulsion were then added compound F and phenoxyethanol as preservatives in an amount of 60 mg per mol of silver each. The emulsion-was then adjusted to pH 5.5 and pAg 7.5. To the emulsion were then added chloroauric acid, the sensitizer shown in Table 3-4 and sodium thiosulfate in an amount of $4\times10^{-5}$ mol, $1\times10^{-5}$ mol and $1\times10^{-5}$ mol per mol of silver, respectively. The emulsion was then heated to a temperature of 60° C. for 60 minutes to undergo chemical sensitization. To the emulsion was then added 4-hydroxy-6-methyl-1,3,3a,7-tetraazaindene as a stabilizer in an amount of $1\times10^{-3}$ mol per mol of silver. (The final grains exhibited a pH value of 5.7, a pAg value of 7.5 and an Ru content of $5\times10^{-5}$ mol/mol Ag.)

(F):

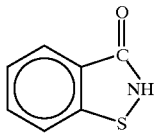

Preparation of coated specimen (Silver halide emulsion layer)

To Emulsion C were then added the following compounds. The coating solution thus obtained was then applied to a support comprising an undercoating layer described below in such an amount that the coated amount of gelatin and silver reached 0.9 g/$m^2$ and 2.75 g/$m^2$, respectively, to form a silver halide emulsion layer thereon.

| | |
|---|---|
| N-oleyl-N-methyltaurin sodium salt | 19 mg/$m^2$ |
| Solid dispersion of hydrazide compound shown in Table 3-4 prepared in Example 3-1 or methanol solution of hydrazide compound (calculated in terms of hydrazide compound) | 15 mg/$m^2$ |
| Nucleation accelerator Z shown below | 20 mg/$m^2$ |
| Sodium 3-(5-Mercaptotetrazole)-benzenesulfonate | 11 mg/$m^2$ |
| Compound A | 13 mg/$m^2$ |
| Ascorbic acid | 1 mg/$m^2$ |
| Compound B | 15 mg/$m^2$ |
| Compound C | 70 mg/$m^2$ |
| Acetic acid to make film pH | 5.2–6.0 |
| Compound D | 950 mg/$m^2$ |
| Liboran-1400 (available from Lion Corp.) | 47 mg/$m^2$ |
| Compound E (hardening agent) to make percent swell with water | 80% |

The following lower emulsion protective layer and the upper emulsion protective layer were applied onto the above described emulsion layer.

(Lower emulsion protective layer)

To an aqueous solution of gelatin were added the following compounds. The coating solution thus obtained was then applied to the emulsion layer in such an amount that the coated amount of gelatin reached 0.8 g/m$^2$.

| | | |
|---|---|---|
| Gelatin ($Ca^{++}$ content: 2,700 ppm) | 0.8 | g/m$^2$ |
| Compound F | 1 | mg/m$^2$ |
| 1,5-Dihydroxy-2-benzaldoxim | 14 | mg/m$^2$ |
| $C_2H_5SO_2SNa$ | 3 | mg/m$^2$ |
| Compound C | 3 | mg/m$^2$ |
| Sodium p-dodecylbenzenesulfonate | 7 | mg/m$^2$ |

(Preparation and coating of upper emulsion protective layer coating solution)

To an aqueous solution of gelatin were added the following compounds. The coating solution thus obtained was then applied to the emulsion layer in such an amount that the coated amount of gelatin reached 0.45 g/m$^2$.

| | | |
|---|---|---|
| Gelatin ($Ca^{++}$ content: 2,700 ppm) | 0.45 | g/m$^2$ |
| Amorphous silica matting agent (average grain diameter: 4.4 $\mu$m) | 40 | mg/m$^2$ |
| Amorphous silica matting agent (average grain diameter: 3.6 $\mu$m) | 10 | mg/m$^2$ |
| Compound F | 1 | mg/m$^2$ |
| Compound C | 8 | mg/m$^2$ |
| Solid-dispersed dye $G_1$ | 68 | mg/m$^2$ |
| Liquid paraffin | 21 | mg/m$^2$ |
| N-perfluorooctanesulfonyl-N-propylglycin potassium | 5 | mg/m$^2$ |
| Sodium p-dodecylbenzenesulfonate | 29 | mg/m$^2$ |

To the other side of the support were then applied the following electrically-conductive layer and back layer.

(Electrically-conductive layer)

To an aqueous solution were added the following compounds. The coating solution thus obtained was then applied to the support in such an amount that the coated amount of gelatin reached 0.06 g/m$^2$.

| | | |
|---|---|---|
| $SnO_2$/Sb (9/1 by weight; average grain diameter: 0.25 $\mu$m) | 186 | mg/m$^2$ |
| Gelatin ($Ca^{++}$ content: 2,700 ppm) | 0.06 | g/m$^2$ |
| Sodium p-dodecylbenzenesulfonate | 13 | mg/m$^2$ |
| Sodium dihexyl-α-sulfosuccinate | 12 | mg/m$^2$ |
| Compound C | 12 | mg/m$^2$ |
| Compound F | 1 | mg/m$^2$ |

(Back layer)

To an aqueous solution were added the following compounds. The coating solution thus obtained was then applied to the support in such an amount that the coated amount of gelatin reached 1.94 g/m$^2$.

| | | |
|---|---|---|
| Gelatin ($Ca^{++}$ content: 30 ppm) | 1.94 | g/m$^2$ |
| Particulate polymethyl methacrylate average grain diameter: 4.7 $\mu$m) | 7 | mg/m$^2$ |
| Compound H | 233 | mg/m$^2$ |
| Compound I | 21 | mg/m$^2$ |
| Compound G | 146 | mg/m$^2$ |
| Compound F | 3 | mg/m$^2$ |
| Sodium p-dodecylbenzenesulfonate | 68 | mg/m$^2$ |
| Sodium dihexyl-α-sulfosuccinate | 21 | mg/m$^2$ |
| $C_8F_{17}SO_3Li$ | 4 | mg/m$^2$ |
| N-perfluorooctanesulfonyl-N-propylglycin potassium | 6 | mg/m$^2$ |
| Sodium sulfate | 177 | mg/m$^2$ |
| Compound E (hardening agent) to make percent swelling with water | 90% | |

(Support, undercoating layer)

A first undercoating layer and a second undercoating layer having the following formulations were applied to both sides of a biaxially-oriented polyethylene terephthalate support (thickness: 100 $\mu$m).

(First undercoating layer)

| | |
|---|---|
| Core-shell type vinylidene chloride copolymer (1) | 15 g |
| 2,4-Dichloro-6-hydroxy-s-triazine | 0.25 g |
| Particulate polystyrene (average grain diameter: 3 $\mu$m) | 0.05 g |
| Colloidal silica (Snowtex ZL; grain diameter: 70 to 100 $\mu$m; available from Nissan Chemical Industries, Ltd.) | 0.12 g |
| Water to make | 100 g |

To the solution was then added a 10 wt % KOH to adjust the pH value thereof to 6. The coating solution was then applied to the support in such an amount that the dry thickness (dried at 180° C. for 2 minutes) reached 0.9 $\mu$m.

(Second undercoating layer)

| | |
|---|---|
| Gelatin | 1 g |
| Methyl cellulose | 0.05 g |
| Compound J | 0.02 g |
| $C_{12}H_{25}O(CH_2CH_2O)_{10}H$ | 0.03 g |
| Compound F | $3.5 \times 10^{-3}$ g |
| Acetic acid | 0.2 g |
| Water to make | 100 g |

The coating solution thus obtained was then applied to the support in such an amount that the dry thickness (dried at 170° C. for 2 minutes) reached 0.1 $\mu$m to prepare an undercoated support.

Nucleation accelerator Z:

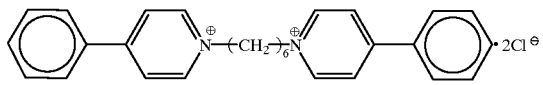

Compound A:

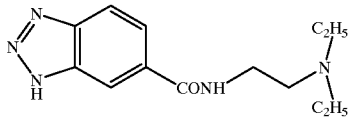

Compound B:

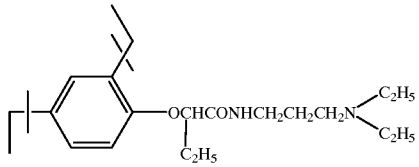

-continued

Compound C:

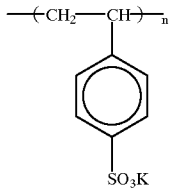

Compound D:

Core/shell = 50/50

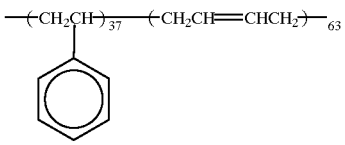

<Core portion: St/Bu = 37/63>

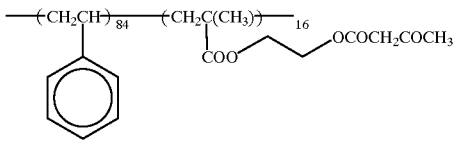

<Shell portion: St/AAEMA = 84/16>

Compound E:

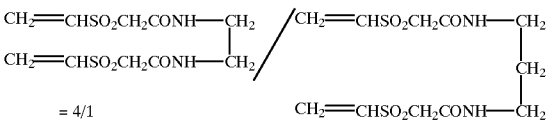

Compound F:

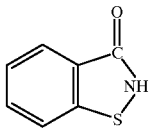

Compound G:

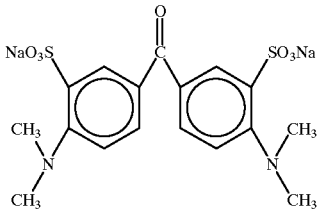

Solid-dispersed dye $G_1$:

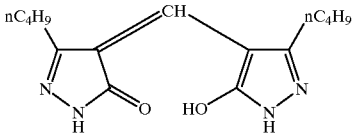

-continued

Compound H:

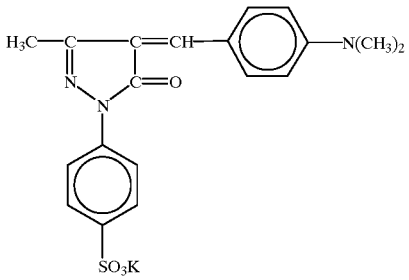

Compound I:

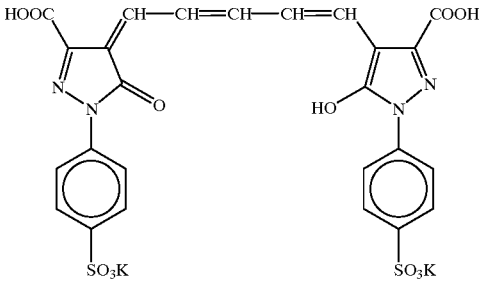

Compound J:

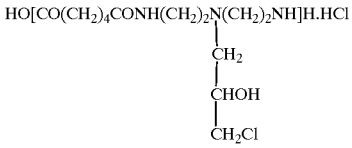

Core-shell type vinylidene chloride copolymer (1):

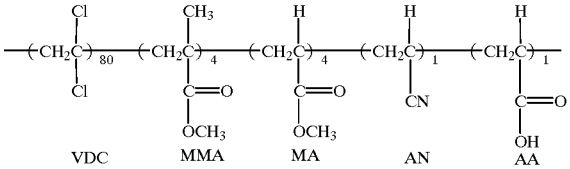

Core: VDC/MMA/MA (80% by weight)
Shell: VDC/AN/AA (20% by weight)
Average particle size: 70nm The coating and drying were effected under the following conditions:

<Coating method>

To the emulsion layer side of the above described undercoated support were simultaneously applied the emulsion layer, the lower emulsion protective layer and the upper emulsion protective layer in this order from the support at a temperature of 35° C. while a hardening agent solution was being supplied by a slide hopper process. The coated material was then passed through a cold air set zone (5° C.). To the other side of the above described undercoated support were then simultaneously applied the electrically-conductive layer and the back layer in this order from the support while a hardening agent solution was being supplied by a slide hopper process. The coated material was then passed through a cold air set zone (5° C.). When the coated material was passed through these set zones, the coating solutions exhibited sufficient settability. Subsequently, the both sides of the coated material were simultaneously dried in a drying zone under the following drying conditions. After the application to the back layer side of the support, the coated material was carried without being in contact with rollers and other members until being wound. The coating speed during this process was 120 m/min.

<Drying condition>

The coated material which had been thus set was dried by a 30° C. drying air until the water/gelatin weight ratio reached 800%. The coated material was then dried by a 35° C.-30% drying air until the water/gelatin weight ratio reached 200%. The coated material was then kept blown by the drying air. When the surface temperature of the coated material reached 34° C., it was considered completion of drying. After 30 seconds from the completion, the coated material was dried by a 48° C.-2% air for 1 minute. After all, the drying was effected for 50 seconds between the beginning of drying and the time at which the water/gelatin ratio reached 800%, for 35 seconds until the water/gelatin ratio reached 200% and for 5 seconds until the drying was completed.

The photographic light-sensitive material thus obtained was wound and slit at 23° C. and 40% RH, moisture-conditioned at 40° C. and 10% RH for 8 hours in a barrier bag which had been moisture-conditioned for 6 hours, and then enclosed with a cardboard which had been moisture-conditioned at 23° C. and 40% RH for 2 hours to prepare a specimen.

The humidity in the barrier bag was measured. The result was 40%.

Thus, specimens as shown in Table 3-4 were prepared.

TABLE 3-4

| Specimen No. | Sensitizer | Hydrazine compound | Way of Addition |
|---|---|---|---|
| 2-1" | — | 54' | Methanol solution |
| 2-2" | — | K-6' | Solid dispersion |
| 2-3" | S-15 | 54' | Methanol solution |
| 2-4" | S-15 | K-6' | Solid dispersion |
| 2-5" | T-6 | 54' | Methanol solution |
| 2-6" | T-6 | K-6' | Solid dispersion |
| 2-7" | S-15 | K-4' | Solid dispersion |
| 2-8" | S-15 | K-5' | Solid dispersion |

(The hydrazine compound added in the form of solid dispersion was prepared in Example 3-1)

<Evaluation>

The above described specimen was exposed to light in a printer P-627FM available from Dainippon Screen Mfg. Co., Ltd. through a stepwedge. The specimen thus exposed was developed with Developers A or B set forth in Example 3-2 by means of an automatic developing machine FG-680AG available from Fuji Photo Film Co., Ltd. at a temperature of 35° C. for 20 seconds, fixed (in the same manner as in Example 3-2), rinsed, and then dried. The replenishment rate of the developer and the fixing solution during processing were each 100 ml per $m^2$.

The specimen was then evaluated for contrast, black pepper and aging stability of the light-sensitive material in the same manner as in Example 3-2.

The results are shown in Table 3-5.

TABLE 3-5

| Specimen No. | Developer | γ | Black pepper | Sensitivity change ($\Delta S_{1.5}$) | Remarks |
|---|---|---|---|---|---|
| 2-1" | A | 9 | 5 | 0.12 | Compara. |
| 2-2" | A | 7 | 5 | 0.08 | Compara. |
| 2-3" | A | 17 | 3 | 0.25 | Compara. |
| 2-4" | A | 16 | 4 | 0.05 | Invent. |
| 2-5" | A | 18 | 3 | 0.27 | Compara. |
| 2-6" | A | 16 | 4 | 0.03 | Invent. |
| 2-7" | A | 16 | 4 | 0.02 | Invent. |
| 2-8" | A | 18 | 4 | 0.02 | Invent. |
| 2-1" | B | 7 | 5 | 0.11 | Compara. |
| 2-2" | B | 6 | 5 | 0.06 | Compara. |
| 2-3" | B | 20 | 3 | 0.27 | Compara. |
| 2-4" | B | 18 | 5 | 0.04 | Invent. |
| 2-5" | B | 22 | 3 | 0.28 | Compara. |
| 2-6" | B | 20 | 5 | 0.01 | Invent. |
| 2-7" | B | 23 | 5 | 0.01 | Invent. |
| 2-8" | B | 24 | 5 | 0.02 | Invent. |

<Results>

Similarly to Example 3-2, only the combinations of the present invention could provide light-sensitive materials which exhibit an ultrahigh contrast and little black pepper with a low pH developer and an excellent storage stability. The use of Developer B, which comprises erythorbic acid as a developing agent, provided a higher effect.

EXAMPLE 3-7

Even when Developers A and B or the fixing solution A which had been stored in solid form was diluted with water prior to use in Examples 3-2 to 3-6, only the combinations of the present invention could provide photographic light-sensitive sensitive materials which exhibit an ultrahigh contrast and little black pepper with a low pH developer and an excellent storage stability.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one photosensitive silver halide emulsion layer, wherein at least one of the silver halide emulsion layer and other hydrophilic colloid layers comprises at least one hydrazine compound which is present in an amount of $1\times10^{-6}$ to $1\times10^{-2}$ mol per mol of silver halide and which is represented by the following general formula (II) in the form of a fine solid dispersion:

$$A—(B)_m \quad \text{(II)}$$

wherein A represents a connecting group; B represents a group represented by the following general formula (III); and m represents an integer of from 2 to 6:

$$—(L_2—Ar_2)_n—L_1—Ar_1—NHNH—G_1—R_1 \quad \text{(III)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

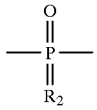

group, a —CO—CO— group, a thiocarbonyl group or an iminomethylene group; $R_2$ represents a group selected from those defined above as $R_1$, and may be different from $R_1$.

2. The silver halide photographic material of claim 1, wherein said at least one of the emulsion layer and other hydrophilic colloid layers comprises a nucleation accelerator.

3. The silver halide photographic material of claim 1, wherein the silver halide emulsion has a silver chloride content of not less than 50 mol %.

4. The silver halide photographic material of claim 1, wherein the silver halide emulsion layer comprises a chemically sensitized silver halide emulsion.

5. A processing process of a silver halide photographic material, which comprises the steps of:

imagewise exposing a silver halide photographic material; and developing the exposed silver halide photographic material with a developer;

wherein the developer has a pH value of from not less than 8.5 to less than 11.0, and wherein the silver halide photographic material comprises a support having thereon at least one photosensitive silver halide emulsion layer, wherein at least one of the silver halide emulsion layer and other hydrophilic colloid layers comprises at least one hydrazine compound which is present in an amount of $1\times10^{-6}$ to $1\times10^{-2}$ mol per mol of silver halide and which is represented by the following general formula (II) in the form of fine solid dispersion:

$$A—(B)_m \quad \text{(II)}$$

wherein A represents a connecting group; B represents a group represented by the following general formula (III); and m represents an integer of from 2 to 6:

$$—(L_2—Ar_2)_n—L_1—Ar_1—NHNH—G_1—R_1 \quad \text{(III)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

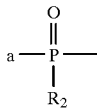

group, a —CO—CO— group, a thiocarbonyl group or an iminomethylene group; $R_2$ represents a group selected from those defined above as $R_1$, and may be different from $R_1$.

6. A processing process of a silver halide photographic material which comprises the steps of:

imagewise exposing a silver halide photographic material;

developing the exposed silver halide photographic material while replenishing a developer, wherein the developer is substantially free of dehydroxybenzene developing agents and contains a developing agent represented by the following general formula (1):

(1)

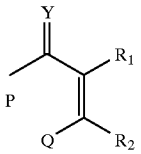

wherein $R_1$ and $R_2$ each represents a hydroxyl group, an amino group, an acylamino group, a alkylsulfonylamino group, an arylsulfonylamino group, an alkoxycarbonylamino group, a mercapto group or an alkylthio group; P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group or a mercapto group, or P and Q represent atomic groups which are connected to each other to form a 5- to 7-membered ring with the two vinyl carbon atoms on which $R_1$ and $R_2$ substitute and the carbon atom on which Y substitutes; and Y represents =O or =N-$R_3$ wherein $R_3$ represents a hydrogen atom, a hydroxyl group, an alkyl group, an acyl group, a hydroxyalkyl group, a sulfoalkyl group or a carboxyalkyl group, and wherein the silver halide photographic material comprises a support having thereon at least one photosensitive silver halide emulsion layer, wherein at least one of the silver halide emulsion layer and other hydrophilic colloid layers comprises at least one hydrazine compound which is present in an amount of $1\times10^{-6}$ to $1\times10^{-2}$ mol per mol of silver halide and which is represented by the following general formula (II) in the form of fine solid dispersion:

$$A—(B)_m \quad \text{(II)}$$

wherein A represents a connecting group; B represents a group represented by the following general formula (III); and m represents an integer of from 2 to 6:

$$—(L_2—Ar_2)_n—L_1—Ar_1—NHNH—G_1—R_1 \quad \text{(III)}$$

wherein $Ar_1$ and $Ar_2$ each represents an aromatic group or an aromatic heterocyclic group; $L_1$ and $L_2$ each represents a connecting group; n represents an integer of 0 or 1; $R_1$ represents a hydrogen atom, an alkyl group, an aryl group, a heterocyclic group, an alkoxy group, an aryloxy group, an amino group or a hydrazino group; and $G_1$ represents a —CO— group, an —$SO_2$— group, an —SO— group, a

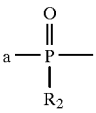

group, a —CO—CO— group, a thiocarbonyl group or an iminomethylene group; $R_2$ represents a group selected from those defined above as $R_1$, and may be different from $R_1$.

* * * * *